US007060424B2

(12) United States Patent
Hosokawa et al.

(10) Patent No.: US 7,060,424 B2
(45) **Date of Patent: *Jun. 13, 2006**

(54) METHOD OF INCREASING SPEED OF SILVER HALIDE COLOR PHOTOSENSITIVE MATERIAL

(75) Inventors: Junichiro Hosokawa, Minami-Ashigara (JP); Yasuhiro Shimada, Minami-Ashigara (JP); Osamu Uchida, Minami-Ashigara (JP); Yasuhiro Ishiwata, Minami-Ashigara (JP); Toshio Kawagishi, Minami-Ashigara (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

This patent is subject to a terminal disclaimer.

(21) Appl. No.: 10/301,762

(22) Filed: Nov. 22, 2002

(65) Prior Publication Data

US 2003/0175627 A1 Sep. 18, 2003

(30) Foreign Application Priority Data

Nov. 22, 2001 (JP) ..... 2001-358036
May 14, 2002 (JP) ..... 2002-138621

(51) Int. Cl.
*G03C 7/30* (2006.01)
*G03C 7/305* (2006.01)
*G03C 7/38* (2006.01)

(52) U.S. Cl. ..... 430/374; 430/383; 430/386; 430/963

(58) Field of Classification Search ..... 430/386, 430/963, 384, 385, 388, 389, 558, 554, 555, 430/374, 383
See application file for complete search history.

(56) References Cited

U.S. PATENT DOCUMENTS

| | | | | |
|---|---|---|---|---|
| 5,041,365 | A * | 8/1991 | Takahashi et al. | 430/551 |
| 5,215,872 | A * | 6/1993 | Goto et al. | 430/387 |
| 5,384,236 | A | 1/1995 | Matsuoka et al. | |
| 5,460,929 | A | 10/1995 | Nagaoka et al. | |
| 5,543,282 | A | 8/1996 | Mihayashi et al. | |
| 5,597,683 | A * | 1/1997 | Uchida et al. | 430/544 |
| 5,605,788 | A * | 2/1997 | Kawagishi et al. | 430/558 |
| 5,736,299 | A | 4/1998 | Watanabe et al. | |
| 6,197,488 | B1 | 3/2001 | Allway et al. | |
| 6,319,660 | B1 | 11/2001 | Allway et al. | |
| 6,350,564 | B1 | 2/2002 | Bringley et al. | |
| 6,423,484 | B1 * | 7/2002 | Yoshioka et al. | 430/546 |
| 6,426,180 | B1 | 7/2002 | Bringley et al. | |

FOREIGN PATENT DOCUMENTS

| | | |
|---|---|---|
| EP | 1 160 620 A2 | 5/2001 |
| EP | 1 143 291 A2 | 10/2001 |
| JP | 51-59943 | 5/1976 |
| JP | 54-32552 | 3/1979 |
| JP | 62-27740 | 2/1987 |
| JP | 11-119364 A | 4/1999 |
| JP | 2000-181002 A | 6/2000 |
| JP | 2001-133931 A | 5/2001 |

OTHER PUBLICATIONS

U.S. Pat. Appl. No. 10/298,633 filed Nov. 19, 2002.

* cited by examiner

*Primary Examiner*—Hoa Van Le
(74) *Attorney, Agent, or Firm*—Sughrue Mion, PLLC

(57) ABSTRACT

A method of increasing speed of a silver halide color photosensitive material. The photosensitive material has, on a support, a blue-sensitive silver halide emulsion layer, a green-sensitive silver halide emulsion layer, a red-sensitive silver halide emulsion layer, and a nonsensitive layer. The method comprises adding, to the emulsion layer or the nonsensitive layer, a compound represented by formula (M) or (C):

(M)

(C)

in the formula (M), $R_1$ represents H or a substituent, Z represents a group of non-metallic atoms required to form a 5-membered azole ring containing 2 to 4 nitrogen atoms, and X represents H or a substituent, and in the formula (C), Za represents —NH— or —CH($R_3$)—, Zb and Zc represent —C($R_4$)═ or —N═, $R_1$, $R_2$ and $R_3$ represent an electron attractive group having a Hammett constant σp of 0.2 to 1.0, $R_4$ represents H or substituent, and X represents H or a substituent.

12 Claims, No Drawings

METHOD OF INCREASING SPEED OF SILVER HALIDE COLOR PHOTOSENSITIVE MATERIAL

CROSS-REFERENCE TO RELATED APPLICATIONS

This application is based upon and claims the benefit of priority from the prior Japanese Patent Applications No. 2001-358036, filed Nov. 22, 2001; and No. 2002-138621, filed May 14, 2002, the entire contents of both of which are incorporated herein by reference.

BACKGROUND OF THE INVENTION

1. Field of the Invention

The present invention relates to a method for obtaining images with an increased speed using a silver halide color photosensitive material.

2. Description of the Related Art

In the field of silver halide color photosensitive materials, it has been a problem to be solved for a great many years to enhance speed without damaging graininess. In general, the speed depends on the grain size of a silver halide emulsion. The larger the grain size of the emulsion, the more the speed increases. However, since the graininess deteriorates with increase of the size of a silver halide grain, the speed and graininess have a trade-off relationship. In this field, it is the most basic and important problem to be solved in improving the image quality of a photosensitive material, to increase speed without deteriorating graininess.

A technique of increasing speed without deteriorating graininess by containing, in a silver halide photosensitive material, a compound having a minimum of three hetero atoms which do not react with an oxidized color developing agent, has been disclosed, for example, in the publication of Jpn. Pat Appln. KOKAI Publication No. (hereinafter referred to as JP-A-) 2000-194085.

However, although it has been found that speed is increased by using the method described in the above publication, the effect thereof is insufficient, and that there are also side effects caused by the addition of such a compound. If the compound coexists with a silver halide emulsion, an undesirable mutual action occurs, and undesirable time-lapse deterioration at the time of storage of a coating liquid or a photosensitive material occurs.

BRIEF SUMMARY OF THE INVENTION

As a result of studies in searching for a more advantageous effect and in solving the problem, the inventors arrived at a method of preferably increasing the speed by a compound represented by general formula (M) or general formula (C). It is presumed that a compound having properties of adsorbing on the surface of an emulsion grain is advantageous for the purpose, and the compound of general formula (M) or (C) of the present invention is superior, in this point, to the compound described in the publication JP-A-2000-194085, although details of the mechanism are unknown. It is also presumed that it is desirable for the compound to be added to have moderate reactivity with an oxidized color developing agent, in view of the properties of inhibiting undesirable latent image bleaching during development.

The compound of general formula (M) or (C) of the present invention is a coupler having reactivity with an oxidized color developing agent. The present invention provides a method of improving speed/graininess of a photosensitive material using this compound. Thus, the present invention is different from the structure of the invention disclosed in the publication of JP-A-2000-194085 describing a photosensitive material whose speed is enhanced by using a compound which does not react with an oxidized color developing agent.

It is an object of the present invention to provide a method of increasing speed of a silver halide color photosensitive material without deteriorating image quality such as graininess.

The inventors have found that the above problem can be solved by using the compound represented by general formula (M) or (C) described later. They believe that the mechanism of the action of the compound of the present invention exerts an effect by eliminating speed loss at the time of development. From analytical results, it is presumed that the compound of the present invention weakens, during development, the ability of a sensitizing dye to adsorb on an emulsion surface, and activates a latent image which is not usually developed, thereby increasing the number of development initiating points. The sensitizing dye exists in an emulsion grain surface at the time of photography and is indispensable to increase optical speed. However, the sensitizing dye sometimes inhibits the oxidized color developing agent from reacting with a latent image at the time of development. The compound of the present invention, when it is used by emulsification dispersion, exists in oil droplets at the time of photography. If the pH of the developing solution is high, the compound dissociates, i.e., elutes from the oil droplet, and acts on the emulsion grain surface. It has been found that in order to make effective use of the above property, it is effective to set the pKa of the compound at a value in the vicinity of, or less than, the pH of the developing solution. By providing the present invention with such a property, a more advantageous effect can be obtained than by the compound disclosed in the publication of JP-A-2000-194085. The reduction in the undesired mutual action with an emulsion can be realized at the time of manufacture or storage of the photosensitive material. The compound of the present invention is designed as a coupler in order to provide the compound with the above property, and its coloring property can also be utilized as a part of a main coupler.

As a result of further studies, it has been found that the use of the above compound leads to enhancement of the reactivity of a latent image on the emulsion surface at the time of development, and, the reactivity with the oxidized color developing agent. However, latent image bleaching due to oxidation easily occurs. It has therefore been found that if the pAg-increasing property of the compound of the present invention is too high, latent image bleaching occurs simultaneously, and thus the desired effect of increasing the number of development initiating points is suppressed.

It has also been found that the above coupler structure brings about an effect of increasing the number of development initiating points, and a coloring dye obtained after reaction with the oxidized color developing agent does not have such an effect, thus it is more preferable if the color forming property of the coupler of the present invention is not too high.

That is, the present invention provides the following method.

(1) A method of increasing speed of a silver halide color photosensitive material by at least one type of a compound represented by the following general formula (M) or general formula (C):

(M)

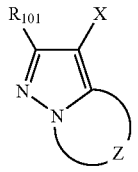

(C)

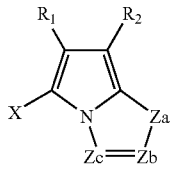

In formula (M), $R_{101}$ represents a hydrogen atom or substituent. Z represents a group of non-metallic atoms required to form a 5-membered azole ring containing 2 to 4 nitrogen atoms. The azole ring may have a substituent (including a fused ring, i.e., an aromatic ring such as a benzene ring may be fused to the azole ring). X represents a hydrogen atom or substituent.

In formula (C), Za represents —NH— or —CH($R_3$)—, and Zb and Zc independently represent —C($R_4$)═ or —N═. $R_1$, $R_2$ and $R_3$ independently represent an electron attractive group having a Hammett constant σp value of 0.2 to 1.0. $R_4$ represents a hydrogen atom or substituent. If there are two $R_4$s in the formula, they may be the same or different. X represents a hydrogen atom or substituent.

(2) The method of increasing speed of a silver halide color photosensitive material according to (1), wherein, in the formula (M), the total number of carbon atoms of the substituents on the azole ring, including $R_{101}$, X and Z, is from 13 to 60.

(3) The method of increasing speed of a silver halide color photosensitive material according to (1) or (2), wherein the method comprises adding, to the silver halide color photosensitive material, the compound represented by the general formula (M):

(M)

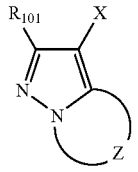

In formula (M), $R_{101}$ represents a hydrogen atom or substituent. Z represents a group of non-metallic atoms required to form a 5-membered azole ring containing 2 to 4 nitrogen atoms. The azole ring may have a substituent (including a fused ring). X represents a hydrogen atom or substituent.

(4) The method of increasing speed of a silver halide color photosensitive material according to (3), wherein the general formula (M) is represented by general formula (M-1):

(M-1)

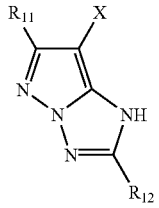

In the formula, $R_{11}$ and $R_{12}$ independently represent a substituent. X represents a hydrogen atom or substituent.

(5) The method of increasing speed of a silver halide color photosensitive material according to (3), wherein the general formula (M) is represented by general formula (M-3):

(M-3)

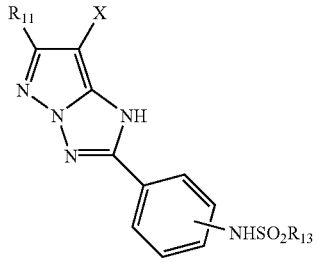

In the formula, $R_{11}$ and $R_{13}$ independently represent a substituent. X represents a hydrogen atom or substituent.

(6) The method of increasing speed of a silver halide color photosensitive material according to any one of (1) to (5), wherein the addition of the compound represented by the general formula (M) or (C) changes a film pAg ($\Delta pAg_F$) of the silver halide color photosensitive material by 0 to 0.3.

(7) The method of increasing speed of a silver halide color photosensitive material according to any one of (1) to (6), wherein the compound represented by the general formula (M) or (C) has a pKa value of 6.0 to 8.4.

(8) The method of increasing speed of a silver halide color photosensitive material according to any one of (1) to (7), wherein the compound represented by the general formula (M) or (C) has a reactivity (CRV) with an oxidized color developing agent of 0.01 to 0.1.

(9) The method of increasing speed of a silver halide color photosensitive material according to any one of (1) to (8), wherein the method comprises adding, to a red-sensitive silver halide emulsion layer of the silver halide color photosensitive material, the compound represented by the general formula (M) or (C).

(10) The method of increasing speed of a silver halide color photosensitive material according to any one of (1) to (9), wherein the method comprises adding, to a blue-sensitive silver halide emulsion layer of the silver halide color photosensitive material, the compound represented by the general formula (M) or (C).

(11) The method of increasing speed of a silver halide color photosensitive material according to any one of (1) to (10), wherein a layer of the photosensitive material containing tabular grains having an average aspect ratio of 8 or more, contains at least one compound represented by the general formula (M) or genera formula (C).

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

DETAILED DESCRIPTION OF THE INVENTION

The compound represented by general formula (M) or (C) will be described below.

(M)

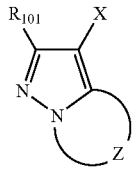

(C)

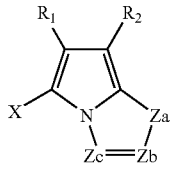

In formula (M), $R_{101}$ represents a hydrogen atom or substituent. Z represents a group of non-metallic atoms required to form a 5-membered azole ring containing 2 to 4 nitrogen atoms. The azole ring may have a substituent (including a fused ring). X represents a hydrogen atom or substituent.

In formula (C), Za represents —NH— or —CH($R_3$)—, and Zb and Zc independently represent —C($R_4$)═ or —N═. $R_1$, $R_2$ and $R_3$ independently represent an electron attractive group having a Hammett constant σp value of 0.2 to 1.0. $R_4$ represents a hydrogen atom or substituent. If there are two $R_4$s in the formula, they may be the same or different. X represents a hydrogen atom or substituent.

The compound of the present invention will be described in detail below. Of the skeletons represented by formula (M), preferable skeletons are 1H-pyrazolo[1,5-b][1,2,4]triazole and 1H-pyrazolo[5,1-c][1,2,4]triazole, which are represented by formula (M-1) and (M-2), respectively.

(M-1)

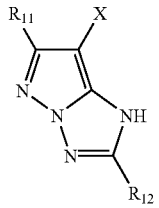

-continued (M-2)

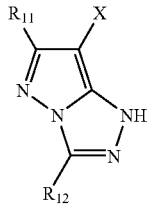

In the formula, $R_{11}$ and $R_{12}$ represent a substituent. X represents a hydrogen atom or substituent.

The substituents $R_{11}$, $R_{12}$ and X in formula (M-1) or (M-2) will be described in detail.

$R_{11}$ preferably represents a halogen atom (e.g., chlorine atom, bromine atom, and fluorine atom), alkyl group (having 1 to 60 carbon atoms, e.g., methyl, ethyl, propyl, iso-butyl, t-butyl, t-octyl, 1-ethylhexyl, nonyl, cyclohexyl, undecyl, pentadecyl, n-hexadecyl, and 3-decanamidepropyl), alkenyl group (having 2 to 60 carbon atoms, e.g., vinyl, allyl, and oleyl), cycloalkyl group (having 5 to 60 carbon atoms, e.g., cyclopentyl, cyclohexyl, 4-t-butylcyclohexyl, 1-indanyl, and cyclododecyl), aryl group (having 6 to 60 carbon atoms, e.g., phenyl, p-tolyl, and naphthyl), acylamino group (having 2 to 60 carbon atoms, e.g., acetylamino, n-butanamide, octanoylamino, 2-hexyldecanamide, 2-(2',4'-di-t-amylphenoxy)butanamide, benzoylamino, and nicotinamide), sulfonamide group (having 1 to 60 carbon atoms, e.g., methanesulfonamide, octanesulfonamide, and benzenesulfonamide), ureide group (having 2 to 60 carbon atoms, e.g., decylaminocarbonylamino, and di-n-octylaminocarbonylamino), urethane group (having 2 to 60 carbon atoms, e.g., dodecyloxycarbonylamino, phenoxycarbonylamino, and 2-ethylhexyloxycarbonylamino), alkoxy group (having 1 to 60 carbon atoms, e.g., methoxy, ethoxy, butoxy, n-octyloxy, hexadecyloxy, and methoxyethoxy), aryloxy group (having 6 to 60 carbon atoms, e.g., phenoxy, 2,4-di-t-amylphenoxy, 4-t-octylphenoxy, and naphthoxy), alkylthio group (having 1 to 60 carbon atoms, e.g., methylthio, ethylthio, butylthio, and hexadecylthio), arylthio group (having 6 to 60 carbon atoms, e.g., phenylthio, and 4-dodecyloxyphenylthio), acyl group (having 1 to 60 carbon atoms, e.g., acetyl, benzoyl, butanoyl, and dodecanoyl), sulfonyl group (having 1 to 60 carbon atoms, e.g., methanesulfonyl, butanesulfonyl, and toluenesulfonyl), cyano group, carbamoyl group (having 1 to 60 carbon atoms, e.g., N,N-dicyclohexylcarbamoyl), sulfamoyl group (having 0 to 60 carbon atoms, e.g., N,N-dimethylsulfamoyl), hydroxy group, sulfo group, carboxyl group, nitro group, alkylamino group (having 1 to 60 carbon atoms, e.g., methylamino, diethylamino, octylamino, and octadecylamino), arylamino group (having 6 to 60 carbon atoms, e.g., phenylamino, naphthylamino, and N-methyl-N-phenylamino), heterocyclic group (having 0 to 60 carbon atoms, preferably 3- to 8-membered, and more preferably, 5- to 6-membered heterocyclic group including a hetero atom, which forms a ring, selected from the group consisting of a nitrogen atom, oxygen atom, and sulfur atom, and more preferably, including a carbon atom as the ring-forming atoms in addition to the hetero atoms, e.g., a group indicated as an example of term X described later), and an acyloxy group (having 1 to 60 carbon atoms, e.g., formyloxy, acetyloxy, myristoyloxy, and benzoyloxy).

Of the above, the alkyl group, cycloalkyl group, aryl group, acylamino group, ureide group, urethane group, alkoxy group, aryloxy group, alkylthio group, arylthio group, acyl group, sulfonyl group, cyano group, carbamoyl group, and sulfamoyl group include those having a substituent. Examples of the substituent are an alkyl group, cycloalkyl group, aryl group, acylamino group, ureide group, urethane group, alkoxy group, aryloxy group, alkylthio group, arylthio group, acyl group, sulfonyl group, cyano group, carbamoyl group and sulfamoyl group.

Of these substituents, preferable examples of $R_{11}$ are an alkyl group, aryl group, alkoxy group, and aryloxy group. An alkyl group, alkoxy group and aryloxy group are more preferably. A branched alkyl group is especially preferable.

$R_{12}$ preferably represents the substituents as indicated for $R_{11}$. More preferable examples of the substituents are an alkyl group, aryl group, heterocyclic group, alkoxy group, and aryloxy group.

$R_{12}$ still more preferably represents a substituted alkyl group and substituted aryl group, and most preferably, a substituted aryl group. Compounds represented by general formulae (M-3) and (M-4) are preferable.

In the general formula (M), the total number of carbon atoms of the substituents on the azole ring, including $R_{101}$, X and Z, is not particularly limited, but the total number is preferably from 13 to 60, and more preferably 20 to 50, in order to enhance the adsorption capacity of the compound represented by the general formula (M) to emulsion grains and to enhance the advantage in improving the speed/graininess ratio.

(M-3)

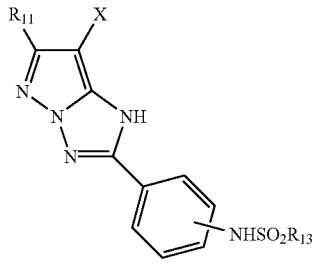

(M-4)

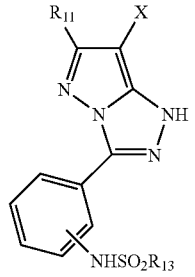

In the formula, $R_{11}$ and X have the same meanings as those defined in general formulae (M-1) and (M-2). $R_{13}$ represents a substituent. Examples of preferable substituents represented by $R_{13}$ are the substituents enumerated above for $R_{11}$. Examples of more preferable substituents are a substituted aryl group, and a substituted or unsubstituted alkyl group. As the substituent in this case, the substituents enumerated above as examples of $R_{11}$ are preferable.

X represents a hydrogen atom or substituent. Preferable examples of the substituents are those enumerated as examples of $R_{11}$. More preferable examples of the substituents represented by X are an alkyl group, alkoxycarbonyl group, carbamoyl group or a group which leaves by reaction with an oxidized developing agent. Examples of the leaving group are a halogen atom (fluorine, chlorine, bromine, etc.), alkoxy group (ethoxy, methoxycarbonylmethoxy, carboxypropyloxy, methanesulfonylethoxy, perfluoropropoxy, etc.), aryloxy group (4-carboxyphenoxy, 4-(4-hydroxyphenylsulfonyl)phenoxy, 4-methanesulfonyl-3-carboxyphenoxy, 2-methanesulfonyl-4-acetylsulfamoylphenoxy, etc.), acyloxy group (acetoxy, benzoyloxy, etc.), sulfonyloxy group (methanesulfonyloxy, benzenesulfonyloxy, etc.), acylamino group (heptafluorobutyrylamino, etc.), sulfonamide group (methanesulfonamide, etc.), alkoxycarbonyloxy group (ethoxycarbonyloxy, etc.), carbamoyloxy group (diethylcarbamoyloxy, piperidinocarbonyloxy, morpholinocarbonyloxy, etc.), alkylthio group (2-carboxyethylthio, etc.), arylthio group (2-octyloxy-5-t-octylphenylthio, 2-(2,4-di-t-amylphenoxy)butyrylaminophenylthio, etc.), heterocyclic thio group (1-phenyltetrazolylthio, 2-benzimidazolylthio, etc.), heterocyclic oxy group (2-pyridyloxy, 5-nitro-2-pyridyloxy, etc.), 5- or 6-membered, nitrogen-containing heterocyclic group (1-triazolyl, 1-imidazolyl, 1-pyrazolyl, 5-chloro-1-tetrazolyl, 1-benzotriazolyl, 2-phenylcarbamoyl-1-imidazolyl, 5,5-dimethylhydantoin-3-yl, 1-benzylhydantoin-3-yl, 5,5-dimethyloxazolidine-2,4-dione-3-yl, purine, etc.), azo group (4-methoxyphenylazo, 4-pivaloylaminophenylazo, etc.), etc.

The substituent represented by X is preferably an alkyl group, alkoxycarbonyl group, carbamoyl group, halogen atom, alkoxy group, aryloxy group, alkylthio group, arylthio group, or a 5- or 6-membered, nitrogen-containing heterocyclic group which bonds to the coupling active position with a nitrogen atom, and more preferably an alkyl group, carbamoyl group, halogen atom, substituted aryloxy group, substituted arylthio group, alkylthio group, or 1-pyrazolyl group. X more preferably represents a substituent.

The compound preferably used in the present invention which is represented by general formulae (M-1) and (M-2) may form a polymer which is greater than or equal to a dimer through $R_{11}$ and $R_{12}$, or may bond to a macromolecular chain. In the present invention, formula (M-1) is preferable and formula (M-3) is more preferable.

Next, general formula (C) will be described. The formula (C) of the present invention is specifically expressed by the following formulae (C3) to (C10):

(C3)

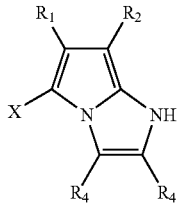

(C4)

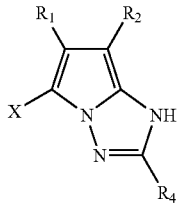

-continued (C5)

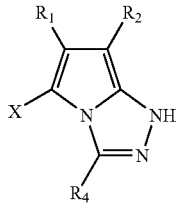

(C6)

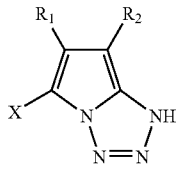

(C7)

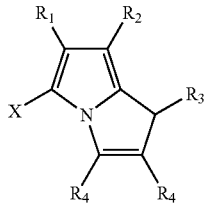

(C8)

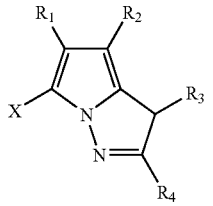

(C9)

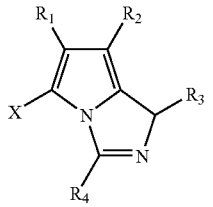

(C10)

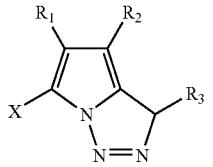

In the formulae, $R_1$ to $R_4$ and X have the same meanings as those defined in formula (C).

In the present invention, the compounds represented by formulae (C3), (C4), (C5) and (C8) are preferable, and the compound represented by (C4) is especially preferable.

In formula (C), the substituent represented by $R_1$, $R_2$ and $R_3$ is an electron attractive group having a Hammett constant up value of 0.20 to 1.0, preferably an electron attractive group having a up value of 0.20 to 0.8. Hammett's rule is an empirical rule proposed by L. P. Hammett in 1935 in order to quantitatively argue the effects of substituents on reaction or equilibrium of benzene derivatives. The rule is widely regarded as appropriate these days. The substituent constants obtained by the Hammett rule include a σp value and a σm value, and these values are described in a large amount of general literature. For example, the values are described in detail in J. A. Dean ed., "Lange's Handbook of Chemistry," the 12th edition, 1979 (McGraw-Hill), "The Extra Number of The Domain of Chemistry (KAGAKUNO RYOIKI ZOUKAN)," Vol. 122, pages 96 to 103, 1979 (Nanko Do) and Chemical Reviews, Vol. 91, pp. 165–195 (1991).

In the present invention, $R_1$, $R_2$, and $R_3$ are defined by the Hammett constant up value. However, this does not mean that $R_1$, $R_2$, and $R_3$ are limited to substituents having the known values stated in the above literature. That is, the present invention includes, of course, substituents having values that fall within the above range when measured on the basis of Hammett's rule even if they are unknown in literature.

Examples of $R_1$, $R_2$, and $R_3$, as the electron attractive group having a σp value of 0.2 to 1.0, are an acyl group, alkoxycarbonyl group, aryloxycarbonyl group, carbamoyl group, cyano group, nitro group, dialkylphosphono group, diarylphosphono group, diarylphosphinyl group, alkylsulfinyl group, arylsulfinyl group, alkylsulfonyl group, arylsulfonyl group, etc. Of these substituents, those capable of further having substituents can further have substituents to be enumerated later for $R_4$.

$R_1$, $R_2$, and $R_3$ preferably represent an acyl group, alkoxycarbonyl group, aryloxycarbonyl group, carbamoyl group, cyano group, and sulfonyl group, and more preferably, an cyano group, acyl group, alkoxycarbonyl group, aryloxycarbonyl group, and carbamoyl group.

A preferable example of the combination of $R_1$ and $R_2$, is one wherein $R_1$ represents a cyano group and $R_2$ represents an alkoxycarbonyl group.

$R_4$ represents a hydrogen atom or substituent. Examples of the substituent are those enumerated above for $R_{11}$. $R_4$ preferably represents a substituent.

Preferable examples of the substituents represented by $R_4$ are an alkyl group, aryl group, heterocyclic group, alkoxy group, aryloxy group, and acylamino group. An alkyl group and substituted aryl group are more preferable, and a substituted aryl group is most preferable. Examples of the substituent in this case are those enumerated above for $R_4$.

X has the same meaning as that defined in formula (M).

The following are examples of a coupler preferably used in the present invention. However, the present invention is not limited to these examples.

(1)

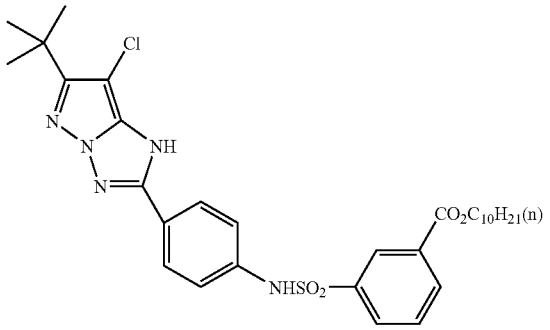

-continued
(2)
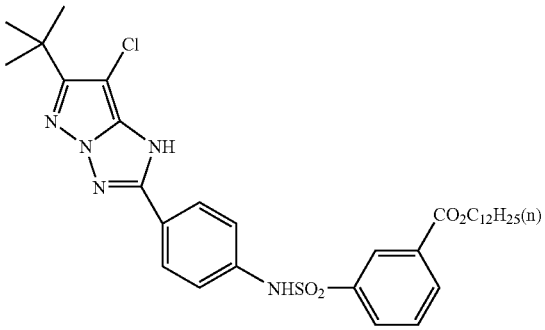
(3)
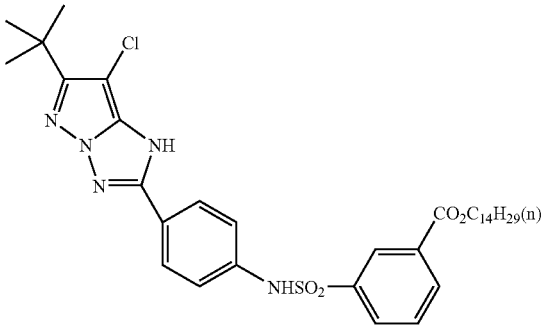
(4)
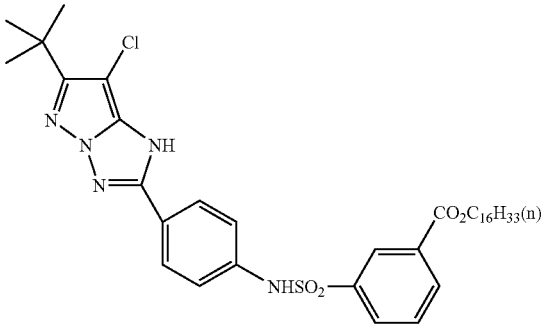
(5)
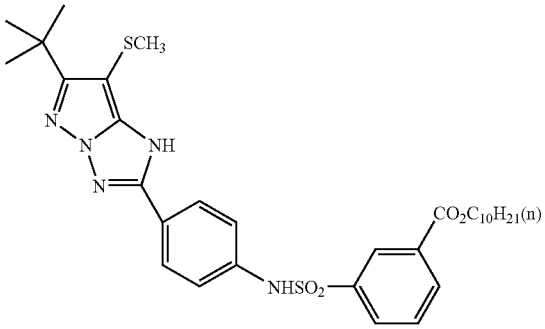
-continued
(6)
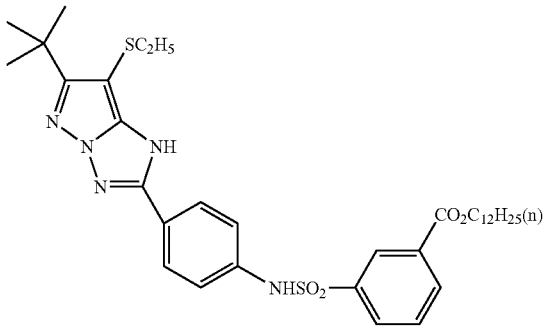
(7)
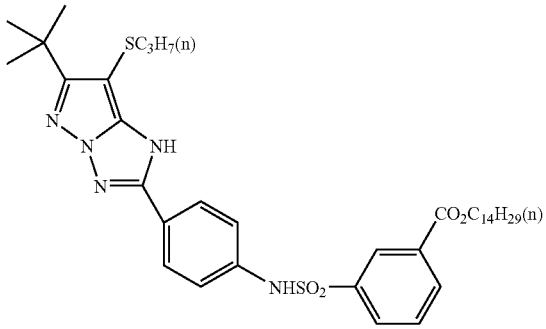
(8)
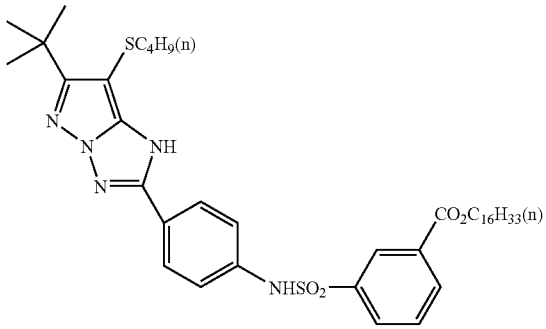
(9)
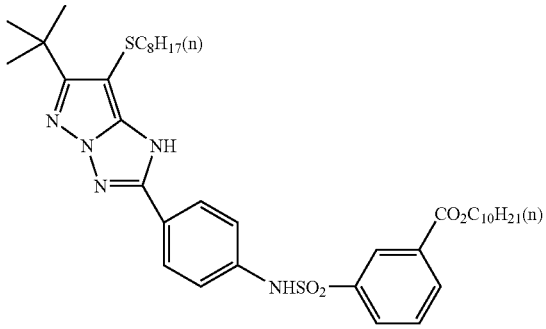

-continued
(10)
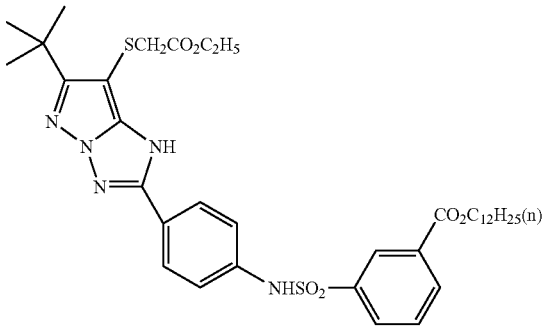
(11)
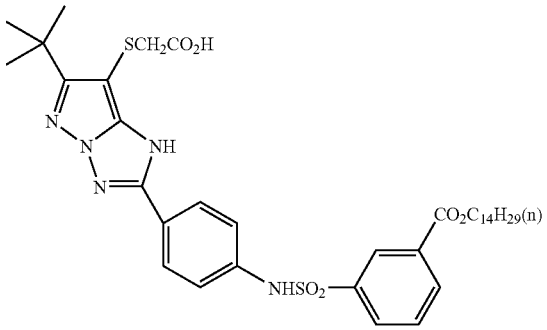
(12)
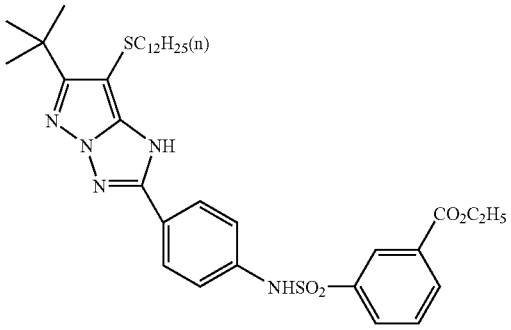
(13)
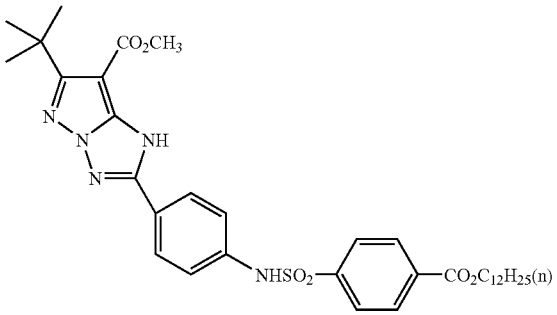
-continued
(14)
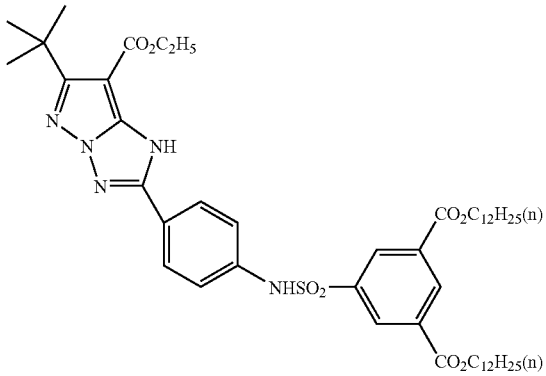
(15)
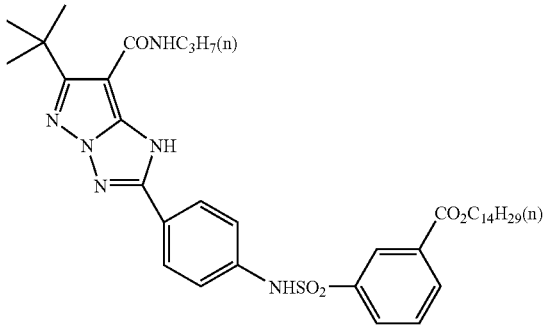
(16)
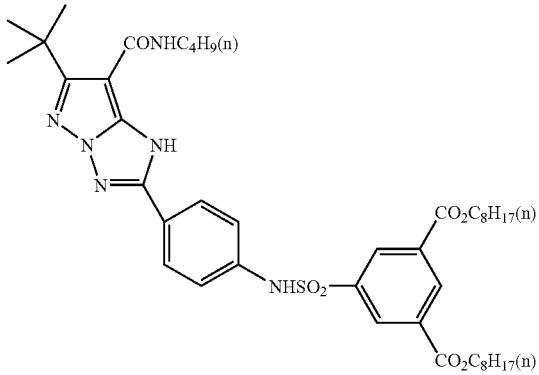
(17)
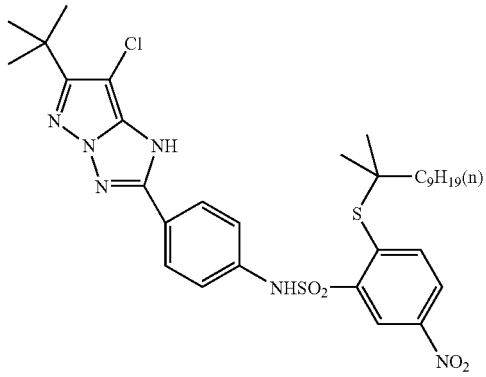

-continued
(18)
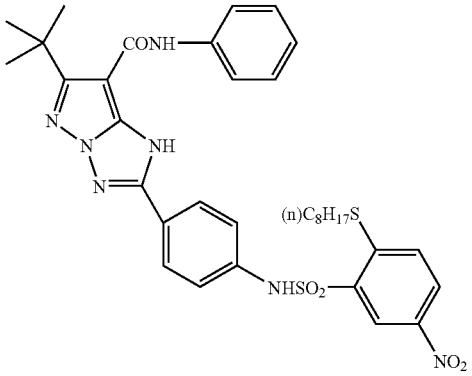
(19)
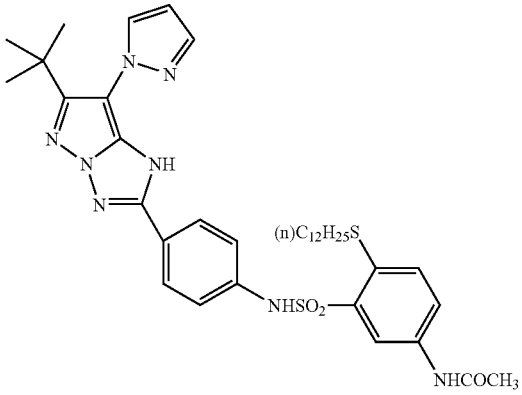
(20)
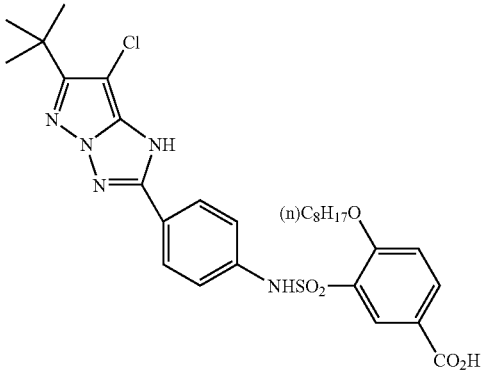
(21)
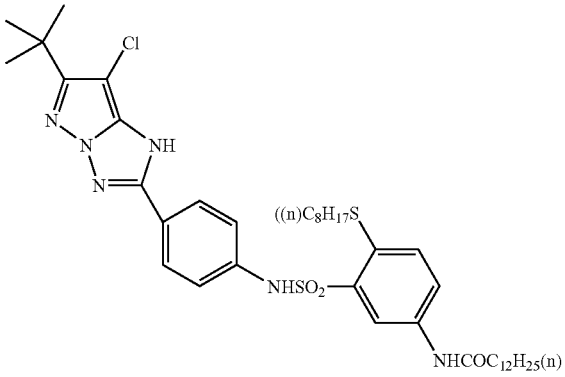
-continued
(22)
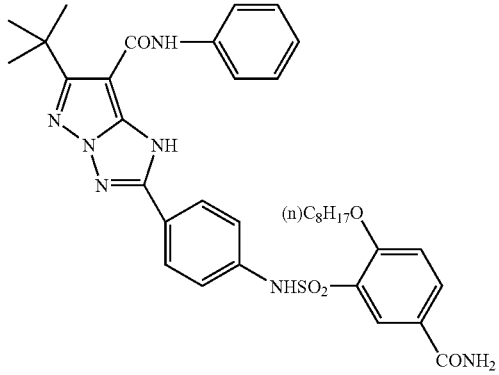
(23)
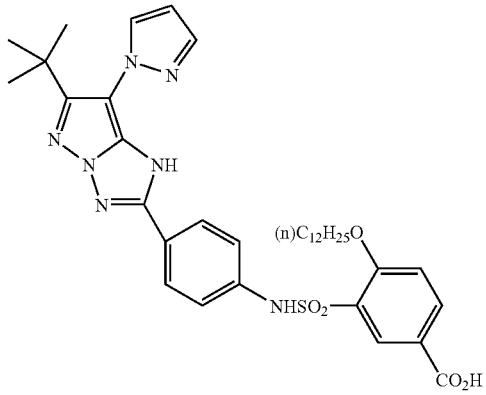
(24)
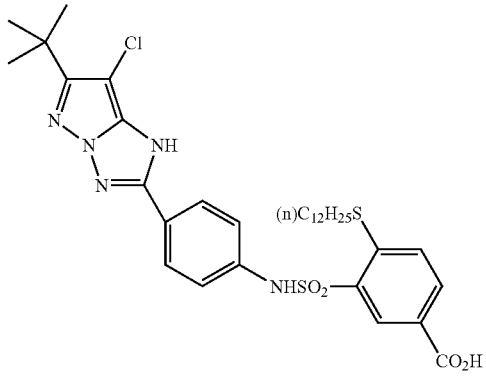
(25)
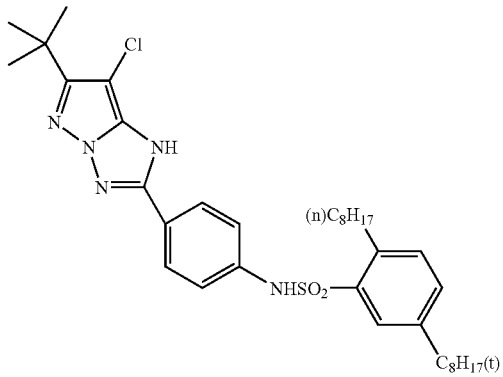

-continued
(26)
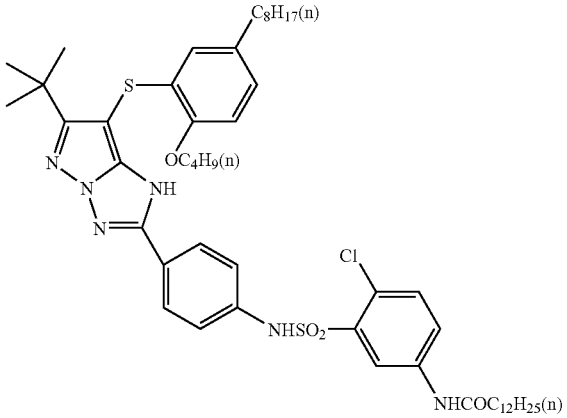
(27)
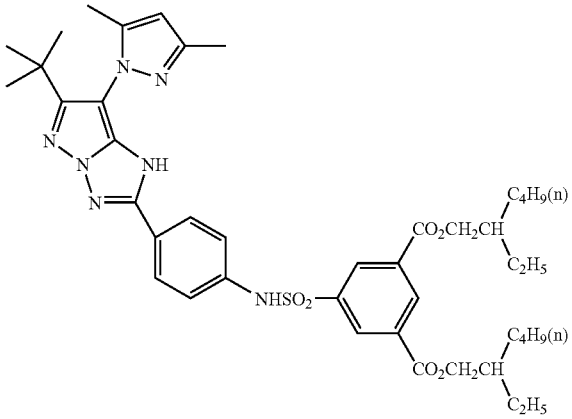
(28)
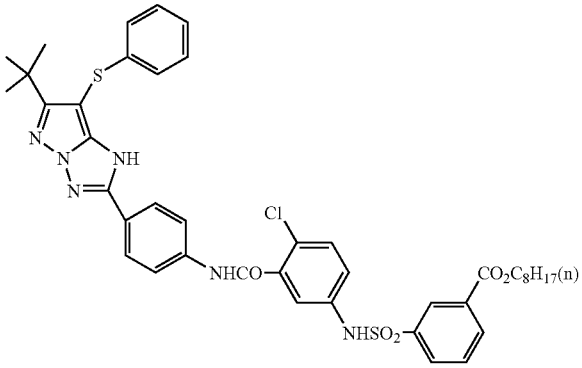
(29)
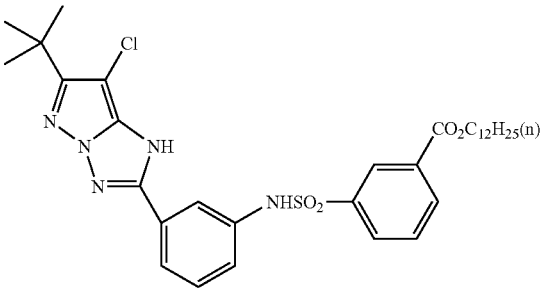
-continued
(30)
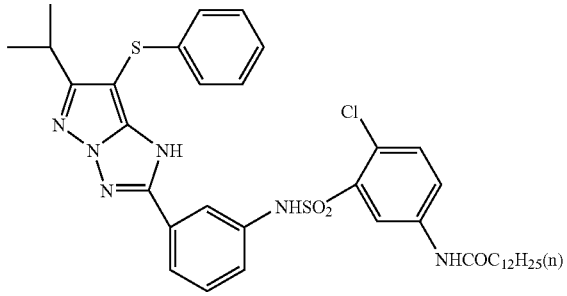
(31)
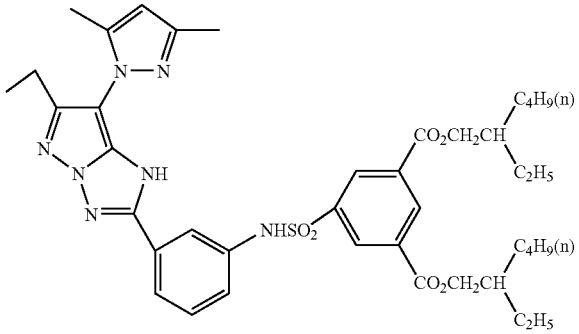
(32)
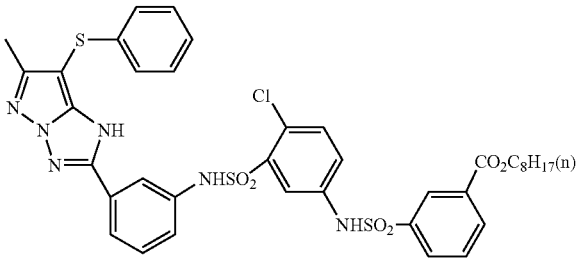
(33)
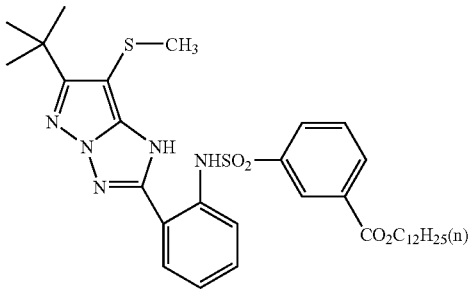
(34)
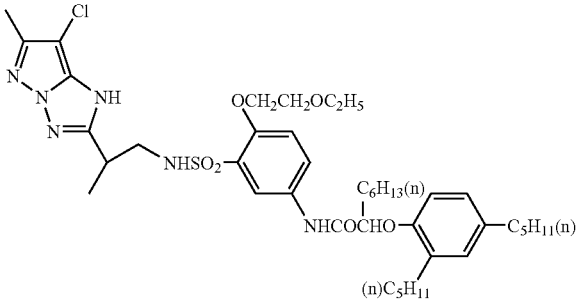

-continued
(35)
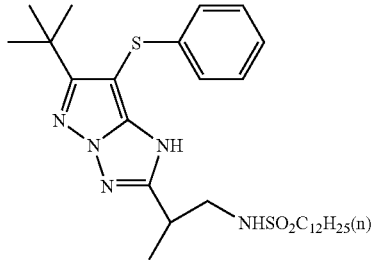
(36)
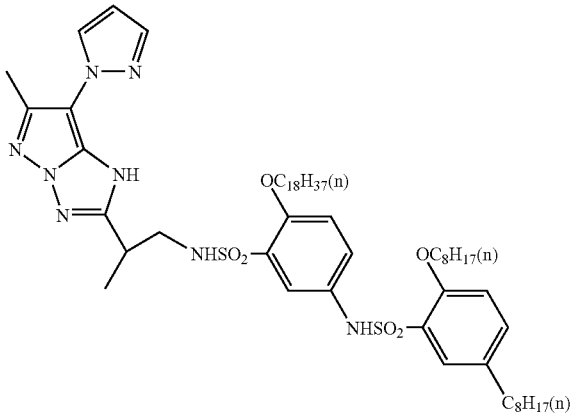
(37)
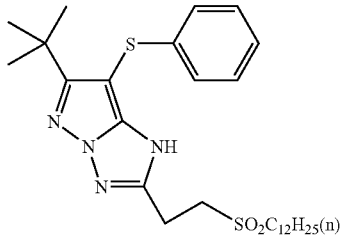
(38)
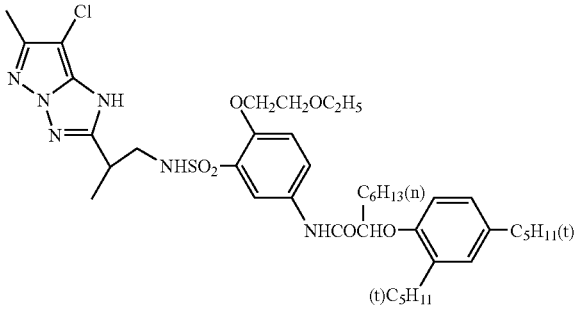
(39)
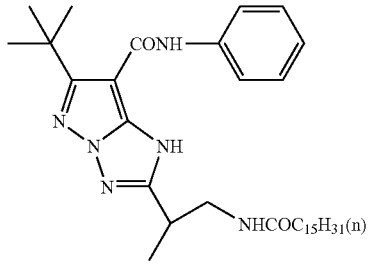
-continued
(40)
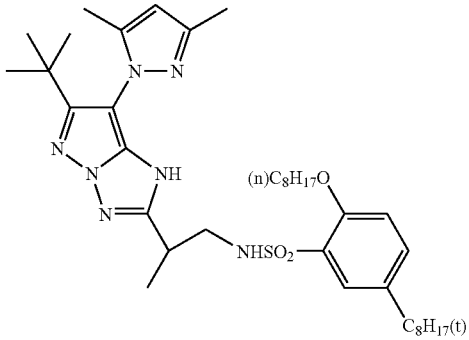
(41)
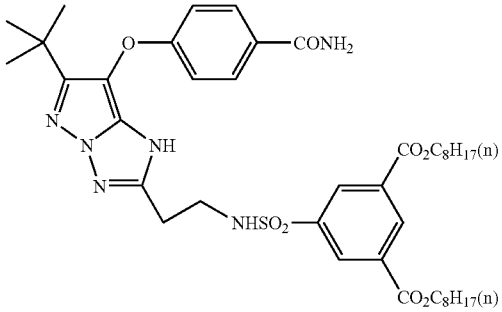
(42)
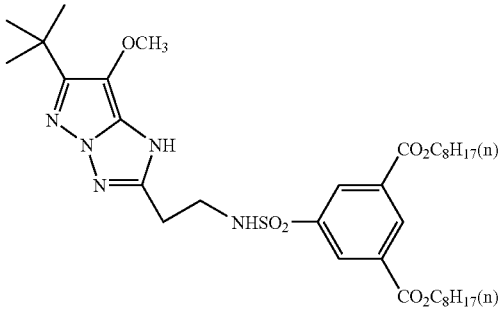
(43)
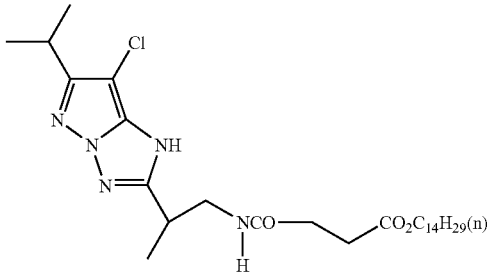
(44)
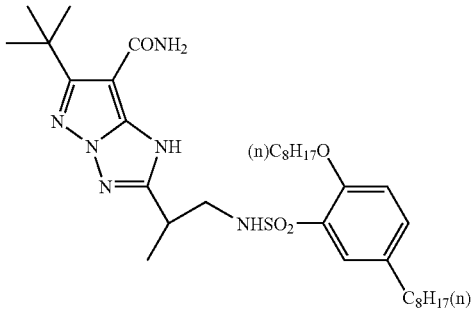

-continued
(45)
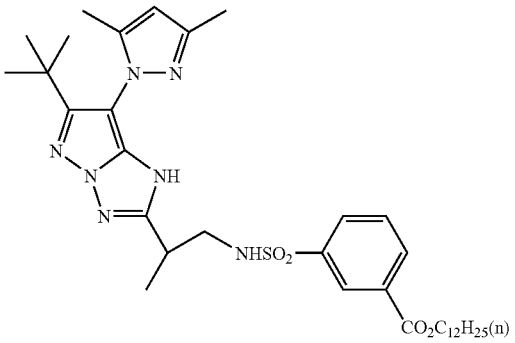
(46)
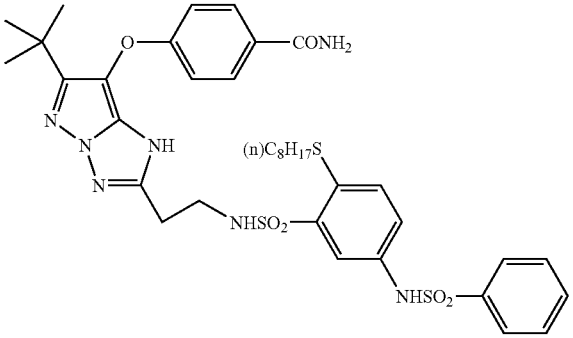
(47)
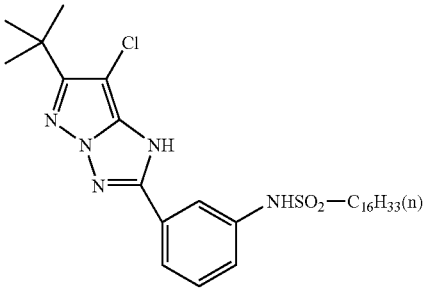
(48)
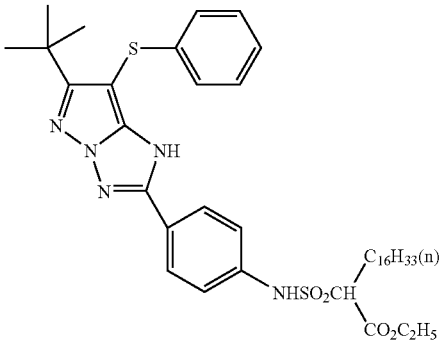
-continued
(49)
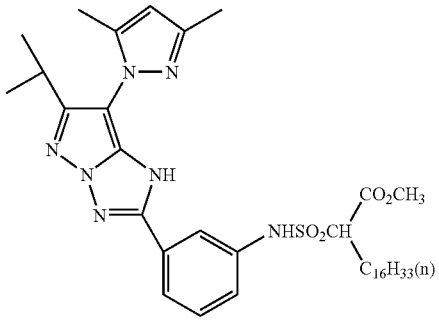
(50)
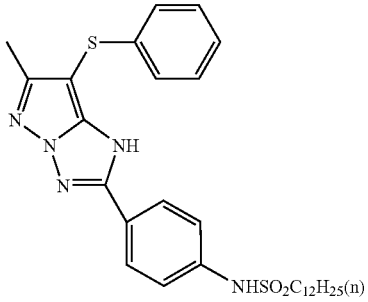
(51)
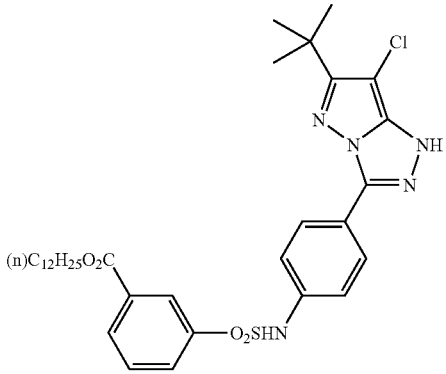
(52)
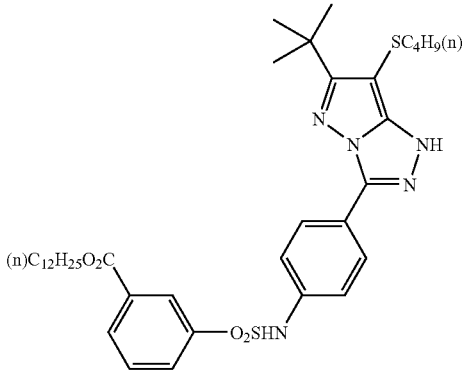

-continued
(53)
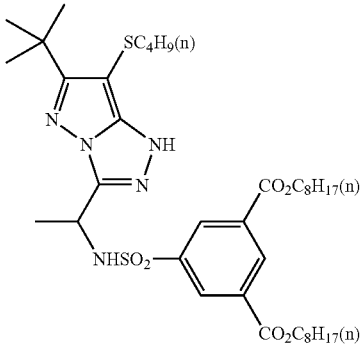
(54)
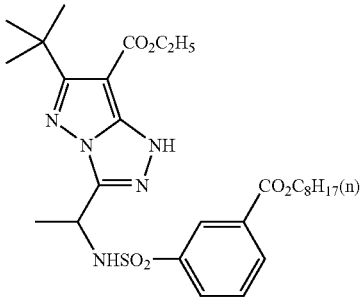
(55)
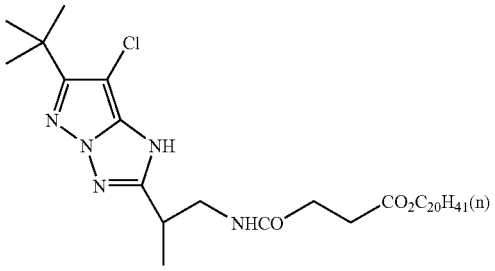
(56)
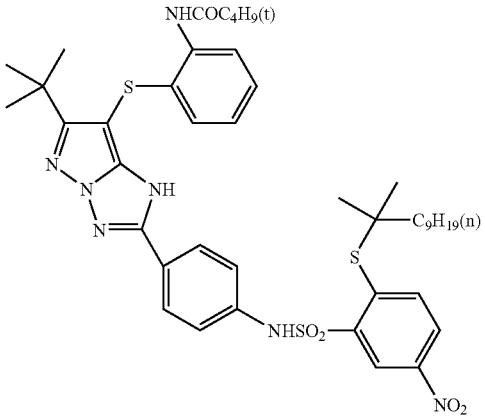
-continued
(57)
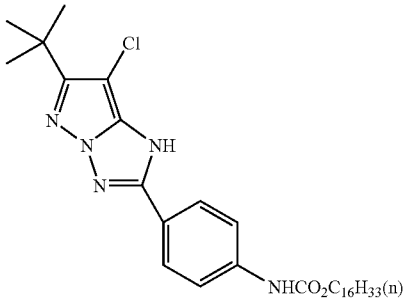
(58)
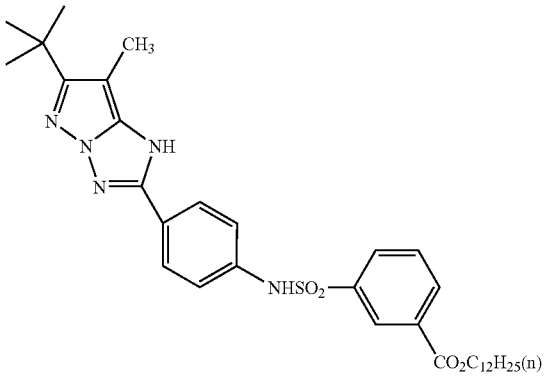
(59)
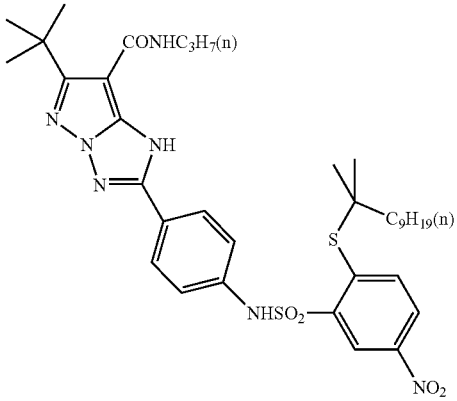
(60)
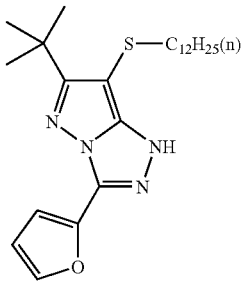

-continued
(61)
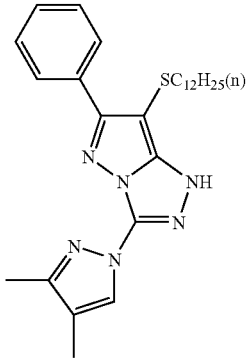
(62)
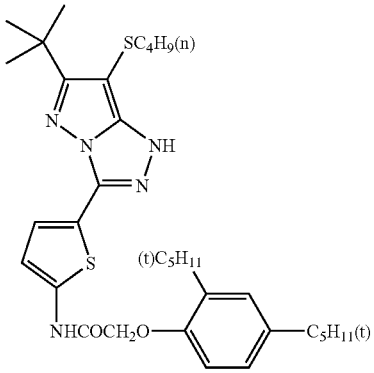
(63)
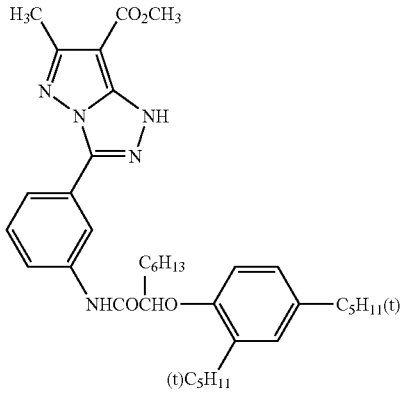
(64)
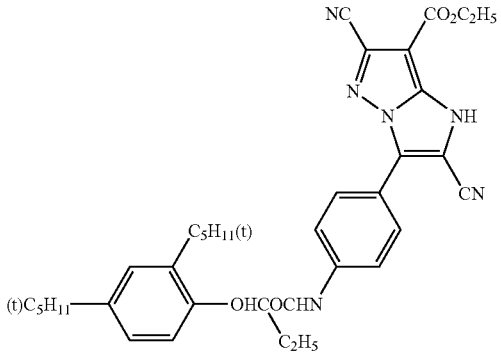
-continued
(65)
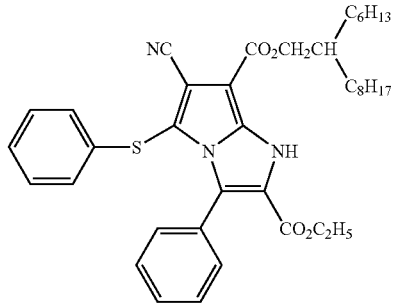
(66)
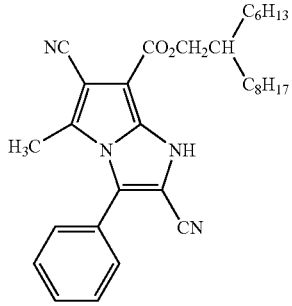
(67)
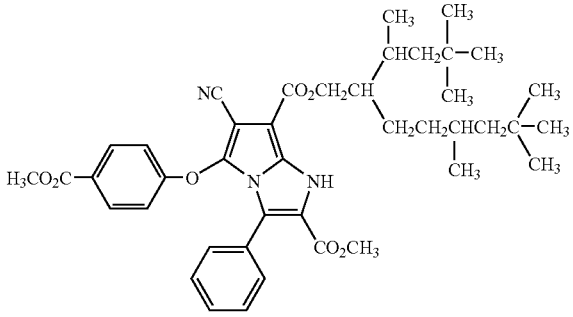
(68)
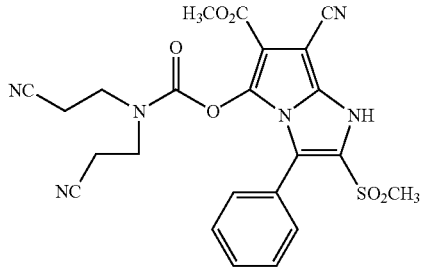
(69)
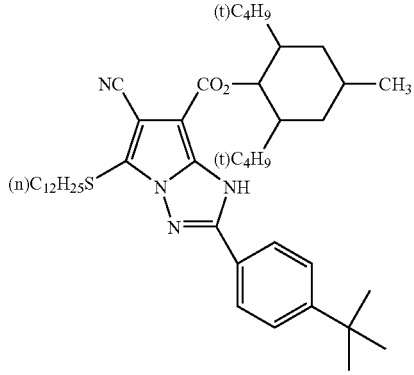

-continued
(70)
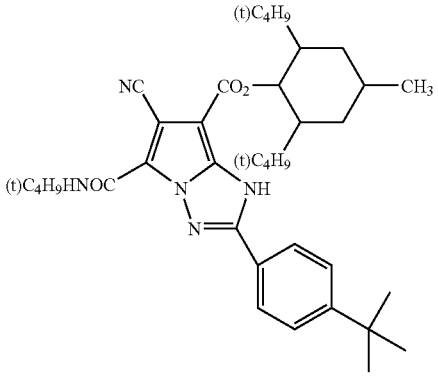
(71)
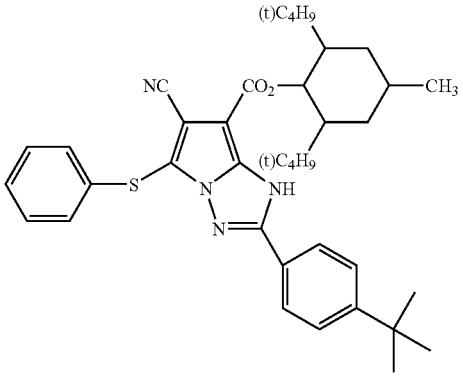
(72)
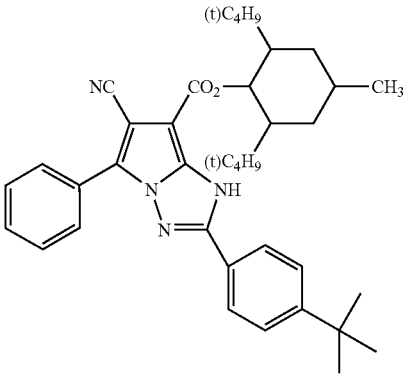
(73)
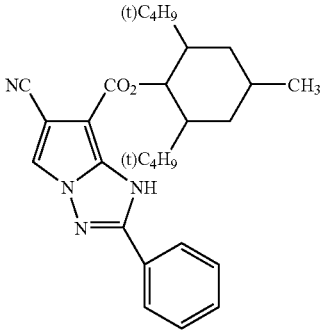
-continued
(74)
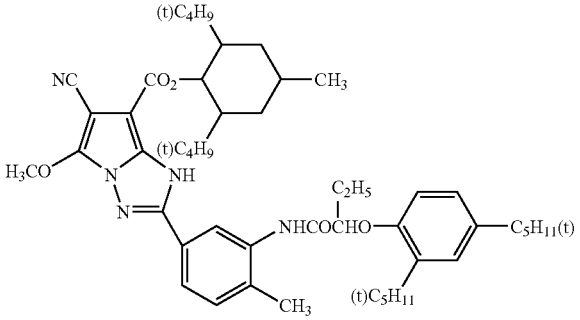
(75)
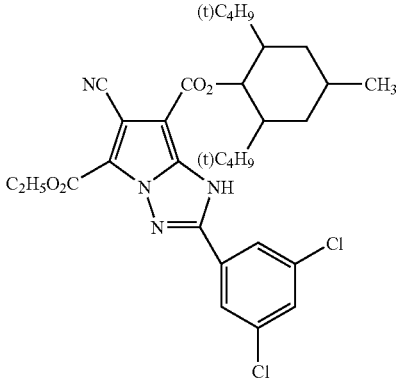
(76)
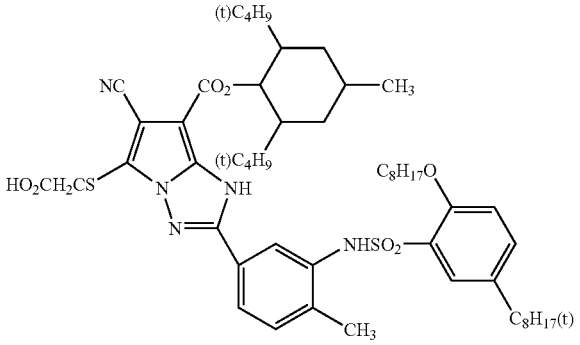
(77)
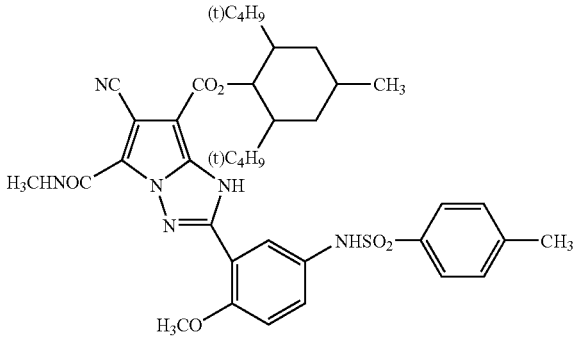

-continued
(78)
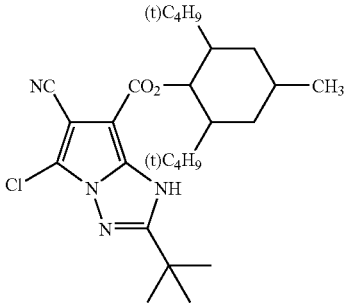
(79)
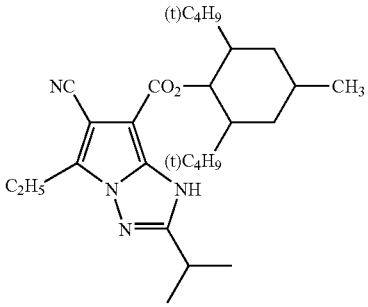
(80)
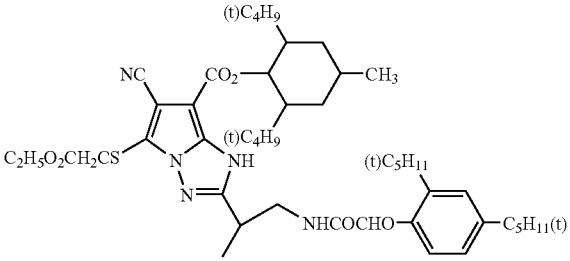
(81)
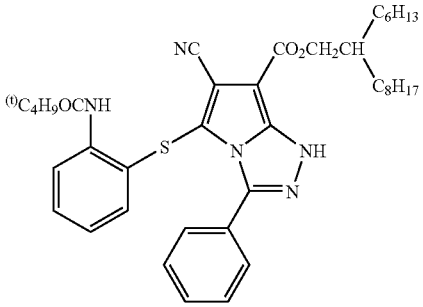
(82)
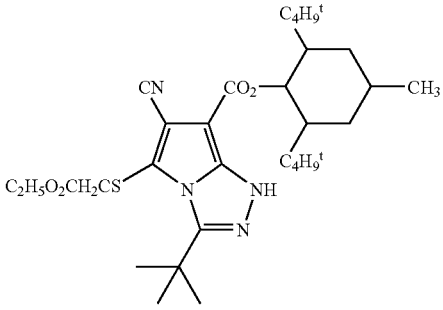
-continued
(83)
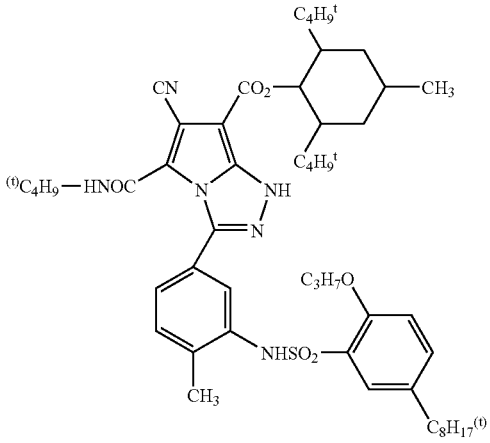
(84)
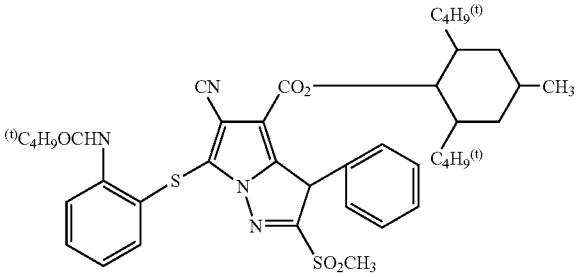
(85)
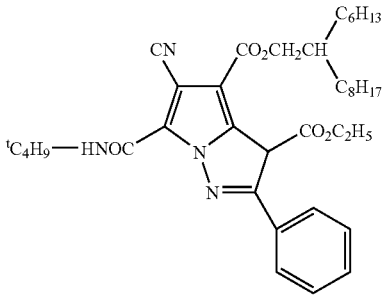
(86)
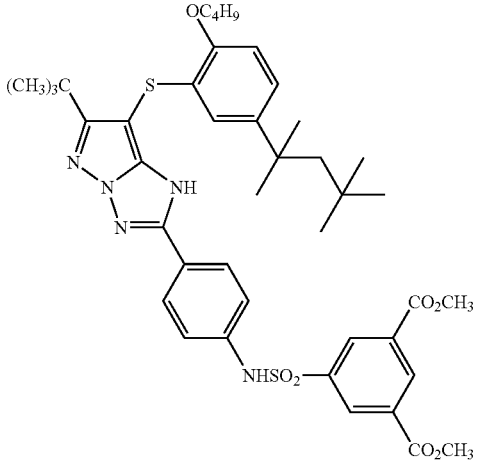

-continued
(87)
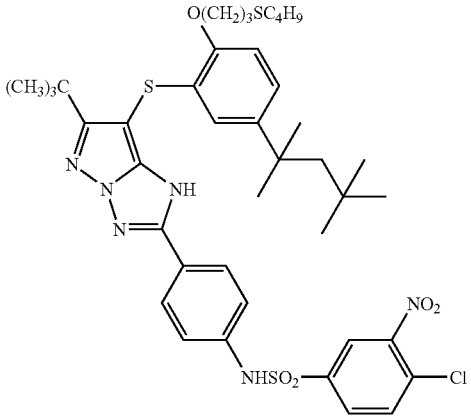
(88)
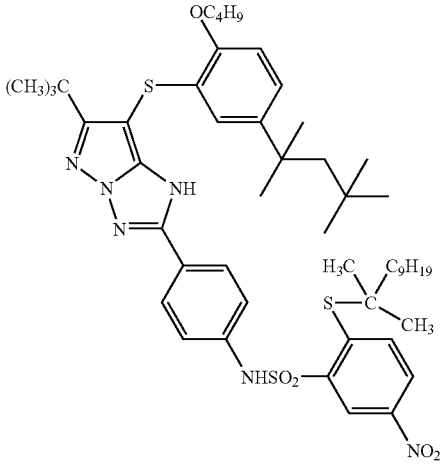
(89)
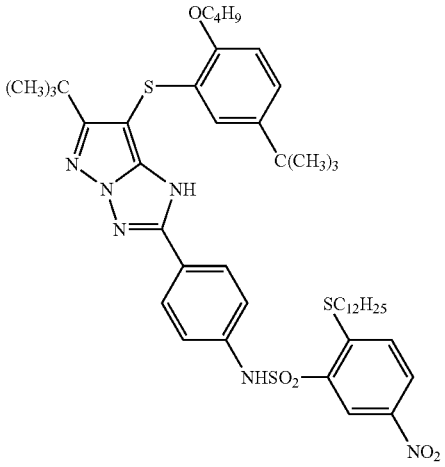
-continued
(90)
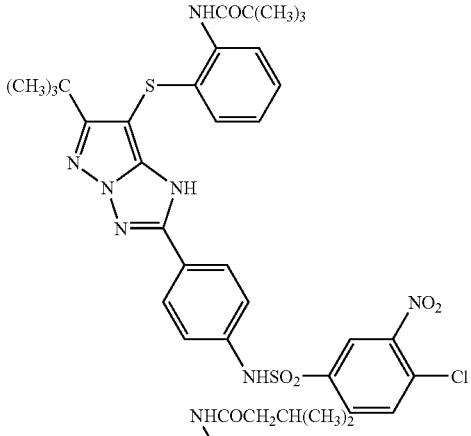
(91)
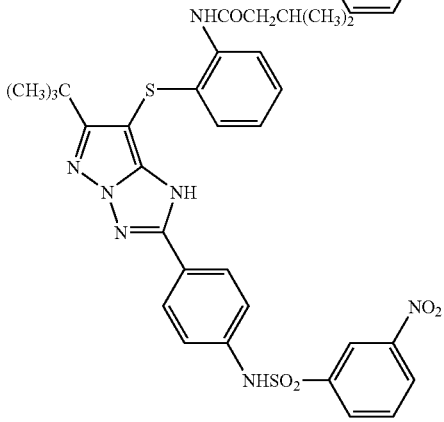
(92)
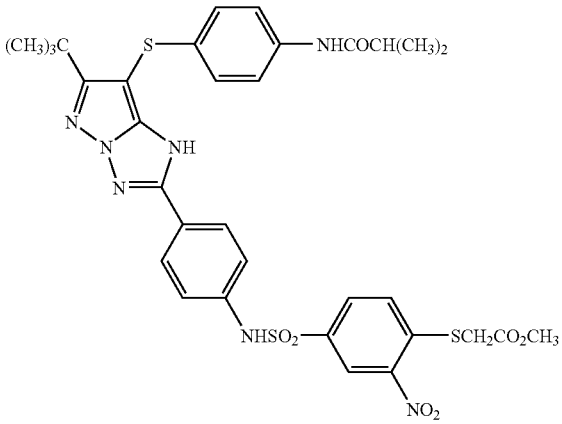
(93)
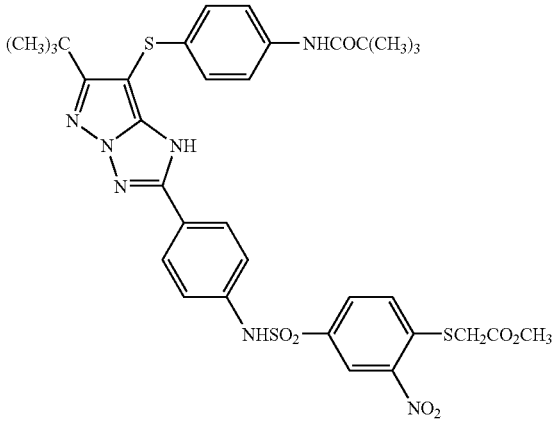

-continued
(94)
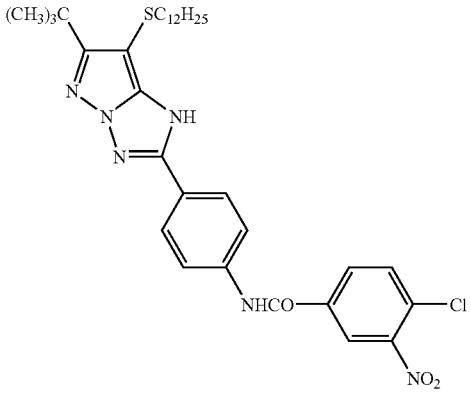
(95)
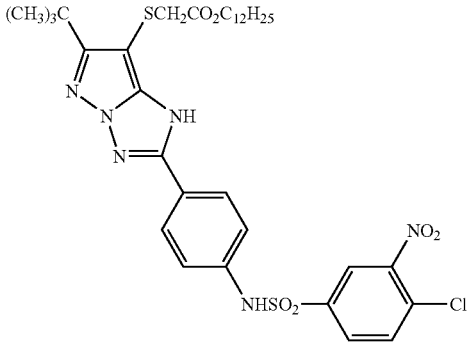
(96)
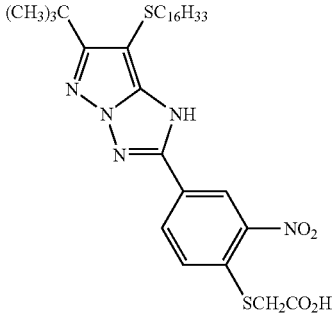
(97)
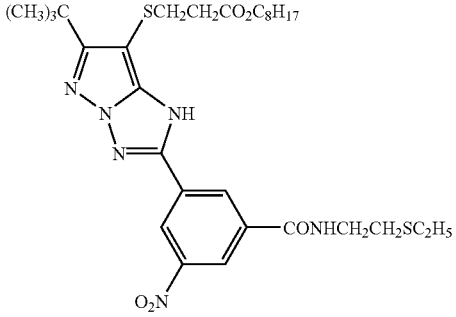
-continued
(98)
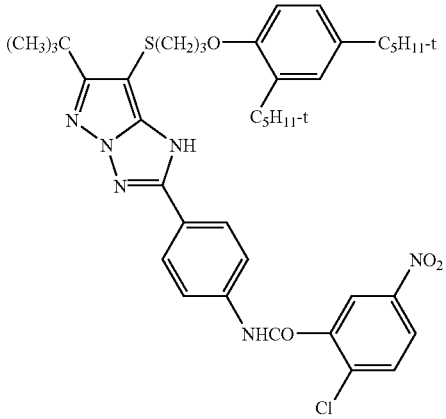
(99)
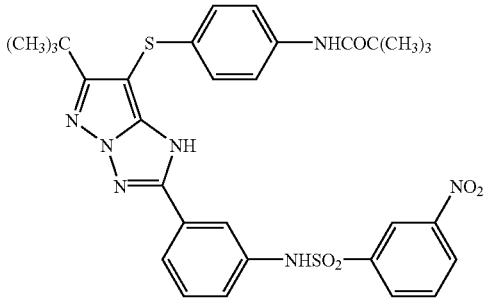
(100)
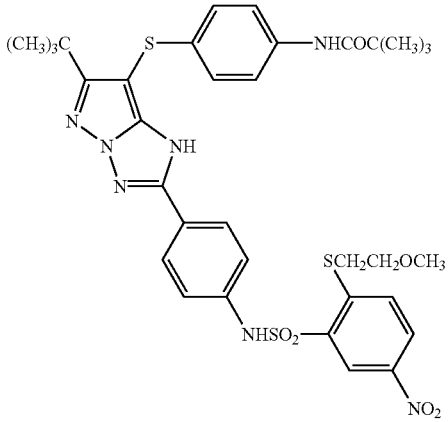
(101)
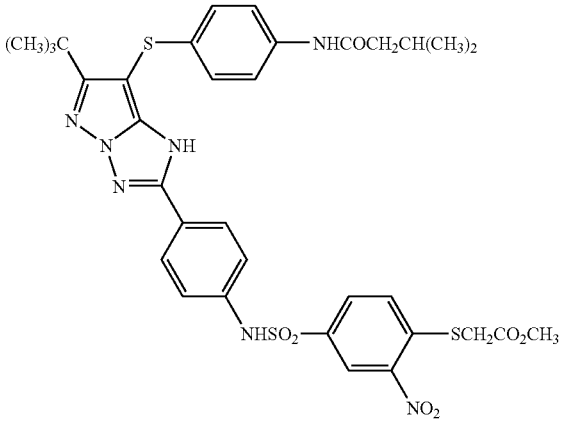

-continued
(102)
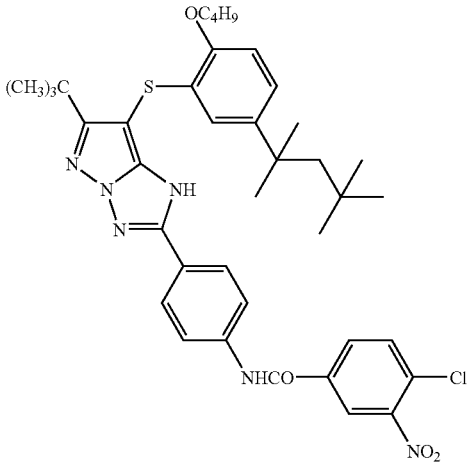
(103)
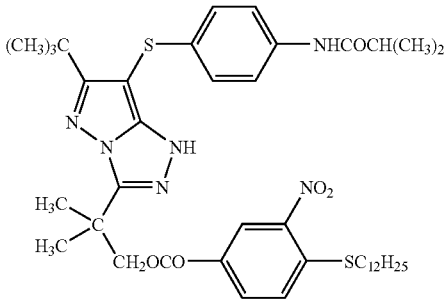
(104)
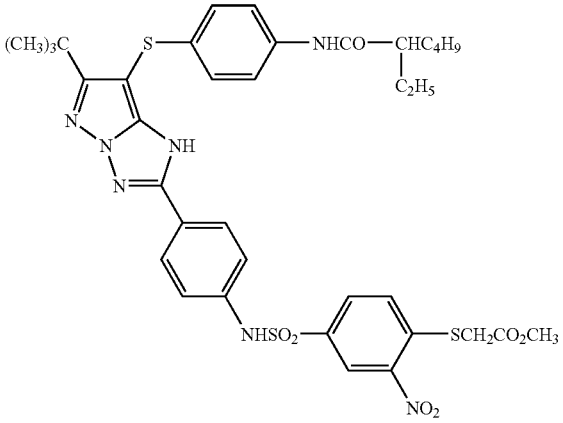
(105)
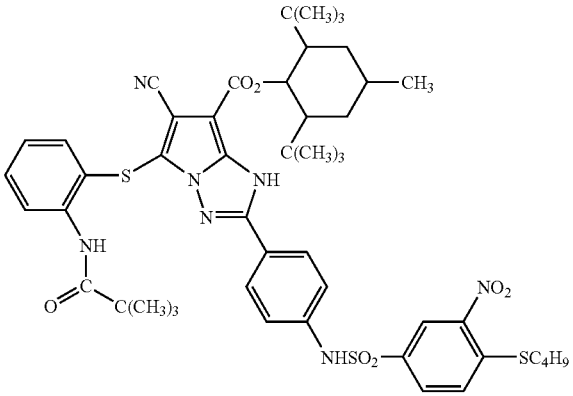
-continued
(106)
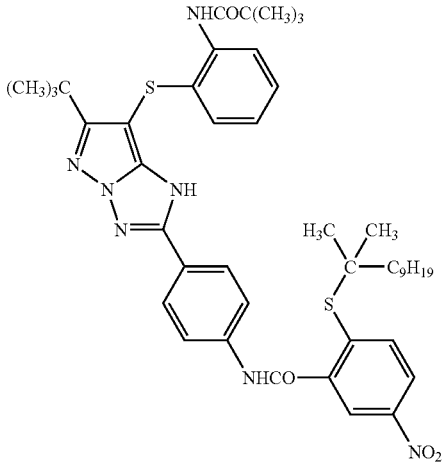
(107)
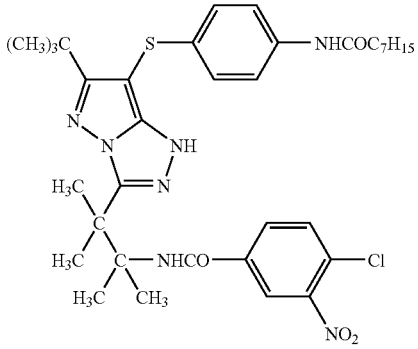
(108)
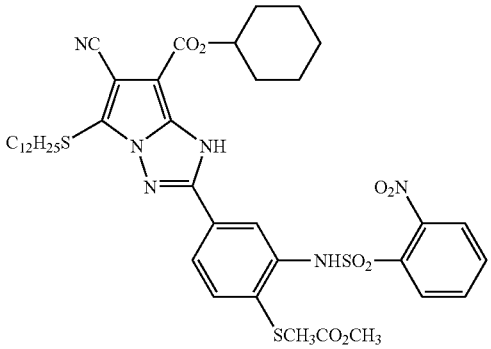
(109)
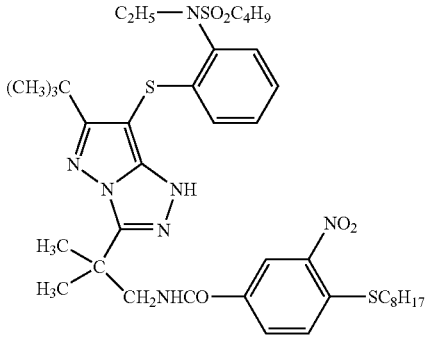

-continued (110)

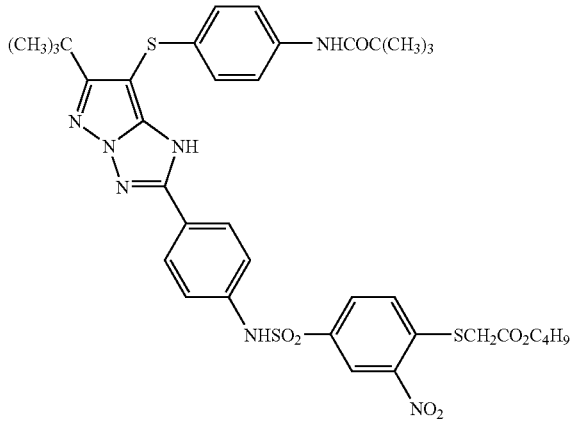

(111)

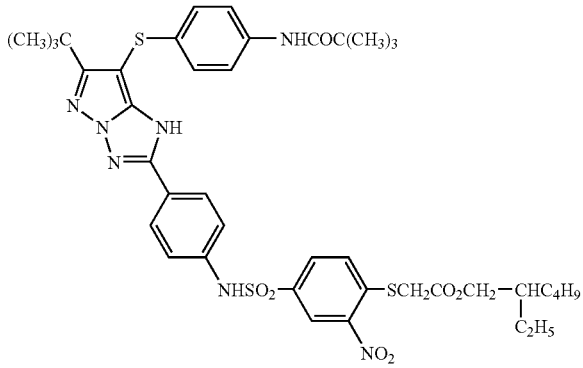

The compound of the present invention can easily be prepared according to the synthesis methods described in JP-A's-61-65245, 61-65246, 61-147254 and 8-122984, etc.

In the present invention, the addition location and so on of the compound represented by general formula (M) or (C) is not limited as long as the compound is able to act on the silver halide color photographic material. However, the compound is preferably contained in the silver halide color photographic material. When the compound represented by general formula (M) or (C) of the present invention is contained in the silver halide color photographic material, the compound may be used in any of the silver halide light-sensitive layer and nonsensitive layer. It is also preferable that the compound represented by general formula (M) or (C) of the present invention is added to both a light-sensitive layer and nonsensitive layer.

If the compound of the present invention is used in the silver halide light-sensitive layer, and the light-sensitive layer is divided into a plurality of layers of different speeds, the compound can be used for the layer of any speed. However, it is preferable that the compound be used for the highest speed layer.

If the compound is used in the nonsensitive layer, it is preferable that the compound be used for the nonsensitive layer disposed between the red-sensitive layer and the green-sensitive layer, or between the green-sensitive layer and the blue-sensitive layer. The nonsensitive layer refers to all the layers other than the silver halide emulsion layer. Examples of the nonsensitive layers are an antihalation layer, an interlayer, a yellow filter layer, and a protective layer.

The method and the time of adding the compound of general formula (M) or (C) to the photosensitive material is not particularly limited. There are the methods as follows: a method of emulsifying and dispersing the compound with a high boiling organic solvent; solid-state dispersion; a method of dissolving the compound in an organic solvent such as methanol and adding the obtained product to a coating liquid; and a method of adding the compound at the time of preparing the silver halide emulsion. It is preferable, however, that the compound be introduced in the photosensitive material by emulsification and dispersion.

As stated in the description of the prior art, in general, the speed depends on the grain size of a silver halide emulsion. The larger the grain size of the emulsion, the more the speed increases. However, since the graininess deteriorates with increase of the size of a silver halide grain, the speed and graininess have a trade-off relationship.

In addition to increasing the grain size of the silver halide emulsion, it is possible to increase the speed of the material by increasing the activity of a coupler, or reducing the amount of a development inhibitor releasing coupler (DIR coupler). However, if the speed is increased by these methods, the graininess deteriorates simultaneously. These methods such as change of the grain size of the emulsion, regulation of the activity of the coupler, control of the DIR coupler are mere "regulation means" for, in the trade-off relationship between the speed and graininess, increasing the speed while deteriorating the graininess, or reducing the speed while improving the graininess.

"A method of increasing speed" recited in the claims is not the above-mentioned speed increasing method involving deterioration of the graininess corresponding to the speed increase.

A method of increasing speed of the present invention is a speed-increasing method not causing deterioration of the graininess, or a speed-increasing method wherein the degree of increasing the speed is larger compared with the degree of deterioration in the graininess. If the speed increase and the graininess deterioration occur simultaneously, it is required to use the above "regulation means" to match the graininess and then compare the speed, and to obtain a substantial speed increase.

"Substantial speed increase" means a speed difference between the photosensitive material with the compound represented by the general formula (M) or (C) and that without the compound represented by the general formula (M) or (C) is 0.03 or more. The speed of the photosensitive material is measured after exposing the photosensitive materials through a continuous wedge. The speed is defined as the logarithmic value of the reciprocal of the exposure amount that provides the minimum density plus 0.2.

The addition amount of the compound of general formula (M) or (C) is preferably 0.1 to 1000 mg/m$^2$, more preferably, 1 to 500 mg/m$^2$, and especially preferably, 5 to 100 mg/m$^2$.

If the compound is used for the light-sensitive silver halide emulsion layer, the amount thereof is preferably $1\times10^{-4}$ to $1\times10^{-1}$ mol per mol of silver in the layer, and more preferably $1\times10^{-3}$ to $5\times10^{-2}$ mol per mol of silver in the layer.

The pKa of the compound of general formula (M) or (C) is determined by the following method. 0.5 milliliters (mL) of 1N sodium chloride aqueous solution is added to 100 mL of an aqueous solution containing tetrahydrofuran, in which 0.01 milimole of a coupler is dissolved, and water at 6:4 (wt. ratio). While the solution is stirred under atmosphere of nitrogen gas, titration is carried out using an aqueous 0.5N potassium hydroxide solution. In the titration curve plotted using the dropping amount of the aqueous potassium hydroxide solution on the horizontal axis, and pH value on the vertical axis, the pH at the inflection point is regarded as pKa. If there are a plurality of inflection points, i.e., the coupler has a dissociation site, in addition to the coupling-active position, an ultraviolet absorption spectrum is monitored simultaneously, and the variation of absorption of a coupler anion (dissociation form at the coupling-active position) in the vicinity of 260 to 350 nm is determined, thereby determining the inflection point.

The pKa of the compound of general formula (M) or (C) is preferably 6.0 to 8.4, and more preferably, 7.5 to 8.3.

The change of a film pAg ($\Delta pAg_F$) caused by addition of the compound of general formula (M) or (C) is determined by the following method.

The change of a film pAg ($\Delta pAg_F$) caused by addition of the compound of general formula (M) or (C) is determined by the difference in film pAg value from the case where the following evaluation photosensitive material (A) is prepared and no compound of formula (M) is added. The film pAg value is obtained by immersing the photosensitive material of a size of 8 cm×12 cm in 100 mL of the following buffer whose pH is adjusted to 10 for 5 minutes, and determining the pAg of the buffer using a silver electrode and comparison electrode (calomel electrode).

| <Buffer Solution Preparation Method> | |
|---|---|
| Boric acid | 7.73 g |
| Potassium chloride | 49.0 g |
| Potassium carbonate | 17.3 g |
| 1N potassium hydroxide aqueous solution | 62.5 mL |
| Water to make | 1,000 mL |

The change of a film pAg caused by addition of the compound of general formula (M) or (C) is preferably 0 to 0.3, and more preferably, 0 to 0.25.

Evaluation Light-Sensitive Material (A)

(Support)

Cellulose Triacetate

| | | |
|---|---|---|
| (Emulsion Layer) | | |
| Em-C | in terms of silver | 1.07 g/m$^2$ |
| Gelatin | | 2.33 g/m$^2$ |
| ExC-1 | | 0.76 g/m$^2$ |
| ExC-4 | | 0.42 g/m$^2$ |
| Tricresyl phosphate | | 0.62 g/m$^2$ |
| Compound of formula (M) or (C) | | $3.9 \times 10^{-4}$ mol/m$^2$ |
| (Protective Layer) | | |
| Gelatin | | 2.00 g/m$^2$ |
| H-1 | | 0.33 g/m$^2$ |
| B-2 (diameter of 1.7 μm) | | 0.10 g/m$^2$ |
| B-2 (diameter of 1.7 μm) | | 0.30 g/m$^2$ |
| B-3 | | 0.10 g/m$^2$ |

The characteristics of the emulsion Em-C and the structure of each compound used in the above evaluation photosensitive material (A) are shown in Example 1 described later.

The reactivity (CRV) of the compound of general formula (M) or (C) with an oxidized color developing agent is determined by the following method.

The evaluation photosensitive material (A) was exposed to white light, and was processed in the same manner as the processing method described in Example 1, except that the process time of the color development step was changed to 1 minute and 15 seconds. The magenta density of the photosensitive material was determined and the cyan density was also determined. The differences between the magenta density and cyan density of the photosensitive material and those of the photosensitive material containing no compound of general formulae (M) and (C) were determined.

With respect to the compound of formula (M), the difference in magenta density determined by the above method is regarded as CRV. With respect to the compound of formula (C), the difference in cyan density determined by the above method is regarded as CRV.

The CRV is preferably 0.01 to 0.10 in improving the speed/graininess, and more preferably, 0.01 to 0.05.

For the photosensitive material of the present invention, it is only required that at least one blue-sensitive, green-sensitive, and red-sensitive silver halide emulsion layer and nonsensitive layer be formed on a support. A typical example is a silver halide photosensitive material having, on its support, at least one blue-sensitive layer, at least one green-sensitive layer, at least one red-sensitive layer, each of which is constituted by a plurality of silver halide emulsion layers that are sensitive to essentially the same color but have different speeds, and at least one nonsensitive layer. This light-sensitive layer includes a unit light-sensitive layer which is sensitive to one of blue light, green light and red light. In a multilayered silver halide color photosensitive material, these unit light-sensitive layers are generally arranged in the order of red-, green- and blue-sensitive layers from a support. However, according to the intended use, this arrangement order may be reversed, or light-sensitive layers sensitive to the same color can sandwich another light-sensitive layer sensitive to a different color. A nonsensitive layer may be formed between the silver halide light-sensitive layers and as the uppermost layer and the lowermost layer. These layers may contain, e.g., couplers to be described later, DIR compounds and color-mixing inhibitors. As for a plurality of silver halide emulsion layers constituting respective unit light-sensitive layer, a two-layered structure of high- and low-speed emulsion layers can be preferably used in this order so as to the speed becomes lower toward the support as described in DE (German Patent) 1,121,470 or GB 923,045, the entire contents of which are incorporated herein by reference. Also, as described in JP-A's-57-112751, 62-200350, 62-206541 and 62-206543, the entire contents of which are incorporated herein by reference, layers may be arranged such that a low-speed emulsion layer is formed farther from a support and a high-speed layer is formed closer to the support.

More specifically, layers can be arranged from the farthest side from a support in the order of low-speed blue-sensitive layer (BL)/high-speed blue-sensitive layer (BH)/high-speed green-sensitive layer (GH)/low-speed green-sensitive layer (GL)/high-speed red-sensitive layer (RH)/low-speed red-sensitive layer (RL), the order of BH/BL/GL/GH/RH/RL or the order of BH/BL/GH/GL/RL/RH.

Further, as described in JP-A-55-34932, the layers can be arranged from the farthest side from a support in the order of blue-sensitive layer/GH/RH/GL/RL. Also, as described in JP-A's-56-25738 and 62-63936, the entire contents of which are incorporated herein by reference, the layers can be arranged from the farthest side from a support, blue-sensitive layer/GL/RL/GH/RH.

As described in Jpn. Pat. Appln. KOKOKU Publication No. (hereinafter referred to as JP-B-) 55-34932, the entire contents of which are incorporated herein by reference, the layers may be arranged in the order of blue-sensitive layer/GH/RH/GL/RL from the farthest side from a support. Also, as described in JP-B-56-25738, the entire contents of which are incorporated herein by reference, the layers may be arranged in the order of blue-sensitive layer/GL/RL/GH/RH from the farthest side to the support.

As described in JP-B-49-15495, the entire contents of which are incorporated herein by reference, three layers can be arranged such that a silver halide emulsion layer having the highest sensitivity is arranged as an upper layer, a silver halide emulsion layer having sensitivity lower than that of the upper layer is arranged as an interlayer, and a silver halide emulsion layer having sensitivity lower than that of the interlayer is arranged as a lower layer; i.e., three layers having different sensitivities can be arranged such that the sensitivity is sequentially decreased toward the support. Even when a layer structure is constituted by three layers having different sensitivities, these layers can be arranged in the order of medium-speed emulsion layer/high-speed emulsion layer/low-speed emulsion layer from the farthest side from a support in a layer sensitive to one color as described in JP-A-59-202464, the entire contents of which are incorporated herein by reference.

In addition, the order of high-speed emulsion layer/low-speed emulsion layer/medium-speed emulsion layer or low-speed emulsion layer/medium-speed emulsion layer/high-speed emulsion layer can be adopted.

Furthermore, the arrangement can be changed as described above even when four or more layers are formed.

The silver halide preferably used in the present invention is silver bromoiodide, silver iodochloride, or silver bromochloroiodide containing about 30 mol % or less of silver iodide. A particularly preferable silver halide is silver bromoiodide or silver bromochloroiodide containing about 2 to about 10 mol % of silver iodide.

Silver halide grains contained in the photographic emulsion can have regular crystals such as cubic, octahedral, or tetradecahedral crystals, irregular crystals such as spherical or tabular crystals, crystals having crystal defects such as twin planes, or composite shapes thereof.

The silver halide grain can be a fine grain having a grain size of about 0.2 μm or less, or be a large grain having a projected area diameter of upto about 10 μm, and an emulsion can be either a polydisperse or monodisperse emulsion.

A silver halide photographic emulsion which can be used in the present invention can be prepared by methods described in, e.g., "I. Emulsion preparation and types," Research Disclosure (RD) No. 17643 (December, 1978), pp. 22 and 23, "I. Emulsion preparation and types", and RD No. 18716 (November, 1979), page 648, and RD No. 307105 (November, 1989), pp. 863 to 865; P. Glafkides, "Chemie et Phisique Photographique", Paul Montel, 1967; G. F. Duffin, "Photographic Emulsion Chemistry", Focal Press, 1966; and V. L. Zelikman et al., "Making and Coating Photographic Emulsion", Focal Press, 1964.

Monodisperse emulsions described in, e.g., U.S. Pat. Nos. 3,574,628 and 3,655,394, and GB1,413,748 are also preferable.

Tabular grains having an aspect ratio of 3 or more can also be used in the present invention. Tabular grains can be easily prepared by methods described in Gutoff, "Photographic Science and Engineering", Vol. 14, pp. 248 to 257 (1970); and U.S. Pat. Nos. 4,434,226, 4,414,310, 4,433,048, and 4,439,520, and GB2,112,157.

It has been found out that the compound of the present invention which improves the speed/graininess ratio exhibits the advantage in an especially great degree when the compound is used in the same layer of a photosensitive material as that containing tabular grains having an average aspect ratio of 8 or more. The average aspect ratio is preferably from 8 to 100, more preferably from 12 to 50.

A crystal structure can be uniform, can have different halogen compositions in the interior and the surface layer thereof, or can be a layered structure. Alternatively, a silver halide having a different composition can be bonded by an epitaxial junction or a compound except for a silver halide such as silver rhodanide or lead oxide can be bonded. A mixture of grains having various types of crystal shapes can also be used.

The above emulsion preferably has a dislocation line. In particular, the tabular grains preferably have a dislocation line at a fringe portion. The dislocation line can be introduced by the following methods: a method of adding an aqueous solution containing an iodized alkali, etc., to form a silver-iodide-rich layer; a method of adding the AgI fine grains; and a method described in JP-A-323487.

The above emulsion can be any of a surface latent image type emulsion which mainly forms a latent image on the surface of a grain, an internal latent image type emulsion which forms a latent image in the interior of a grain, and another type of emulsion which has latent images on the surface and in the interior of a grain. However, the emulsion must be a negative type emulsion. The internal latent image type emulsion can be a core/shell internal latent image type emulsion described in JP-A-63-264740. A method of preparing this core/shell internal latent image type emulsion is described in JP-A-59-133542. Although the thickness of a shell of this emulsion depends on, e.g., development conditions, it is preferably 3 to 40 nm, and most preferably, 5 to 20 nm.

A silver halide emulsion is normally subjected to physical ripening, chemical ripening, and spectral sensitization steps before it is used. Additives for use in these steps are described in RD Nos. 17643, 18716, and 307105, and they are summarized in a table to be presented later.

In a photosensitive material of the present invention, it is possible to mix, in a single layer, two or more types of emulsions different in at least one of characteristics of a photosensitive silver halide emulsion, i.e., a grain size, grain size distribution, halogen composition, grain shape, and speed.

It is also possible to preferably use surface-fogged silver halide grains described in U.S. Pat. No. 4,082,553, internally fogged silver halide grains described in U.S. Pat. Nos. 4,626,498 and JP-A-59-214852, and colloidal silver, in sensitive silver halide emulsion layers and/or essentially non-sensitive hydrophilic colloid layers. The internally fogged or surface-fogged silver halide grain means a silver halide grain which can be developed uniformly (non-image-wise) regardless of whether the location is a non-exposed portion or an exposed portion of the photosensitive material. A method of preparing the internally fogged or surface-fogged silver halide grain is described in U.S. Pat. No. 4,626,498 and JP-A-59-214852. A silver halide which forms the core of an internally fogged core/shell type silver halide grain can have a different halogen composition. As the internally fogged or surface-fogged silver halide, any of silver chloride, silver chlorobromide, silver bromoiodide, and silver bromochloroiodide can be used. The average grain size of these fogged silver halide grains is preferably 0.01 to 0.75 μm, and most preferably, 0.05 to 0.6 μm. The grain shape can be a regular grain shape. Although the emulsion can be a polydisperse emulsion, it is preferably a monodisperse emulsion (in which at least 95% in weight or number of grains of silver halide grains have grain sizes falling within the range of ±40% of the average grain size).

In the present invention, it is preferable to use a nonsensitive fine grain silver halide. The nonsensitive fine grain silver halide preferably consists of silver halide grains which are not exposed during imagewise exposure for obtaining a dye image and are not essentially developed during development. These silver halide grains are preferably not fogged in advance. In the fine grain silver halide, the content of silver bromide is 0 to 100 mol %, and silver chloride and/or silver iodide can be added if necessary. The fine grain silver halide preferably contains 0.5 to 10 mol % of silver iodide. The average grain size (the average value of equivalent-circle diameters of projected areas) of the fine grain silver halide is preferably 0.01 to 0.5 μm, and more preferably, 0.02 to 0.2 μm.

The fine grain silver halide can be prepared following the same procedures as for a common sensitive silver halide. The surface of each silver halide grain need not be optically sensitized nor spectrally sensitized. However, before the silver halide grains are added to a coating solution, it is preferable to add a well-known stabilizer such as a triazole-based compound, azaindene-based compound, benzothiazolium-based compound, mercapto-based compound, or zinc compound. Colloidal silver can be added to this fine grain silver halide grain-containing layer.

The silver coating amount of a photosensitive material of the present invention is preferably 8.0 g/m$^2$ or less.

Photographic additives usable in the present invention are also described in RD's, the entire contents of which are incorporated herein by reference, and the relevant portions are summarized in the following table.

| | Types of Additives | RD17643 | RD18716 | RD307105 |
|---|---|---|---|---|
| 1. | Chemical sensitizers | page 23 | page 648 right column | page 866 |
| 2. | Sensitivity increasing agents | | page 648 right column | |
| 3. | Spectral sensitizers, super sensitizers | pages 23–24 | page 648, right column to page 649, right column | pages 866–868 |
| 4. | Brighteners | page 24 | page 647, right column | page 868 |
| 5. | Light absorbents, filter dyes, ultraviolet absorbents | pages 25–26 | page 649, right column to page 650, left column | page 873 |
| 6. | Binders | page 26 | page 651, left column | pages 873–874 |
| 7. | Plasticizers, lubricants | page 27 | page 650, right column | page 876 |
| 8. | Coating aids, surfactants | pages 26–27 | page 650, right column | pages 875–876 |
| 9. | Antistatic agents | page 27 | page 650, right column | pages 876–877 |
| 10. | Matting agents | | | pages 878–879 |

Various dye forming couplers can be used in the photosensitive material of the present invention, and the following couplers are particularly preferable.

Yellow couplers: couplers represented by formulas (I) and (II) in EP 502,424A; couplers represented by formulas (1) and (2) in EP 513,496A (particularly Y-28 on page 18); a coupler represented by formula (I) in claim 1 of EP 568,037A; a coupler represented by general formula (I) in column 1, lines 45 to 55, in U.S. Pat. No. 5,066,576; a coupler represented by general formula (I) in paragraph 0008 of JP-A-4-274425; couplers described in claim 1 on page 40 in EP 498,381A1 (particularly D-35 on page 18); couplers represented by formula (Y) on page 4 in EP 447,969A1 (particularly Y-1 (page 17) and Y-54 (page 41)); and couplers represented by formulas (II) to (IV) in column 7, lines 36 to 58, in U.S. Pat. No. 4,476,219 (particularly II-17, II-19 (column 17), and II-24 (column 19)), the entire contents of the above documents disclosing the yellow couplers are incorporated herein by reference.

Magenta couplers: JP-A-3-39737 (L-57 (page 11, lower right column), L-68 (page 12, lower right column), and L-77 (page 13, lower right column); [A-4]-63 (page 134), and [A-4]-73 and -75 (page 139) in EP No. 456,257; M-4 and -6 (page 26), and M-7 (page 27) in EP No. 486,965; M-45 (page 19) in EP No. 571,959A; (M-1) (page 6) in JP-A-5-204106; and M-22 in paragraph 0237 of JP-A-4-362631, the entire contents of the above documents disclosing the magenta couplers are incorporated herein by reference.

Cyan couplers: CX-1, CX-3, CX-4, CX-5, CX-11, CX-12, CX-14, and CX-15 (pages 14 to 16) in JP-A-4-204843; C-7 and C-10 (page 35), C-34 and C-35 (page 37), and (I-1) and (I-17) (pages 42 and 43) in JP-A-4-43345; and couplers represented by general formulas (Ia) and (Ib) in claim 1 of JP-A-6-67385, the entire contents of the above documents disclosing the cyan couplers are incorporated herein by reference.

Polymer couplers: P-1 and P-5 (page 11) in JP-A-2-44345, the entire contents of which are incorporated herein by reference.

Couplers for forming a colored dye with a proper diffusibility are preferably those described in U.S. Pat. No. 4,366,237, GB No. 2,125,570, EP No. 96,873B, and DE No. 3,234,533, the entire contents of which are incorporated herein by reference.

As couplers for correcting the unnecessary absorption of a colored dye, preferred use is made of, besides the magenta colored yellow couplers of the present invention, yellow colored cyan couplers represented by formulas (CI), (CII), (CIII), and (CIV) described on page 5 in EP No. 456,257A1 (particularly YC-86 on page 84); yellow colored magenta couplers ExM-7 (page 202), Ex-1 (page 249), and EX-7 (page 251) described in EP No. 456,257A1; magenta colored cyan couplers CC-9 (column 8) and CC-13 (column 10) described in U.S. Pat. No. 4,833,069; (2) (column 8) in U.S. Pat. No. 4,837,136; and colorless masking couplers represented by formula (A) in claim 1 of WO No. 92/11575 (particularly compound examples on pages 36 to 45), the entire contents of all the documents disclosing the couplers for correcting the unnecessary absorption of a colored dye are incorporated herein by reference.

Examples of compounds (including couplers) that react with an oxidized color developing agent to release a photographically useful compound residue are as follows. Development inhibitor release compounds: compounds represented by formulas (I), (II), (III), and (IV) on page 11 of EP No. 378,236A1 (particularly T-101 (page 30), T-104 (page 31), T-113 (page 36), T-131 (page 45), T-144 (page 51), and T-158 (page 58)); a compound represented by formula (I) on page 7 of EP No. 436,938A2 (particularly D 49 (page 51)); a compound represented by formula (1) in EP No. 568,037A (particularly (23) (page 11)); and compounds represented by formulas (I), (II), and (III) on pages 5 and 6 of EP No. 440,195A2 (particularly I-(1) on page 29). Bleaching accelerator release compounds: compounds represented by formulas (I) and (I') on page 5 of EP No. 310,125A2 (particularly (60) and (61) on page 61); and compounds represented by formula (I) in claim 1 of JP-A-6-59411 (particularly (7) (page 7)). Ligand release compounds: compounds represented by LIG-X described in claim 1 of U.S. Pat. No. 4,555,478 (particularly compounds in column 12, lines 21 to 41). Leuco dye release compounds: compounds 1 to 6 in columns 3 to 8 of U.S. Pat. No. 4,749,641. Fluorescent dye release compounds: compounds represented by COUP-DYE in claim 1 of U.S. Pat. No. 4,774,181 (particularly compounds 1 to 11 in columns 7 to 10). Development accelerator or fogging agent release compounds: compounds represented by formulas (1), (2), and (3) in column 3 of U.S. Pat. No. 4,656,123 (particularly (1–22) in column 25); and ExZK-2 on page 75, lines 36 to 38, in EP No. 450,637A2. Compounds which release a group which does not function as a dye unless it splits off: compounds represented by formula (I) in claim 1 of U.S. Pat. No. 4,857,441 (particularly Y-1 to Y-19 in columns 25 to 36).

Preferable examples of additives other than couplers are as follows.

Dispersion mediums of an oil-soluble organic compound: P-3, P-5, P-16, P-19, P-25, P-30, P-42, P-49, P-54, P-55, P-66, P-81, P-85, P-86, and P-93 (pages 140 to 144) in JP-A-62-215272. Impregnating latexes of an oil-soluble organic compound: latexes described in U.S. Pat. No. 4,199,363. Scavengers of an oxidized color developing agent: compounds represented by formula (I) in column 2, lines 54 to 62, in U.S. Pat. No. 4,978,606 (particularly I-(1), I-(2), I-(6), and I-(12) (columns 4 and 5)), and formulas in column 2, lines 5 to 10, in U.S. Pat. No. 4,923,787 (particularly compound 1 (column 3)). Stain inhibitors: formulas (I) to (III) on page 4, lines 30 to 33, particularly I-47, I-72, III-1, and III-27 (pages 24 to 48) in EP No. 298321A. Discoloration inhibitors: A-6, A-7, A-20, A-21, A-23, A-24, A-25, A-26, A-30, A-37, A-40, A-42, A-48, A-63, A-90, A-92, A-94, and A-164 (pages 69 to 118) in EP No. 298,321A; II-1 to III-23, particularly III-10, in columns 25 to 38 of U.S. Pat. No. 5,122,444; I-1 to III-4, particularly II-2, on pages 8 to 12 in EP No. 471,347A; and A-1 to A-48, particularly A-39 and A-42, in columns 32 to 40 of U.S. Pat. No. 5,139,931. Materials which reduce the use amount of a color enhancer or a color amalgamation inhibitor: I-1 to II-15, particularly I-46, on pages 5 to 24 in EP No. 411,324A. Formalin scavengers: SCV-1 to SCV-28, particularly SCV-8, on pages 24 to 29 in EP No. 477,932A. Film hardeners: H-1, H-4, H-6, H-8, and H-14 on page 17 in JP-A-1-214845; compounds (H-1 to H-54) represented by formulas (VII) to (XII) in columns 13 to 23 of U.S. Pat. No. 4,618,573;, compounds (H-1 to H-76), particularly H-14, represented by formula (6) on page 8, lower right column, in JP-A-2-214852; and compounds described in claim 1 of U.S. Pat. No. 3,325,287. Development inhibitor precursors: P-24, P-37, and P-39 (pages 6 and 7) in JP-A-62-168139; and compounds described in claim 1, particularly 28 and 29 in column 7, of U.S. Pat. No. 5,019,492. Antiseptic agents and mildewproofing agents; I-1 to III-43, particularly II-1, II-9, II-10, II-18, and III-25, in columns 3 to 15 of U.S. Pat. No. 4,923,790. Stabilizers and antifoggants: I-1 to (14), particularly I-1, I-60, (2), and (13), in columns 6 to 16 of U.S. Pat. No. 4,923,793; and compounds 1 to 65, particularly compound 36, in columns 25 to 32 of U.S. Pat. No. 4,952,483. Chemical sensitizers: triphenylphosphine, selenide, and compound 50 in JP-A-5-40324. Dyes: a-1 to b-20, particularly a-1, a-12, a-18, a-27, a-35, a-36, and b-5, on pages 15 to 18 and V-1 to V-23, particularly V-1, on pages 27 to 29 in JP-A-3-156450; F-I-1 to F-II-43, particularly F-I-11 and F-II-8, on pages 33 to 55 in EP No. 445,627A; III-1 to III-36, particularly III-1 and III-3, on pages 17 to 28 in EP No. 457,153A; microcrystalline dispersions of Dye-1 to Dye-124 on pages 8 to 26 in WO No. 88/04794; compounds 1 to 22, particularly compound 1, on pages 6 to 11 in EP No. 319,999A; compounds D-1 to D-87 (pages 3 to 28) represented by formulas (1) to (3) in EP No. 519,306A; compounds 1 to 22 (columns 3 to 10) represented by formula (I) in U.S. Pat. No. 4,268,622; and compounds (1) to (31) (columns 2 to 9) represented by formula (I) in U.S. Pat. No. 4,923,788. UV absorbents: compounds (18b) to (18r) and 101 to 427 (pages 6 to 9) represented by formula (1) in JP-A-46-3335; compounds (3) to (66) (pages 10 to 44) represented by formula (I) and compounds HBT-1 to HBT-10 (page 14) represented by formula (III) in EP No. 520,938A; and compounds (1) to (31) (columns 2 to 9) represented by formula (1) in EP No. 521,823A.

The present invention can be applied to various color photosensitive materials such as color negative films for general purposes or cinemas, color reversal films for slides and TV, color paper, color positive films and color reversal paper. Moreover, the present invention is suitable to lens equipped film units described in JP-B-2-32615 and Jpn. Utility Model Appln. KOKOKU Publication No. 3-39784.

Supports which can be suitably used in the present invention are described in, e.g., RD. No. 17643, page 28; RD. No. 18716, from the right column of page 647 to the left column of page 648; and RD. No. 307105, page 879.

The specific speed in the present invention is determined by the method described in JP-A-63-236035. This determination method is based on JIS K 7614-1981. This method is substantially the same as the JIS determination method except in the points that the development process is completed within 30 minutes to 6 hours after sensitometric exposure, and the development process is based on the Fuji color standard processing formula CN-16.

In the photosensitive material of the present invention, the thicknesses from the light-sensitive silver halide layer, which is the closest to the support, to the surface of the photosensitive material is preferably 24 μm or less, and more preferably 22 μm or less. The film swelling speed $T_{1/2}$ is preferably 30 sec or less, and more preferably, 20 sec or less. The film swelling speed $T_{1/2}$ is defined as the time that, when the saturation film thickness means 90% of the maximum swollen film thickness realized by the processing in a color developing solution at 30° C. for 3 min 15 sec, spent for the film thickness to reach ½ of the saturation film thickness. The film thickness means one measured under moisture conditioning at 25° C. and at a relative humidity of 55% (two days). The film swelling speed $T_{1/2}$ can be measured by using a swellometer described in A. Green et al., Photogr. Sci. Eng., Vol. 19, No. 2, pp. 124 to 129. The film swelling speed $T_{1/2}$ can be regulated by adding a film hardening agent to gelatin as a binder or by changing aging conditions after coating. The swelling ratio preferably ranges from 150 to 400%. The swelling ratio can be calculated from the maximum swollen film thickness measured under the above conditions in accordance with the formula:

$$[\text{maximum swollen film thickness} - \text{film thickness}]/\text{film thickness}.$$

In the photosensitive material of the present invention, hydrophilic colloid layers (called "back layers") having a total dried film thickness of 2 to 20 μm are preferably formed on the side opposite to the side having emulsion layers. The back layers preferably contain the above light absorbent, filter dye, ultraviolet absorbent, antistatic agent, film hardener, binder, plasticizer, lubricant, coating aid and surfactant. The swelling ratio of the back layers is preferably 150% to 500%.

The photosensitive material of the present invention can be developed by conventional methods described in RD. No. 17643, pages 28 and 29; RD. No. 18716, page 651, left to right columns; and RD No. 307105, pages 880 and 881.

The color negative film processing solution for use in the present invention will be described below.

The compounds listed in page 9, right upper column, line 1 to page 11, left lower column, line 4 of JP-A-4-121739 can be used in the color developing solution for use in the present invention. Preferred color developing agents for use in especially rapid processing are 2-methyl-4-[N-ethyl-N-(2-hydroxyethyl)amino]aniline, 2-methyl-4-[N-ethyl-N-(3-hydroxypropyl)amino]aniline and 2-methyl-4-[N-ethyl-N-(4-hydroxybutyl)amino]aniline.

These color developing agents are preferably used in an amount of 0.01 to 0.08 mol, more preferably 0.015 to 0.06 mol, and much more preferably 0.02 to 0.05 mol per liter (L) of the color developing solution. The replenisher of the color developing solution preferably contains the color developing agent in an amount corresponding to 1.1 to 3 times the above concentration, more preferably 1.3 to 2.5 times the above concentration.

Hydroxylamine can widely be used as preservatives of the color developing solution. When enhanced preserving properties are required, it is preferred to use hydroxylamine derivatives having substituents for example, alkyl, hydroxyalkyl, sulfoalkyl and carboxyalkyl groups, examples of which include N,N-di(sulfoehtyl)hydroxylamine, monomethylhydroxylamine, dimethylhydroxylamine, monoethylhydroxylamine, diethylhydroxylamine and N,N-di(carboxyethyl)hydroxylamine. Of these, N,N-di(sulfoehtyl) hydroxylamine is most preferred. Although these may be used in combination with the hydroxylamine, it is preferred that one or at least two members thereof be used in place of the hydroxylamine.

These preservatives are preferably used in an amount of 0.02 to 0.2 mol, more preferably 0.03 to 0.15 mol, and most preferably 0.04 to 0.1 mol per liter of the color developing solution. The replenisher of the color developing solution preferably contains the preservative in an amount corresponding to 1.1 to 3 times the concentration of the mother liquor (processing tank solution) as in the color developing agent.

Sulfurous salts are used as tarring preventives for the oxidized color developing agent in the color developing solution. Each sulfurous salt is preferably used in the color developing solution in an amount of 0.01 to 0.05 mol, more preferably 0.02 to 0.04 mol per liter, and is preferably used in the replenisher in an amount corresponding to 1.1 to 3 times the above concentration.

The pH value of the color developing solution preferably ranges from 9.8 to 11.0, more preferably from 10.0 to 10.5. That of the replenisher is preferably set at 0.1 to 1.0 higher than the above value. Common buffers such as carbonate, phosphonate, sulfosalicylate and borate are used for stabilizing the above pH value.

Although the amount of the replenisher of the color developing solution preferably ranges from 80 to 1300 mL per $m^2$ of the photosensitive material, it is desired that the amount be smaller from the viewpoint of reducing environmental pollution load. Specifically, the amount of the replenisher more preferably ranges from 80 to 600 mL, most preferably from 80 to 400 mL.

Although the bromide ion concentration of the color developing solution generally ranges from 0.01 to 0.06 mol per liter, it is preferred that the above concentration be set at 0.015 to 0.03 mol per liter for inhibiting fog while maintaining sensitivity to thereby improve discrimination and for bettering graininess. When the bromide ion concentration is set so as to fall within the above range, the replenisher preferably contains bromide ion in a concentration as calculated by the following formula. However, when C is negative, it is preferred that no bromide ion be contained in the replenisher.

$$C=A-W/V$$

wherein

C: bromide ion concentration of the color developing replenisher (mol/L),

A: target bromide ion concentration of the color developing solution (mol/L),

V: amount of color developing replenisher supplied per $m^2$ of the photosensitive material (L).

Development accelerators such as pyrazolidones represented by 1-phenyl-3-pyrazolidone and 1-phenyl-2-methyl-2-hydroxymethyl-3-pyrazolidone and thioether compounds represented by 3,6-dithia-1,8-octanediol are preferably used for means for enhancing sensitivity when the amount of the replenisher has been reduced or when a high bromide ion concentration has been set.

Compounds and processing conditions described on page 4, left lower column, line 16 to page 7, left lower column, line 6 of JP-A-4-125558 can be applied to the processing solution having bleaching capability for use in the present invention.

Bleaching agents having redox potentials of at least 150 mV are preferably used. Specifically, suitable examples thereof are those described in JP-A-5-72694 and JP-A-5-173312, and especially suitable examples thereof are 1,3-diaminopropanetetraacetic acid and ferric complex salts of Example 1 compounds listed on page 7 of JP-A-5-173312.

For improving the biodegradability of the bleaching agent, it is preferred that ferric complex salts of compounds listed in JP-A's-4-251845, and 4-268552, EP Nos. 588,289, and 591,934 and JP-A-6-208213 be used as the bleaching agent. The concentration of the above bleaching agent preferably ranges from 0.05 to 0.3 mol per liter of the solution having bleaching capability, and it is especially preferred that a design be made at 0.1 to 0.15 mol per liter for reducing the discharge to the environment. When the solution having bleaching capability is a bleaching solution, a bromide is preferably incorporated therein in an amount of 0.2 to 1 mol, more preferably 0.3 to 0.8 mol per liter.

Each component is incorporated in the replenisher of the solution having bleaching capability fundamentally in a concentration calculated by the following formula. This enables holding the concentration of the mother liquor constant.

$$C_R=C_T\times(V_1+V_2)/V_1+C_P$$

$C_R$: concentration of each component in the replenisher, $C_T$: concentration of the component in the mother liquor (processing tank solution), $V_1$: amount of replenisher having bleaching capability supplied per $m^2$ of photosensitive material (mL), and $V_2$: amount carried from previous bath by 1 $m^2$ of photosensitive material (mL).

In addition, a pH buffer is preferably incorporated in the bleaching solution, and it is especially preferred to incorporate a dicarboxylic acid of low order such as succinic acid, maleic acid, malonic acid, glutaric acid or adipic acid. It is also preferred to use common bleaching accelerators listed in JP-A-53-95630, RD No. 17129 and U.S. Pat. No. 3,893,858.

The bleaching solution is preferably replenished with 50 to 1000 mL, more preferably 80 to 500 mL, and much more preferably 100 to 300 mL, of a bleaching replenisher per $m^2$ of the photosensitive material. Further, the bleaching solution is preferably aerated.

Compounds and processing conditions described on page 7, left lower column, line 10 to page 8, right lower column, line 19 of JP-A-4-125558 can be applied to a processing solution having fixing capability.

For enhancing the fixing velocity and preservability, it is especially preferred to incorporate compounds represented by the general formulae (I) and (II) of JP-A-6-301169 either individually or in combination in the processing solution having fixing capability. Further, the use of p-toluenesulfinic salts and sulfinic acids listed in JP-A-1-224762 is preferred from the viewpoint of enhancing the preservability.

Although the incorporation of an ammonium as a cation in the solution having bleaching capability or solution having fixing capability is preferred from the viewpoint of enhancing the bleach ability, it is preferred that the amount of ammonium be reduced or brought to nil from the viewpoint of minimizing environmental pollution.

Conducting jet agitation described in JP-A-1-309059 is especially preferred in the bleach, bleach-fix and fixation steps.

The amount of replenisher supplied in the bleach-fix or fixation step is in the range of 100 to 1000 mL, preferably 150 to 700 mL, and especially preferably 200 to 600 mL, per $m^2$ of the photosensitive material.

Silver is preferably recovered by installing any of various silver recovering devices in an in-line or off-line mode in the bleach-fix or fixation step. In-line installation enables processing with the silver concentration of the solution lowered, so that the amount of replenisher can be reduced. It is also suitable to conduct an off-line silver recovery and recycle residual solution for use as a replenisher.

The bleach-fix and fixation steps can each be constructed by a plurality of processing tanks. Preferably, the tanks are provided with cascade piping and a multistage counterflow system is adopted. A 2-tank cascade structure is generally effective from the viewpoint of a balance with the size of the developing machine. The ratio of processing time in the former-stage tank to that in the latter-stage tank is preferably in the range of 0.5:1 to 1:0.5, more preferably 0.8:1 to 1:0.8.

From the viewpoint of enhancing the preservability, it is preferred that a chelating agent which is free without forming any metal complex be present in the bleach-fix and fixing solutions. Biodegradable chelating agents described in connection with the bleaching solution are preferably used as such a chelating agent.

Descriptions made on page 12, right lower column, line 6 to page 13, right lower column, line 16 of JP-A-4-125558 mentioned above can preferably be applied to water washing and stabilization steps. In particular, with respect to stabilizing solutions, the use of azolylmethylamines described in EP Nos. 504,609 and 519,190 and N-methylolazoles described in JP-A-4-362943 in place of formaldehyde and the dimerization of magenta coupler into a surfactant solution not containing an image stabilizer such as formaldehyde are preferred from the viewpoint of protecting working environment.

Further, stabilizing solutions described in JP-A-6-289559 can preferably be used for reducing the adhesion of refuse to a magnetic recording layer applied to the photosensitive material.

The replenishing amount of water washing and stabilizing solutions is preferably in the range of 80 to 1000 mL, more preferably 100 to 500 mL, and much more preferably 150 to 300 mL, per $m^2$ of the photosensitive material from the viewpoint that water washing and stabilizing functions are ensured and that the amount of waste solution is reduced to contribute to environment protection. In the processing with the above replenishing amount, any of known mildewproofing agents such as thiabenzazole, 1,2-benzoisothiazolin-3-one and 5-chloro-2-methylisothiazolin-3-one and antibiotics such as gentamicin is preferably added, or water deionized by the use of, for example, an ion exchange resin is preferably used, for preventing the breeding of bacteria and mildew. The use of deionized water in combination with a mildewproofing agent and an antibiotic is more effective than individual uses.

With respect to the solution placed in the water washing or stabilizing solution tank, it is also preferred that the replenishing amount be reduced by conducting a reverse osmosis membrane treatment as described in JP-A's-3-46652, 3-53246, 3-55542, 3-121448 and 3-126030. A low-pressure reverse osmosis membrane is preferably used in the above treatment.

In the processing of the present invention, it is especially preferred that an evaporation correction of processing solution be carried out as disclosed in JIII (Japan Institute of Invention and Innovation) Journal of Technical Disclosure No. 94-4992. In particular, the method in which a correction is effected with the use of information on the temperature and humidity of developing machine installation environment in accordance with Formula 1 on page 2 thereof is preferred. Water for use in the evaporation correction is preferably harvested from the washing replenishing tank. In that instance, deionized water is preferably used as the washing replenishing water.

Processing agents set forth on page 3, right column, line 15 to page 4, left column, line 32 of the above journal of technical disclosure are preferably used in the present invention. Film processor described on page 3, right column, lines 22 to 28 thereof is preferably used as the developing machine in the processing of the present invention.

Specific examples of processing agents, automatic developing machines and evaporation correction schemes preferably employed in carrying out the present invention are described on page 5, right column, line 11 to page 7, right column, last line of the above journal of technical disclosure.

The processing agent for use in the present invention may be supplied in any form, for example, a liquid agent with the same concentration as in use or concentrated one, granules, powder, tablets, a paste or an emulsion. For example, a liquid agent stored in a container of low oxygen permeability is disclosed in JP-A-63-17453, vacuum packed powder or granules in JP-A's-4-19655 and 4-230748, granules containing a water soluble polymer in JP-A-4-221951, tablets in JP-A-51-61837 and JP-A-6-102628 and a paste processing agent in PCT National Publication 57-500485. Although any of these can be suitably used, from the viewpoint of easiness in use, it is preferred to employ a liquid prepared in the same concentration as in use in advance.

The container for storing the above processing agent is composed of, for example, any one or a mixture of polyethylene, polypropylene, polyvinyl chloride, polyethylene terephthalate and nylon. A selection is made in accordance with the required level of oxygen permeability. A material of low oxygen permeability is preferably used for storing an easily oxidized liquid such as a color developing solution, which is, for example, polyethylene terephthalate or a composite material of polyethylene and nylon. It is preferred that each of these materials be used in the container at a thickness of 500 to 1500 μm so that the oxygen permeability therethrough is 20 $mL/m^2$ 24 hrs atm or less.

The processing solution for color reversal film to be employed in the present invention will be described below.

With respect to the processing for color reversal film, detailed descriptions are made in Public Technology No. 6 (Apr. 1, 1991) issued by Aztek, page 1, line 5 to page 10, line 5 and page 15, line 8 to page 24, line 2, any of which can be preferably applied thereto.

In the color reversal film processing, an image stabilizer is added to a conditioning bath or a final bath. Examples of suitable image stabilizers include formalin, formaldehyde sodium bisulfite and N-methylolazoles. Formaldehyde sodium bisulfite and N-methylolazoles are preferred from the viewpoint of working environment, Among the N-methylolazoles, N-methyloltriazole is especially preferred. The contents of descriptions on color developing solution, bleaching solution, fixing solution and washing water made in connection with the processing of color negative films are also preferably applicable to the processing of color reversal films.

Processing agent E-6 available from Eastman Kodak and processing agent CR-56 available from Fuji Photo Film Co., Ltd. can be mentioned as preferred color reversal film processing agents including the above feature.

The magnetic recording layer for use in the present invention will be described below.

The magnetic recording layer is obtained by coating on a support with a water-base or organic solvent coating liquid having magnetic material grains dispersed in a binder.

Suitable magnetic material grains can be composed of any of ferromagnetic iron oxides such as γ $Fe_2O_3$, Co coated γ $Fe_2O_3$, Co coated magnetite, Co containing magnetite, ferromagnetic chromium dioxide, ferromagnetic metals, ferromagnetic alloys, Ba ferrite of hexagonal system, Sr ferrite, Pb ferrite and Ca ferrite. Of these, Co coated ferromagnetic iron oxides such as Co coated γ $Fe_2O_3$ are preferred. The configuration thereof may be any of acicular, rice grain, spherical, cubic and plate shapes. The specific surface area is preferably at least 20 $m^2/g$, more preferably at least 30 $m^2/g$ in terms of $S_{BET}$.

The saturation magnetization (σs) of the ferromagnetic material preferably ranges from $3.0\times10^4$ to $3.0\times10^5$ A/m, more preferably from $4.0\times10^4$ to $2.5\times10^5$ A/m. The ferromagnetic material grains may have their surface treated with silica and/or alumina or an organic material. Further, the magnetic material grains may have their surface treated with a silane coupling agent or a titanium coupling agent as described in JP-A-6-161032. Still further, use can be made of magnetic material grains having their surface coated with an organic or inorganic material as described in JP-A's-4-259911 and 5-81652.

The binder for use in the magnetic material grains can be composed of any of natural polymers (e.g., cellulose derivatives and sugar derivatives), acid-, alkali- or bio-degradable polymers, reactive resins, radiation curable resins, thermosetting resins and thermoplastic resins listed in JP-A-4-219569 and mixtures thereof. The Tg of each of the above resins ranges from −40 to 300° C. and the weight average molecular weight thereof ranges from 2 thousand to 1 million. For example, vinyl copolymers, cellulose derivatives such as cellulose diacetate, cellulose triacetate, cellulose acetate propionate, cellulose acetate butyrate and cellulose tripropionate, acrylic resins and polyvinylacetal resins can be mentioned as suitable binder resins. Gelatin is also a suitable binder resin. Of these, cellulose di(tri)acetate is especially preferred. The binder can be cured by adding an epoxy, aziridine or isocyanate crosslinking agent. Suitable isocyanate crosslinking agents include, for example, isocyanates such as tolylene diisocyanate, 4,4'-diphenylmethane diisocyanate, hexamethylene diisocyanate and xylylene diisocyanate, reaction products of these isocyanates and polyalcohols (e.g., reaction product of 3 mol of tolylene diisocyanate and 1 mol of trimethylolpropane), and polyisocyanates produced by condensation of these isocyanates, as described in, for example, JP-A-6-59357.

The method of dispersing the magnetic material in the above binder preferably comprises using a kneader, a pin type mill and an annular type mill either individually or in combination as described in JP-A-6-35092. Dispersants listed in JP-A-5-088283 and other common dispersants can be used. The thickness of the magnetic recording layer ranges from 0.1 to 10 μm, preferably 0.2 to 5 μm, and more preferably from 0.3 to 3 μm. The weight ratio of magnetic material grains to binder is preferably in the range of 0.5:100 to 60:100, more preferably 1:100 to 30:100. The coating amount of magnetic material grains ranges from 0.005 to 3 $g/m^2$, preferably from 0.01 to 2 $g/m^2$, and more preferably from 0.02 to 0.5 $g/m^2$. The transmission yellow density of the magnetic recording layer is preferably in the range of 0.01 to 0.50, more preferably 0.03 to 0.20, and most preferably 0.04 to 0.15. The magnetic recording layer can be applied to the back of a photographic support in its entirety or in striped pattern by coating or printing. The magnetic recording layer can be applied by the use of, for example, an air doctor, a blade, an air knife, a squeeze, an immersion, reverse rolls, transfer rolls, a gravure, a kiss, a cast, a spray, a dip, a bar or an extrusion. Coating liquids set forth in JP-A-5-341436 are preferably used.

The magnetic recording layer may also be provided with, for example, lubricity enhancing, curl regulating, antistatic, sticking preventive and head polishing functions, or other functional layers may be disposed to impart these functions. An abrasive of grains whose at least one member is nonspherical inorganic grains having a Mohs hardness of at least 5 is preferred. The nonspherical inorganic grains are preferably composed of fine grains of any of oxides such as aluminum oxide, chromium oxide, silicon dioxide and titanium dioxide; carbides such as silicon carbide and titanium carbide; and diamond. These abrasives may have their surface treated with a silane coupling agent or a titanium coupling agent. The above grains may be added to the magnetic recording layer, or the magnetic recording layer may be overcoated with the grains (e.g., as a protective layer or a lubricant layer). The binder which is used in this instance can be the same as mentioned above and, preferably, the same as the that of the magnetic recording layer. The lightsensitive material having the magnetic recording layer is described in U.S. Pat. Nos. 5,336,589, 5,250,404, 5,229,259, and 5,215,874 and EP No. 466,130.

The polyester support for use in the present invention will be described below. Particulars thereof together with the below mentioned lightsensitive material, processing, cartridge and working examples are specified in Journal of Technical Disclosure No. 94-6023 (issued by Japan Institute of Invention and Innovation on Mar. 15, 1994). The polyester for use in the present invention is prepared from a diol and an aromatic dicarboxylic acid as essential components. Examples of suitable aromatic dicarboxylic acids include 2,6-, 1,5-, 1,4- and 2,7-naphthalenedicarboxylic acids, terephthalic acid, isophthalic acid and phthalic acid, and examples of suitable diols include diethylene glycol, triethylene glycol, cyclohexanedimethanol, bisphenol A and other bisphenols. The resultant polymers include homopolymers such as polyethylene terephthalate, polyethylene naphthalate and polycyclohexanedimethanol terephthalate. Polyesters containing 2,6-naphthalenedicarboxylic acid in an amount of 50 to 100 mol % are especially preferred. Polyethylene 2,6-naphthalate is most preferred. The average molecular weight thereof ranges from approximately 5,000 to 200,000. The Tg of the polyester of the present invention is at least 50° C., preferably at least 90° C.

The polyester support is subjected to heat treatment at a temperature of from 40° C. to less than Tg, preferably from Tg minus 20° C. to less than Tg, in order to suppress curling. This heat treatment may be conducted at a temperature held constant within the above temperature range or may be conducted while cooling. The period of heat treatment ranges from 0.1 to 1500 hr, preferably 0.5 to 200 hr. The support may be heat treated either in the form of a roll or while being carried in the form of a web. The surface form of the support may be improved by rendering the surface irregular (e.g., coating with conductive inorganic fine grains of $SnO_2$, $Sb_2O_5$, etc.). Moreover, a scheme is desired such that edges of the support are knurled so as to render only the edges slightly high, thereby preventing photographing of core sections. The above heat treatment may be carried out in any of stages after support film formation, after surface treatment, after back layer application (e.g., application of an antistatic agent or a lubricant) and after undercoating application. The heat treatment is preferably performed after antistatic agent application.

An ultraviolet absorber may be milled into the polyester. Light piping can be prevented by milling, into the polyester, dyes and pigments commercially available as polyester additives, such as Diaresin produced by Mitsubishi Chemical Industries, Ltd. and Kayaset produced by NIPPON KAYAKU CO., LTD.

In the present invention, a surface treatment is preferably conducted for bonding a support and a lightsensitive material constituting layer to each other. The surface treatment is, for example, a surface activating treatment such as chemical treatment, mechanical treatment, corona discharge treatment, flame treatment, ultraviolet treatment, high frequency treatment, glow discharge treatment, active plasma treatment, laser treatment, mixed acid treatment or ozone oxidation treatment. Of these surface treatments, ultraviolet irradiation treatment, flame treatment, corona treatment and glow treatment are preferred.

Next, a subbing layer will be described. The subbing layer may be composed of a single layer or two or more layers. As the binder for the substratum, there can be mentioned not only copolymers prepared from monomers, as starting materials, selected from among vinyl chloride, vinylidene chloride, butadiene, methacrylic acid, acrylic acid, itaconic acid and maleic anhydride but also polyethyleneimine, an epoxy resin, a grafted gelatin, nitrocellulose and gelatin. Resorcin or p-chlorophenol is used as a support swelling compound. A gelatin hardener such as a chromium salt (e.g., chrome alum), an aldehyde (e.g., formaldehyde or glutaraldehyde), an isocyanate, an active halogen compound (e.g., 2,4-dichloro-6-hydroxy-S-triazine), an epichlorohydrin resin or an active vinyl sulfone compound can be used in the subbing layer. Also, $SiO_2$, $TiO_2$, inorganic fine grains or polymethyl methacrylate copolymer fine grains (0.01 to 10 μm) may be incorporated therein as a matting agent.

Further, an antistatic agent is preferably used in the present invention. Examples of suitable antistatic agents include carboxylic acids and carboxylic salts, sulfonic acid salt containing polymers, cationic polymers and ionic surfactant compounds.

Most preferred as the antistatic agent are fine grains of at least one crystalline metal oxide selected from among ZnO, $TiO_2$, $SnO_2$, $Al_2O_3$, $In_2O_3$, $SiO_2$, MgO, BaO, $MoO_3$ and $V_2O_5$ having a volume resistivity of $10^7$ Ω·cm or less, preferably $10^5$ Ω·cm or less, and having a grain size of 0.001 to 1.0 μm or a composite oxide thereof (Sb, P, B, In, S, Si, C, etc.) and fine grains of sol form metal oxides or composite oxides thereof. The content thereof in the lightsensitive material is preferably in the range of 5 to 500 mg/m$^2$, more preferably 10 to 350 mg/m$^2$. The ratio of amount of conductive crystalline oxide or composite oxide thereof to binder is preferably in the range of 1/300 to 100/1, more preferably 1/100 to 100/5.

It is preferred that the lightsensitive material of the present invention have lubricity. The lubricant containing layer is preferably provided on both the lightsensitive layer side and the back side. Preferred lubricity ranges from 0.25 to 0.01 in terms of dynamic friction coefficient. The measured lubricity is a value obtained by conducting a carriage on a stainless steel ball of 5 mm in diameter at 60 cm/min (25° C., 60% RH). In this evaluation, value of approximately the same level is obtained even when the opposite material is replaced by the lightsensitive layer side.

The lubricant which can be used in the present invention is, for example, a polyorganosiloxane, a higher fatty acid amide, a higher fatty acid metal salt or an ester of higher fatty acid and higher alcohol. Examples of suitable polyorganosiloxanes include polydinethylsiloxane, polydiethylsiloxane, polystyrylmethylsiloxane and polymethylphenylsiloxane. The lubricant is preferably added to the back layer or the outermost layer of the emulsion layer. Especially, polydimethylsiloxane and an ester having a long chain alkyl group are preferred.

A matting agent is preferably used in the light-sensitive material of the present invention. Although the matting agent may be used on the emulsion side or the back side indiscriminately, it is especially preferred that the matting agent be added to the outermost layer of the emulsion side. The matting agent may be soluble in the processing solution or insoluble in the processing solution, and it is preferred to use the soluble and insoluble matting agents in combination. For example, polymethyl methacrylate, poly(methyl methacrylate/methacrylic acid) (9/1 or 5/5 in molar ratio) and polystyrene grains are preferred. The grain size thereof preferably ranges from 0.8 to 10 μm. Narrow grain size distribution thereof is preferred, and it is desired that at least 90% of the whole number of grains be included in the range of 0.9 to 1.1 times the average grain size. Moreover, for enhancing the mat properties, it is preferred that fine grains of 0.8 μm or less be simultaneously added, which include, for example, fine grains of polymethyl methacrylate (0.2 μm), poly(methyl methacrylate/methacrylic acid) (9/1 in molar ratio, 0.3 μm), polystyrene (0.25 μm) and colloidal silica (0.03 μm).

The film patrone employed in the present invention will be described below. The main material composing the patrone for use in the present invention may be a metal or a synthetic plastic.

Examples of preferable plastic materials include polystyrene, polyethylene, polypropylene and polyphenyl ether. The patrone for use in the present invention may contain various types of antistatic agents and can preferably contain, for example, carbon black, metal oxide grains, nonionic, anionic, cationic or betaine type surfactants and polymers. Such an antistatic patrone is described in JP-A's-1-312537 and 1-312538. The resistance thereof at 25° C. in 25% RH is preferably $10^{12}$ Ω or less. The plastic patrone is generally molded from a plastic having carbon black or a pigment milled thereinto for imparting light shielding properties. The patrone size may be the same as the current size 135, or for miniaturization of cameras, it is advantageous to decrease the diameter of the 25 mm cartridge of the current size 135 to 22 mm or less. The volume of the case of the patrone is preferably 30 $cm^3$ or less, more preferably 25 $cm^3$ or less. The weight of the plastic used in each patrone or patrone case preferably ranges from 5 to 15 g.

The patrone for use in the present invention may be one capable of feeding a film out by rotating a spool. Further, the patrone may be so structured that a film front edge is accommodated in the main frame of the patrone and that the film front edge is fed from a port part of the patrone to the outside by rotating a spool shaft in a film feeding out direction. These are disclosed in U.S. Pat. Nos. 4,834,306 and 5,226,613. The photographic film for use in the present invention may be a generally so termed raw stock having not yet been developed or a developed photographic film. The raw stock and the developed photographic film may be accommodated in the same new patrone or in different patrones.

A color photosensitive material of the present invention is also suitably used as a negative film for an advanced photo system (to be referred to as an APS hereinafter). Examples are NEXIA A, NEXIA F, and NEXIA H (ISO 200, 100, and 400, respectively) manufactured by Fuji Photo Film Co., Ltd. (to be referred to as Fuji Film hereinafter). These films are so processed as to have an APS format and set in an exclusive cartridge. These APS cartridge films are loaded into APS cameras such as the Fuji Film EPION Series represented by the EPION 300%. A color photosensitive film of the present invention is also suited as a film with lens such as Fuji Film FUJICOLOR UTSURUNDESU SUPER SLIM.

A photographed film is printed through the following steps in a miniature laboratory system.

(1) Reception (an exposed cartridge film is received from a customer)
(2) Detaching step (the film is transferred from the cartridge to an intermediate cartridge for development)
(3) Film development
(4) Reattaching step (the developed negative film is returned to the original cartridge)
(5) Printing (prints of three types C, H, and P and an index print are continuously automatically printed on color paper [preferably Fuji Film SUPER FA8])
(6) Collation and shipment (the cartridge and the index print are collated by an ID number and shipped together with the prints)

As these systems, the Fuji Film MINILABO CHAMPION SUPER FA-298, FA-278, FA-258, FA-238 are preferable. Examples of a film processor are the FP922AL, FP562B, FP562BL, FP362B, and FP3622BL, and a recommended processing chemical is the FUJICOLOR JUST-IT CN-16L. Examples of a printer processor are the PP3008AR, PP3008A, PP1828AR, PP1828A, PP1258AR, PP1258A, PP728AR, and PP728A, and a recommended processing chemical is the FUJICOLOR JUST-IT CP-47L. A detacher used in the detaching step and a reattacher used in the reattaching step are preferably the Fuji Film DT200 or DT100 and AT200 or AT100, respectively.

The APS can also be enjoyed by PHOTO JOY SYSTEM whose main component is the Fuji Film Aladdin 1000 digital image scanner. For example, a developed APS cartridge film is directly loaded into the Aladdin 1000, or image information of a negative film, positive film, or print is input to the Aladdin 1000 by using the FE-550 35-mm film scanner or the PE-550 flat head scanner. Obtained digital image data can be easily processed and edited. This data can be printed out by the NC-550AL digital color printer using a photo-fixing heat-sensitive color printing system or the PICTOROGRAPHY 3000 using a laser exposure thermal development transfer system, or by existing laboratory equipment through a film recorder. The Aladdin 1000 can also output digital information directly to a floppy disk or Zip disk or to an CD-R via a CD writer.

In a home, a user can enjoy photographs on a TV set simply by loading a developed APS cartridge film into the Fuji Film Photo Player AP-1. Image information can also be continuously input to a personal computer by loading a developed APS cartridge film into the Fuji Film Photo Scanner AS-1. The Fuji Film Photo Vision FV-10 or FV-5 can be used to input a film, print, or three-dimensional object. Furthermore, image information recorded in a floppy disk, Zip disk, CD-R, or hard disk can be variously processed on a computer by using the Fuji Film Photo Factory application software. The Fuji Film NC-2 or NC-2D digital color printer using a photo-fixing heat-sensitive color printing system is suited to outputting high-quality prints from a personal computer.

To keep developed APS cartridge films, the FUJICOLOR POCKET ALBUM AP-5 POP L, AP-1 POP L, or AP-1 POP KG, or the CARTRIDGE FILE 16 is preferable.

EXAMPLE

Examples of the present invention will be described below, which, however, in no way limit the scope of the present invention.

Example 1

The support used in this example was prepared by the following method.

1) First Layer and Substratum:

Both surfaces of a 90 μm thick polyethylene naphthalate support were treated with glow discharge under such conditions that the treating ambient pressure was 2.66×10 Pa, the $H_2O$ partial pressure of ambient gas 75%, the discharge frequency 30 kHz, the output 2500 W, and the treating strength 0.5 kV·A·min/$m^2$. This support was coated, in a coating amount of 5 mL/$m^2$, with a coating liquid of the following composition to provide the 1st layer in accordance with the bar coating method described in JP-B-58-4589.

| | |
|---|---|
| Conductive fine grain dispersion ($SnO_2/Sb_2O_5$ grain conc. 10% water dispersion, secondary agglomerate of | 50 pts. wt. |

-continued

| | |
|---|---|
| 0.005 μm grain size primary grains which has an av. grain size of 0.05 μm) | |
| Gelatin | 0.5 pt. wt. |
| Water | 49 pts. wt. |
| Polyglycerol polyglycidyl ether | 0.16 pt. wt. |
| Polyoxyethylene sorbitan monolaurate (polymn. degree 20) | 0.1 pt. wt. |

The support furnished with the first coating layer was wound round a stainless steel core of 20 cm diameter and heated at 110° C. (Tg of PEN support: 119° C.) for 48 hr to thereby effect heat history annealing. The other side of the support opposite to the first layer was coated, in a coating amount of 10 mL/m$^2$, with a coating liquid of the following composition to provide a substratum for emulsion in accordance with the bar coating method.

| | |
|---|---|
| Gelatin | 1.01 pts. wt. |
| Salicylic acid | 0.30 pt. wt. |
| Resorcin | 0.40 pt. wt. |
| Polyoxyethylene nonylphenyl ether (polymn. degree 10) | 0.11 pt. wt. |
| Water | 3.53 pt. wt. |
| Methanol | 84.57 pts. wt. |
| n- Propanol | 10.08 pts.wt. |

Furthermore, the following second layer and third layer were superimposed in this sequence on the first layer by coating. Finally, multilayer coating of a color negative photosensitive material of the composition indicated below was performed on the opposite side. Thus, a transparent magnetic recording medium with silver halide emulsion layers was obtained.

2) Second Layer (Transparent Magnetic Recording Layer):

(1) Dispersion of Magnetic Substance:

1100 parts by weight of Co-coated γ-$Fe_2O_3$ magnetic substance (average major axis length: 0.25 μm, $S_{BET}$: 39 m$^2$/g, Hc: 6.56×10$^4$ A/m, σs: 77.1 Am$^2$/kg, and σr: 37.4 Am$^2$/kg), 220 parts by weight of water and 165 parts by weight of silane coupling agent (3-(poly(polymerization degree: 10)oxyethynyl)oxypropyltrimethoxysilane) were fed into an open kneader, and blended well for 3 hr. The resultant coarsely dispersed viscous liquid was dried at 70° C. round the clock to thereby remove water, and heated at 110° C. for 1 hr. Thus, surface treated magnetic grains were obtained.

Further, in accordance with the following recipe, a composition was prepared by blending by means of the open kneader once more for 4 hr:

| | |
|---|---|
| Thus obtained surface treated magnetic grains | 855 g |
| Diacetylcellulose | 25.3 g |
| Methyl ethyl ketone | 136.3 g |
| Cyclohexanone | 136.3 g |

Still further, in accordance with the following recipe, a composition was prepared by carrying out fine dispersion by means of a sand mill (¼G sand mill) at 2000 rpm for 4 hr. Glass beads of 1 mmφ diameter were used as medium.

| | |
|---|---|
| Thus obtained blend liquid | 45 g |
| Diacetylcellulose | 23.7 g |
| Methyl ethyl ketone | 127.7 g |
| Cyclohexanone | 127.7 g |

Moreover, in accordance with the following recipe, a magnetic substance-containing intermediate liquid was prepared.

(2) Preparation of Magnetic Substance-Containing Intermediate Liquid:

| | |
|---|---|
| Thus obtained fine dispersion of magnetic substance | 674 g |
| Diacetylcellulose soln. (solid content 4.34%, solvent: methyl ethyl ketone/cyclohexanone = 1/1) | 24,280 g |
| Cyclohexanone | 46 g |

These were mixed together and agitated by means of a disperser to thereby obtain a "magnetic substance-containing intermediate liquid".

An α-alumina abrasive dispersion of the present invention was produced in accordance with the following recipe.

(a) Preparation of Sumicorundum AA-1.5 (average primary grain diameter: 1.5 μm, specific surface area: 1.3 m$^2$/g) grain dispersion

| | |
|---|---|
| Sumicorundum AA-1.5 | 152 g |
| Silane coupling agent KBM903 (produced by Shin- Etsu Silicone) | 0.48 g |
| Diacetylcellulose soln. (solid content 4.5%, solvent: methyl ethyl ketone/cyclohexanone = 1/1) | 227.52 g |

In accordance with the above recipe, fine dispersion was carried out by means of a ceramic-coated sand mill (¼G sand mill) at 800 rpm for 4 hr. Zirconia beads of 1 mmφ diameter were used as medium.

(b) Colloidal silica grain dispersion (fine grains)

Use was made of "MEK-ST" produced by Nissan Chemical Industries, Ltd.

This is a dispersion of colloidal silica of 0.015 μm average primary grain diameter in methyl ethyl ketone as a dispersion medium, wherein the solid content is 30%.

(3) Preparation of a Coating Liquid for Second Layer:

| | |
|---|---|
| Thus obtained magnetic substance containing intermediate liquid | 19,053 g |
| Diacetylcellulose soln. (solid content 4.5%, solvent: methyl ethyl ketone/cyclohexanone = 1/1) | 264 g |
| Colloidal silica dispersion "MEK-ST" (dispersion b, solid content: 30%) | 128 g |
| AA-1.5 dispersion (dispersion a) | 12 g |
| Millionate MR-400 (produced by Nippon Polyurethane) diluent (solid content 20%, dilution solvent: methyl ethyl ketone/cyclohexanone = 1/1) | 203 g |
| Methyl ethyl ketone | 170 g |
| Cyclohexanone | 170 g |

A coating liquid obtained by mixing and agitating these was applied in a coating amount of 29.3 mL/m$^2$ with the use of a wire bar. Drying was performed at 110° C. The thickness of magnetic layer after drying was 1.0 μm.

3) Third Layer (Higher Fatty Acid Ester Sliding Agent Containing Layer)

(1) Preparation of Raw Dispersion of Sliding Agent

The following liquid A was heated at 100° C. to thereby effect dissolution, added to liquid B and dispersed by means of a high-pressure homogenizer, thereby obtaining a raw dispersion of sliding agent.

| | |
|---|---|
| Liquid A: | |
| Compd. of the formula: | |
| $C_6H_{13}CH(OH)(CH_2)_{10}COOC_{50}H_{101}$ | 399 pts. wt. |
| Compd. of the formula: | |
| n-$C_{50}H_{101}O(CH_2CH_2O)_{16}H$ | 171 pts. wt. |
| Cyclohexanone | 830 pts. wt. |
| Liquid B: | |
| Cyclohexanone | 8600 pts. wt. |

(2) Preparation of Spherical Inorganic Grain Dispersion

Spherical inorganic grain dispersion (c1) was prepared in accordance with the following recipe.

| | |
|---|---|
| Isopropyl alcohol | 93.54 pts. wt. |
| Silane coupling agent KBM903 (produced by Shin-Etsu Silicone) Compd. 1-1: $(CH_3O)_3Si—(CH_2)_3—NH_2$ | 5.53 pts. wt. |
| Compound 1 | 2.93 pts. wt. |
| Compound 1 | |
| Seahostar KEP50 (amorphous spherical silica, av. grain size 0.5 μm, produced by Nippon Shokubai Ltd. | 88.00 pts. wt. |
| This composition was agitated for 10 min, and further the following was added. | |
| Diacetone alcohol | 252.93 pts. wt. |

The resultant liquid was dispersed by means of ultrasonic homogenizer "Sonifier 450 (manufactured by Branson)" for 3 hr while cooling with ice and stirring, thereby finishing spherical inorganic grain dispersion c1.

(3) Preparation of Spherical Organic Polymer Grain Dispersion

Spherical organic polymer grain dispersion (c2) was prepared in accordance with the following recipe.

| | |
|---|---|
| XC99-A8808 (produced by Toshiba Silicone Co., Ltd., sperical crosslinked polysiloxane grain, av. grain size 0.9 μm) | 60 pts. wt. |
| Methyl ethyl ketone | 120 pts. wt. |
| Cyclohexanone | 120 pts. wt. |

(solid content 20%, solvent: methyl ethyl ketone/cyclohexanone=1/1)

This mixture was dispersed by means of ultrasonic homogenizer "Sonifier 450 (manufactured by Branson)" for 2 hr while cooling with ice and stirring, thereby finishing spherical organic polymer grain dispersion c2.

(4) Preparation of Coating Liquid for 3rd Layer

A coating liquid for 3rd layer was prepared by adding the following components to 542 g of the aforementioned raw dispersion of sliding agent:

| | |
|---|---|
| Diacetone alcohol | 5950 g |
| Cyclohexanone | 176 g |
| Ethyl acetate | 1700 g |
| Above Seahostar KEP50 dispersion (c1) | 53.1 g |
| Above spherical organic polymer grain dispersion (c2) | 300 g |
| FC431 (produced by 3M, solid content 50%, solvent: ethyl acetate) | 2.65 g |
| BYK310 (produced by BYK ChemiJapan, solid content 25%) | 5.3 g. |

The above 3rd-layer coating liquid was applied to the 2nd layer in a coating amount of 10.35 mL/m$^2$, dried at 110° C. and further postdried at 97° C. for 3 min.

4) Application of Light-Sensitive Layer by Coating:

The thus obtained back layers on its side opposite to the support were coated with a plurality of layers of the following respective compositions, thereby obtaining a color negative film sample 101.

(Composition of Light-Sensitive Layer)

The numeric value given beside the description of each component is for the coating amount expressed in the unit of g/m$^2$. With respect to the silver halide and colloidal silver, the coating amount is in terms of silver quantity.

(Sample 101)

| | | |
|---|---|---|
| 1st layer (1st antihalation layer) | | |
| Black colloidal silver | silver | 0.125 |
| Silver iodobromide emulsion grains having an average grain diameter of 0.07 μm | silver | 0.01 |
| Gelatin | | 0.922 |
| ExM-1 | | 0.068 |
| ExC-1 | | 0.002 |
| ExC-3 | | 0.002 |
| Cpd-2 | | 0.001 |
| F-8 | | 0.001 |
| HBS-1 | | 0.050 |
| HBS-2 | | 0.002 |
| 2nd layer (2nd antihalation layer) | | |
| Black colloidal silver | silver | 0.052 |
| Gelatin | | 0.420 |
| ExF-1 | | 0.002 |
| F-8 | | 0.001 |
| Solid disperse dye ExF-7 | | 0.122 |
| HBS-1 | | 0.076 |
| 3rd layer (Interlayer) | | |
| ExC-2 | | 0.050 |
| Cpd-1 | | 0.090 |
| Polyethylacrylate latex | | 0.200 |
| HBS-1 | | 0.100 |
| Gelatin | | 0.700 |
| 4th layer (Low-speed red-sensitive emulsion layer) | | |
| Em-D | silver | 0.503 |
| Em-C | silver | 0.343 |
| ExC-1 | | 0.190 |
| ExC-2 | | 0.013 |
| ExC-3 | | 0.070 |
| ExC-4 | | 0.121 |
| ExC-5 | | 0.010 |
| ExC-6 | | 0.007 |
| ExC-8 | | 0.053 |

-continued

| | | |
|---|---|---|
| ExC-9 | | 0.020 |
| Cpd-2 | | 0.025 |
| Cpd-4 | | 0.025 |
| Cpd-7 | | 0.015 |
| UV-2 | | 0.047 |
| UV-3 | | 0.086 |
| UV-4 | | 0.018 |
| HBS-1 | | 0.240 |
| HBS-5 | | 0.038 |
| Gelatin | | 0.994 |
| 5th layer (Medium-speed red-sensitive emulsion layer) | | |
| Em-B | silver | 0.490 |
| Em-C | silver | 0.455 |
| ExC-1 | | 0.159 |
| ExC-2 | | 0.072 |
| ExC-3 | | 0.020 |
| ExC-4 | | 0.104 |
| ExC-5 | | 0.023 |
| ExC-6 | | 0.010 |
| ExC-8 | | 0.016 |
| ExC-9 | | 0.005 |
| Cpd-2 | | 0.036 |
| Cpd-4 | | 0.028 |
| Cpd-7 | | 0.020 |
| HBS-1 | | 0.129 |
| Gelatin | | 0.890 |
| 6th layer (High-speed red-sensitive emulsion layer) | | |
| Em-A | silver | 1.110 |
| ExC-1 | | 0.245 |
| ExC-3 | | 0.035 |
| ExC-6 | | 0.025 |
| ExC-8 | | 0.114 |
| ExC-9 | | 0.022 |
| ExY-3 | | 0.010 |
| Cpd-2 | | 0.066 |
| Cpd-4 | | 0.079 |
| Cpd-7 | | 0.030 |
| HBS-1 | | 0.329 |
| HBS-2 | | 0.120 |
| Gelatin | | 1.240 |
| 7th layer (Interlayer) | | |
| Cpd-1 | | 0.094 |
| Cpd-6 | | 0.369 |
| Solid disperse dye ExF-4 | | 0.030 |
| HBS-1 | | 0.049 |
| Polyethylacrylate latex | | 0.088 |
| Gelatin | | 0.886 |
| 8th layer (layer for donating interlayer effect to red-sensitive layer) | | |
| Em-J | silver | 0.177 |
| Em-K | silver | 0.170 |
| Cpd-4 | | 0.034 |
| ExM-2 | | 0.144 |
| ExM-3 | | 0.014 |
| ExY-1 | | 0.018 |
| ExY-4 | | 0.036 |
| ExC-7 | | 0.026 |
| HBS-1 | | 0.218 |
| HBS-3 | | 0.003 |
| HBS-5 | | 0.030 |
| Gelatin | | 0.614 |
| 9th layer (Low-speed green-sensitive emulsion layer) | | |
| Em-H | silver | 0.330 |
| Em-G | silver | 0.335 |
| Em-I | silver | 0.082 |
| ExM-2 | | 0.374 |
| ExM-3 | | 0.045 |
| ExY-1 | | 0.018 |
| ExC-7 | | 0.007 |
| HBS-1 | | 0.098 |
| HBS-3 | | 0.010 |

-continued

| | | |
|---|---|---|
| HBS-4 | | 0.074 |
| HBS-5 | | 0.544 |
| Cpd-5 | | 0.010 |
| Cpd-7 | | 0.020 |
| Gelatin | | 1.465 |
| 10th layer (Medium-speed green-sensitive emulsion layer) | | |
| Em-F | silver | 0.459 |
| ExM-2 | | 0.057 |
| ExM-3 | | 0.028 |
| ExY-3 | | 0.008 |
| ExC-6 | | 0.010 |
| ExC-7 | | 0.011 |
| ExC-8 | | 0.010 |
| HBS-1 | | 0.064 |
| HBS-3 | | 0.002 |
| HBS-4 | | 0.020 |
| HBS-5 | | 0.020 |
| Cpd-5 | | 0.004 |
| Cpd-7 | | 0.010 |
| Gelatin | | 0.443 |
| 11th layer (High-speed green-sensitive emulsion layer) | | |
| Em-E | silver | 0.788 |
| ExC-6 | | 0.002 |
| ExC-8 | | 0.012 |
| ExM-1 | | 0.014 |
| ExM-2 | | 0.033 |
| ExM-3 | | 0.033 |
| ExY-3 | | 0.007 |
| Cpd-3 | | 0.004 |
| Cpd-4 | | 0.007 |
| Cpd-5 | | 0.010 |
| Cpd-7 | | 0.020 |
| HBS-1 | | 0.144 |
| HBS-3 | | 0.003 |
| HBS-4 | | 0.020 |
| HBS-5 | | 0.037 |
| Polyethylacrylate latex | | 0.099 |
| Gelatin | | 0.930 |
| 12th layer (Yellow filter layer) | | |
| Cpd-1 | | 0.098 |
| Solid disperse dye ExF-2 | | 0.070 |
| Solid disperse dye ExF-5 | | 0.010 |
| Oil-soluble dye ExF-6 | | 0.010 |
| HBS-1 | | 0.049 |
| Gelatin | | 0.626 |
| 13th layer (Low-speed blue-sensitive emulsion layer) | | |
| Em-O | silver | 0.108 |
| Em-M | silver | 0.324 |
| Em-N | silver | 0.242 |
| ExC-1 | | 0.022 |
| ExC-7 | | 0.015 |
| ExY-1 | | 0.002 |
| ExY-2 | | 0.895 |
| ExY-4 | | 0.056 |
| Cpd-2 | | 0.102 |
| Cpd-3 | | 0.004 |
| HBS-1 | | 0.225 |
| HBS-5 | | 0.070 |
| Gelatin | | 1.550 |
| 14th layer (High-speed blue-sensitive emulsion layer) | | |
| Em-L | silver | 0.720 |
| ExY-2 | | 0.205 |
| ExY-3 | | 0.008 |
| ExY-4 | | 0.070 |
| Cpd-2 | | 0.074 |
| Cpd-3 | | 0.001 |
| Cpd-7 | | 0.030 |
| HBS-1 | | 0.120 |
| Gelatin | | 0.680 |

-continued

| | | |
|---|---|---|
| 15th layer (1st protective layer) | | |
| Silver iodobromide emulsion grains having an average grain diameter of 0.07 μm | silver | 0.305 |
| UV-1 | | 0.211 |
| UV-2 | | 0.132 |
| UV-3 | | 0.198 |
| UV-4 | | 0.026 |
| F-11 | | 0.009 |
| S-1 | | 0.086 |
| HBS-1 | | 0.175 |
| HBS-4 | | 0.050 |

-continued

| | |
|---|---|
| Gelatin | 1.986 |
| 16th layer (2nd protective layer) | |
| H-1 | 0.400 |
| B-1 (diameter 1.7 μm) | 0.050 |
| B-2 (diameter 1.7 μm) | 0.150 |
| B-3 | 0.050 |
| S-1 | 0.200 |
| Gelatin | 0.750 |

In addition to the above components, W-1 to W-6, B-4 to B-6, F-1 to F-19, a lead salt, a platinum salt, an iridium salt and a rhodium salt were appropriately added to the individual layers in order to improve the storability, processability, resistance to pressure, mildewproofing and antiseptic properties, antistatic properties and coating property thereof. Preparation of dispersion of organic solid disperse dye:

The ExF-2 of the 12th layer was dispersed by the following method. Specifically,

| | |
|---|---|
| Wet cake of ExF-2 (containing 17.6 wt. % water) | 2.800 kg |
| Sodium octylphenyldiethoxymethanesulfonate (31 wt. % aq. solution) | 0.376 kg |
| F-15 (7% aq. solution) | 0.011 kg |
| Water | 4.020 kg |
| Total | 7.210 kg |

(adjusted to pH=7.2 with NaOH).

Slurry of the above composition was agitated by means of a dissolver, and further dispersed by means of agitator mill LMK-4 under such conditions that the peripheral speed, delivery rate and packing ratio of 0.3 mm-diameter zircon-a beads were 10 m/s, 0.6 kg/min and 80%, respectively, until the absorhance ratio of the dispersion became 0.29. Thus, a solid particulate dispersion was obtained, wherein the average particle diameter of dye particulate was 0.29 μm. Solid dispersions of ExF-4 and ExF-7 were obtained in the same manner. The average particle diameters of these dye particulates were 0.28 μm and 0.49 μm, respectively. ExF-5 was dispersed by the microprecipitation dispersion method described in Example 1 of EP. No. 549,489A. The average particle diameter thereof was 0.06 μm.

TABLE 1

| Emulsion | Average iodide (mol %) | Equivalent sphere diameter (μm) | Aspect ratio | Equivalent circle diameter (μm) | Grain thickness (μm) | Shape |
|---|---|---|---|---|---|---|
| Em-A | 4 | 0.92 | 14 | 2 | 0.14 | Tabular |
| Em-B | 5 | 0.8 | 12 | 1.6 | 0.13 | Tabular |
| Em-C | 4.7 | 0.51 | 7 | 0.85 | 0.12 | Tabular |
| Em-D | 3.9 | 0.37 | 2.7 | 0.4 | 0.15 | Tabular |
| Em-E | 5 | 0.92 | 14 | 2 | 0.14 | Tabular |
| Em-F | 5.5 | 0.8 | 12 | 1.6 | 0.13 | Tabular |
| Em-G | 4.7 | 0.51 | 7 | 0.85 | 0.12 | Tabular |
| Em-H | 3.7 | 0.49 | 3.2 | 0.58 | 0.18 | Tabular |
| Em-I | 2.8 | 0.29 | 1.2 | 0.27 | 0.23 | Tabular |
| Em-J | 5 | 0.8 | 12 | 1.6 | 0.13 | Tabular |
| Em-K | 3.7 | 0.47 | 3 | 0.53 | 0.18 | Tabular |
| Em-L | 5.5 | 1.4 | 9.8 | 2.6 | 0.27 | Tabular |
| Em-M | 8.8 | 0.64 | 5.2 | 0.85 | 0.16 | Tabular |
| Em-N | 3.7 | 0.37 | 4.6 | 0.55 | 0.12 | Tabular |
| Em-O | 1.8 | 0.19 | — | — | — | Cubic |

The silver halide grains contained in emulsions Em-A to -O are all gains of silver iodobromide.

In Table 1, emulsions Em-A to -C contained the optimum amount of spectral sensitizing dyes 1 to 3, and were subjected to gold sensitization, sulfur sensitization and selenium sensitization optimally. Emulsions Em-E to -G contained the optimum amount of spectral sensitizing dyes 4 to 6, and were subjected to gold sensitization, sulfur sensitization and selenium sensitization optimally. Emulsion Em-J contained the optimum amount of spectral sensitizing dyes 7 and 8, and was subjected to gold sensitization, sulfur sensitization and selenium sensitization optimally. Emulsion Em-L contained the optimum amount of spectral sensitizing dyes 9 to 11, and was subjected to gold sensitization, sulfur sensitization and selenium sensitization optimally. Emulsion Em-O contained the optimum amount of spectral sensitizing dyes 10 to 12, and was subjected to gold sensitization and sulfur sensitization optimally. Emulsions Em-D, -H, -I, -K, -M and -N contained the optimum amount of spectral sensitizing dye listed in Table 2, and were subjected to gold sensitization, sulfur sensitization and selenium sensitization optimally.

TABLE 2

| Emulsion | Sensitizing dye | Addition amount (mo/mo] Ag) |
|---|---|---|
| Em-D | Sensitizing dye 1 | $5.44 \times 10^{-4}$ |
| | Sensitizing dye 2 | $2.35 \times 10^{-4}$ |
| | Sensitizing dye 3 | $7.26 \times 10^{-6}$ |

TABLE 2-continued

| Emulsion | Sensitizing dye | Addition amount (mo/mo] Ag) |
|---|---|---|
| Em-H | Sensitizing dye 8 | $6.52 \times 10^{-4}$ |
| | Sensitizing dye 13 | $1.35 \times 10^{-4}$ |
| | Sensitizing dye 6 | $2.48 \times 10^{-5}$ |
| Em-I | Sensitizing dye 8 | $6.09 \times 10^{-4}$ |
| | Sensitizing dye 13 | $1.26 \times 10^{-4}$ |
| | Sensitizing dye 6 | $2.32 \times 10^{-5}$ |
| Em-K | Sensitizing dye 7 | $6.27 \times 10^{-4}$ |
| | Sensitizing dye 8 | $2.24 \times 10^{-4}$ |
| Em-M | Sensitizing dye 9 | $2.43 \times 10^{-4}$ |
| | Sensitizing dye 10 | $2.43 \times 10^{-4}$ |
| | Sensitizing dye 11 | $2.43 \times 10^{-4}$ |
| Em-N | Sensitizing dye 9 | $3.28 \times 10^{-4}$ |
| | Sensitizing dye 10 | $3.28 \times 10^{-4}$ |
| | Sensitizing dye 11 | $3.28 \times 10^{-4}$ |

The sensitizing dyes used in the examples of the present invention will be listed below.

Sensitizing dye 1

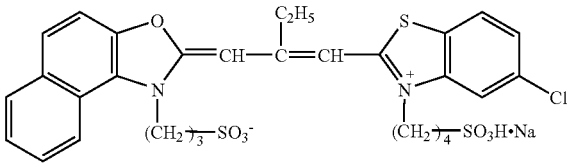

Sensitizing dye 2

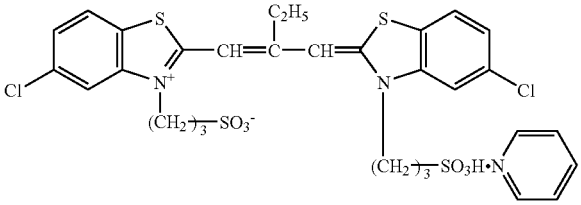

Sensitizing dye 3

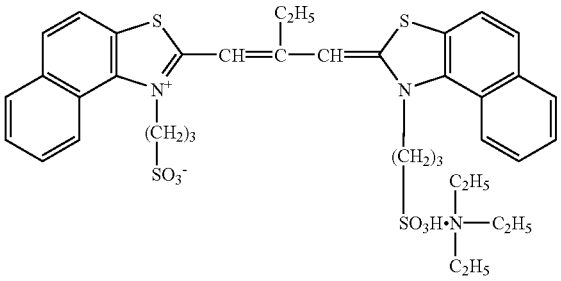

Sensitizing dye 4

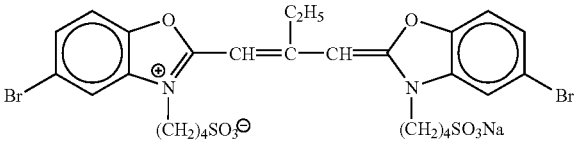

-continued

Sensitizing dye 5

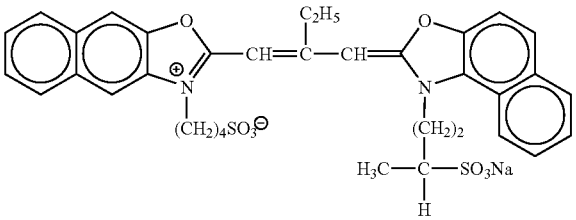

Sensitizing dye 6

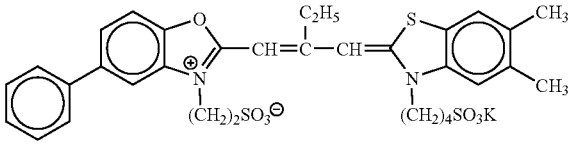

Sensitizing dye 7

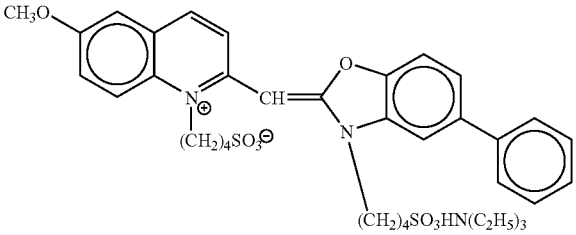

Sensitizing dye 8

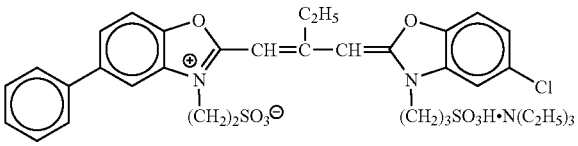

Sensitizing dye 9

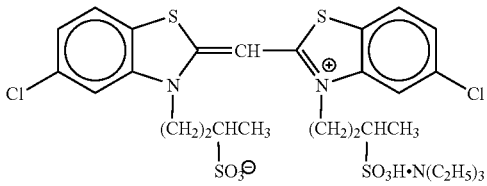

Sensitizing dye 10

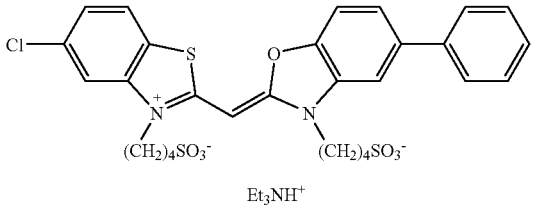

Sensitizing dye 11

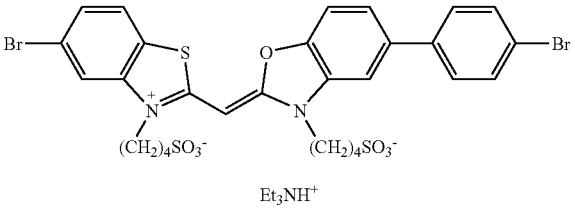

-continued

Sensitizing dye 12

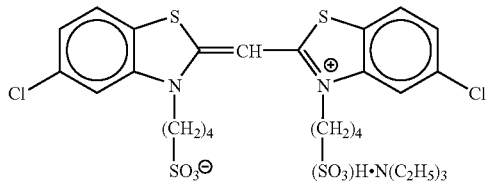

Sensitizing dye 13

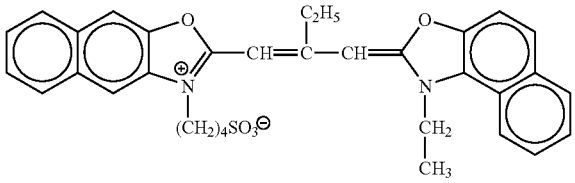

Sensitizing dye 14

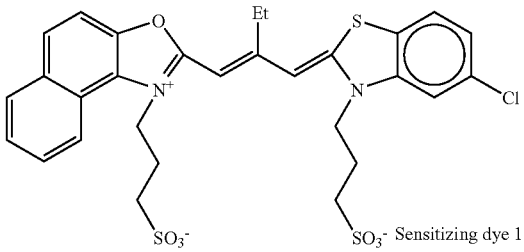

Sensitizing dye 15

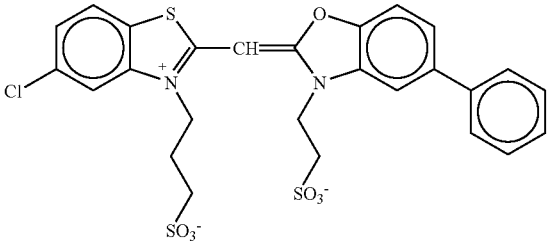

-continued

Sensitizing dye 16

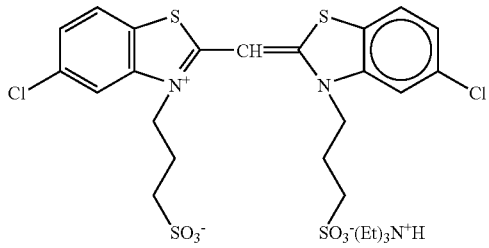

For the preparation of the tabular grains a low-molecular-weight gelatin was used according to the examples described in JP-A-1-158426.

Emulsions Em-A to -K contained the optimum amount of Ir and Fe.

Emulsions Em-L to -O were reduction-sensitized at the time of preparing the grains.

If a high-voltage electron microscope is used, it is observed that the tabular grains have dislocation lines as described in the publication of JP-A-3-237450.

With respect to Emulsions Em-A to -C and -J, dislocation introduction was performed by using the iodide ion-releasing agent according to the examples described in the publication of JP-A-6-11782.

With respect to emulsion Em-E, dislocation introduction was performed by using the silver iodide fine grains prepared immediately before being added. The preparation was conducted in a different chamber having a magnetic coupling induction type mixer described in the publication of JP-A-10-43570.

The other compounds used in the examples of the present invention will be listed below.

ExC-1

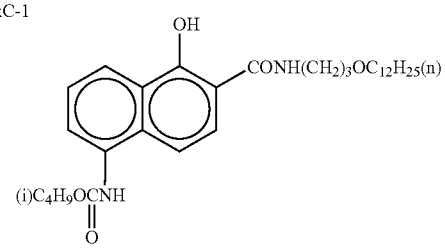

ExC-2

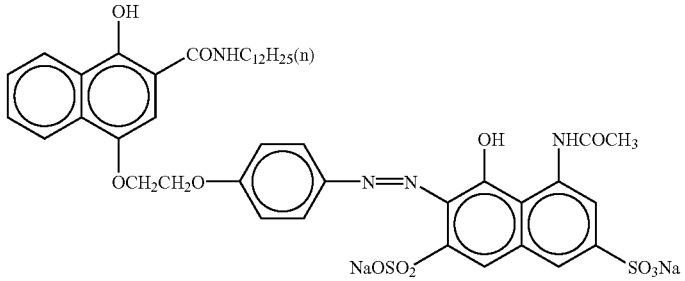

-continued
ExC-3
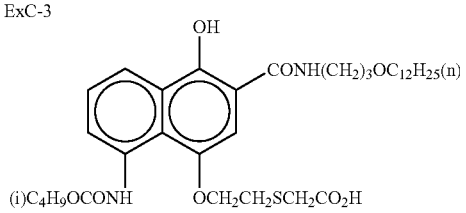
ExC-4
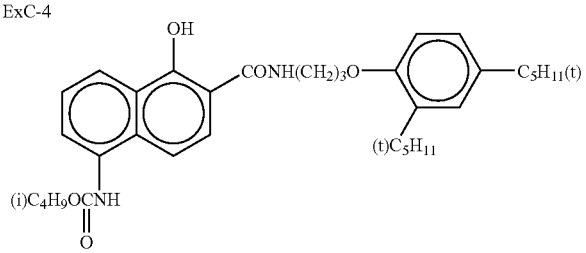
ExC-5
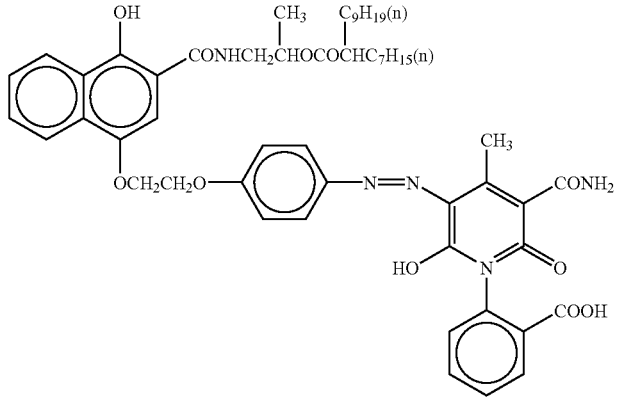
ExC-6
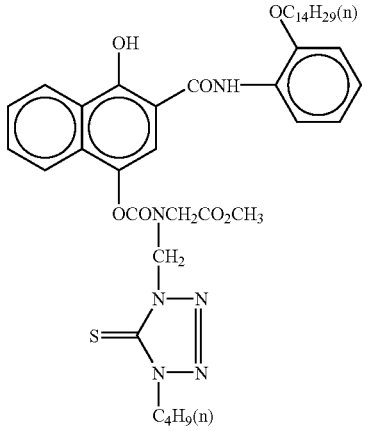

-continued
ExC-7
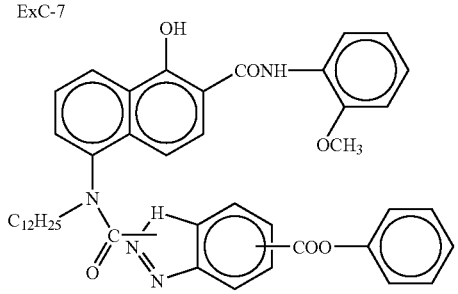
ExC-8
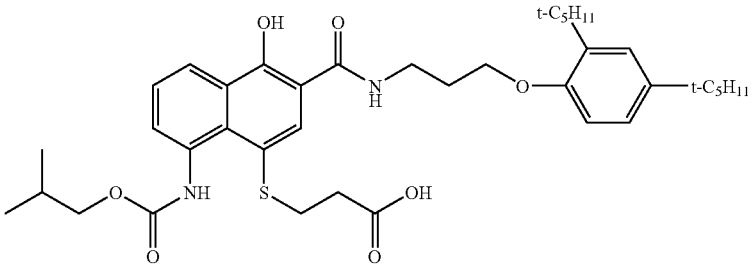
ExC-9
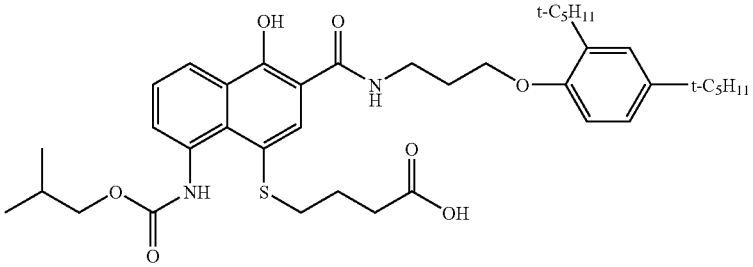
ExM-1
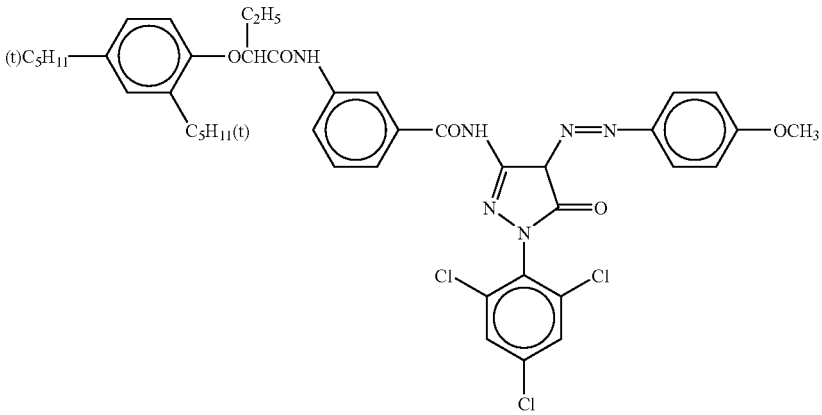

-continued
ExM-2
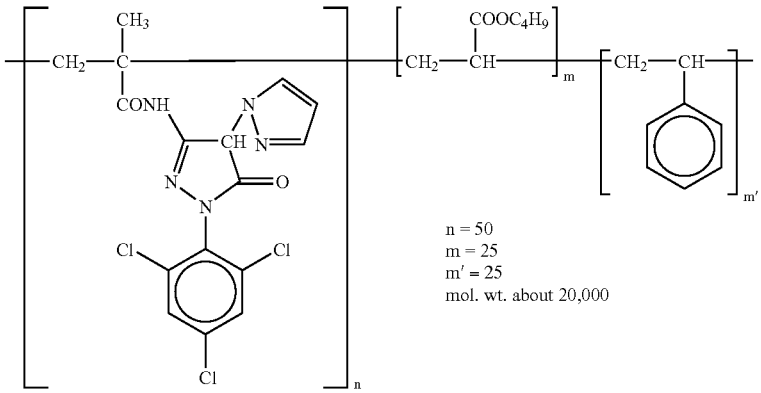
ExM-3
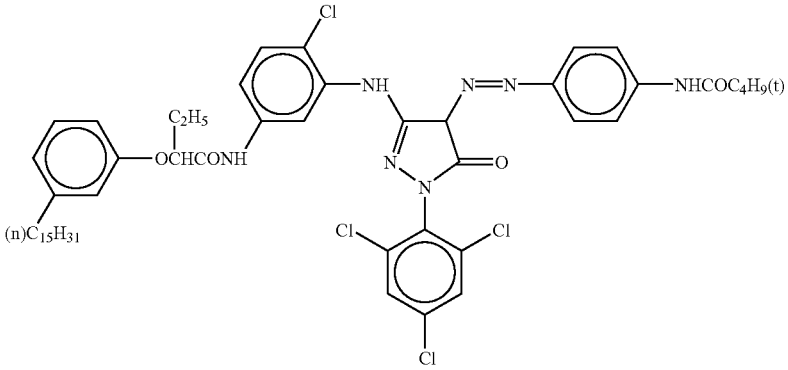
ExY-1
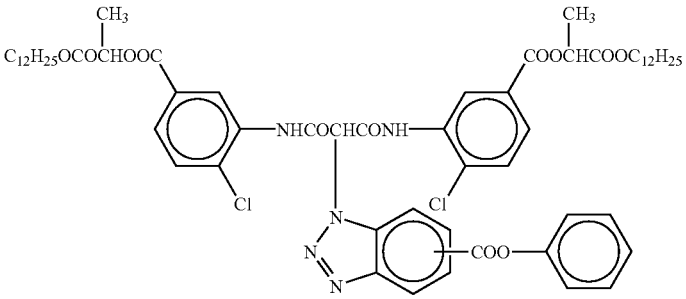
ExY-2
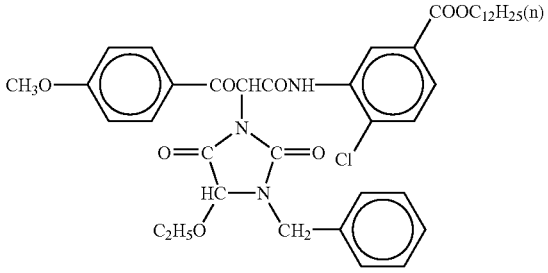

-continued
ExY-3
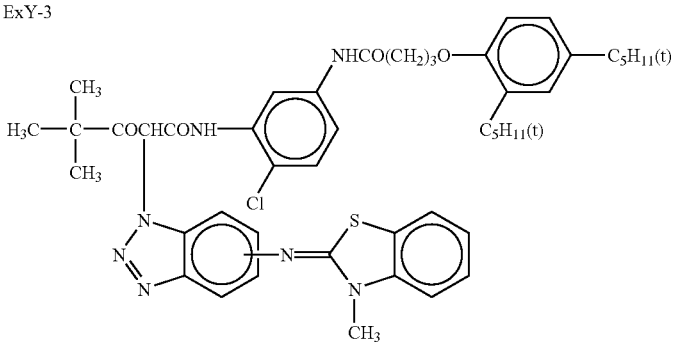
ExY-4
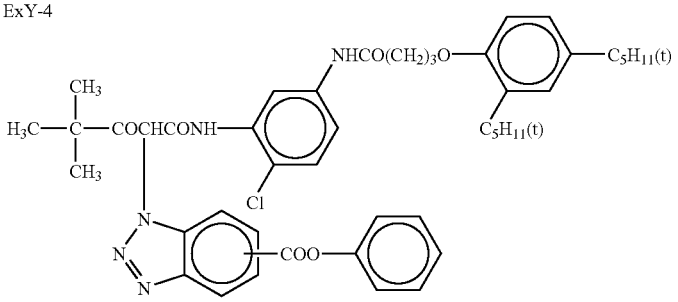
ExY-5
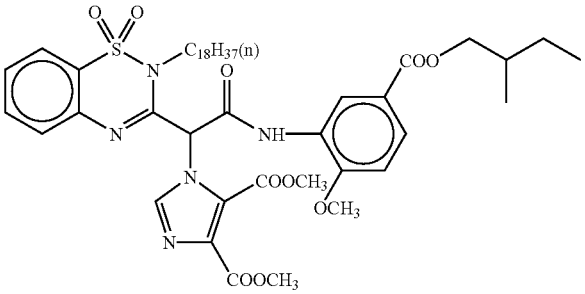
Cpd-1
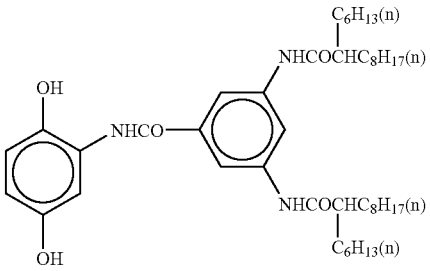
Cpd-3
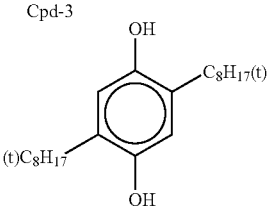
Cpd-2
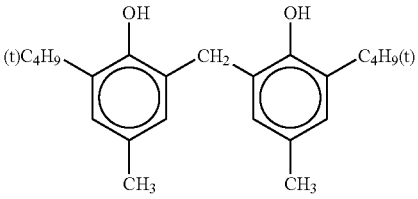
Cpd-5
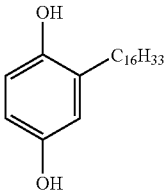

-continued
Cpd-4
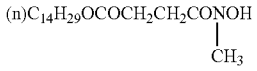
Cpd-6
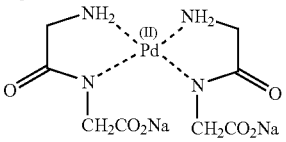
Cpd-7
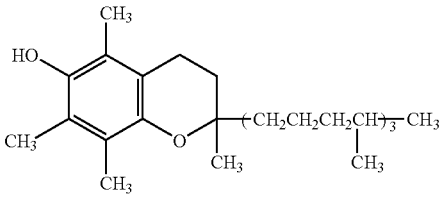
B-1
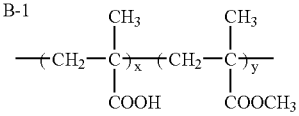
x/y = 10/90 (wt. ratio)
Average mol. wt.:
about 35,000
B-2
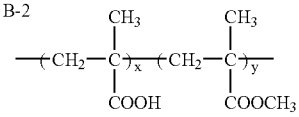
x/y = 40/60 (wt. ratio)
Average mol. wt.:
about 20,000
B-3
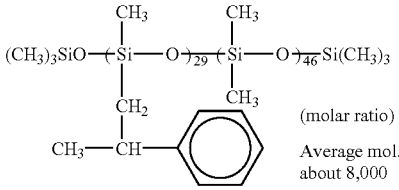
(molar ratio)
Average mol. wt.:
about 8,000
B-4
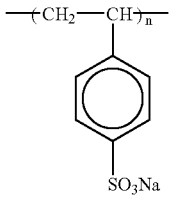
Average mol. wt.:
about 750,000
B-5
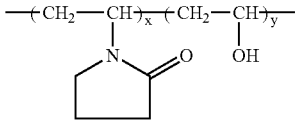
x/y = 70/30 (wt. ratio)
Average mol. wt.:
about 17,000
B-6
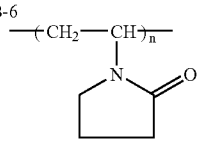
Average mol. wt.:
about 10,000
HBS-1 Tricresyl phosphate -continued
HBS-2 Di-n-butyl phthalate
HBS-3
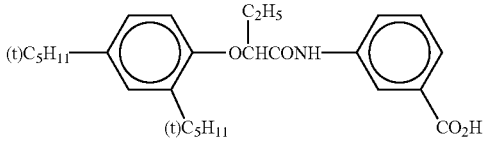
HBS-4 Tri(2-ethylhexyl) phosphate
HBS-5
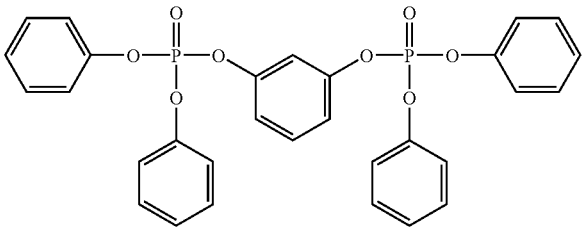
S-1
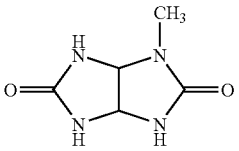
H-1
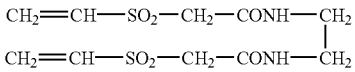
F-1
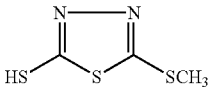
F-2
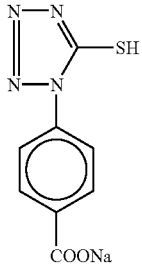
F-3
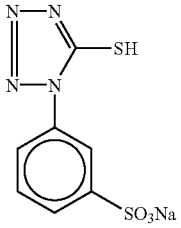
F-4
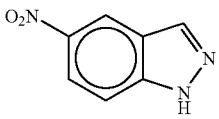
F-5
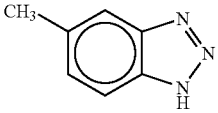
F-6
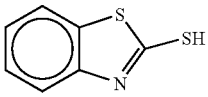

-continued
F-7
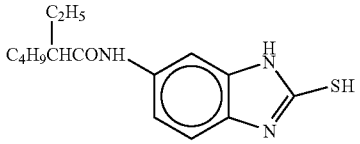
F-8
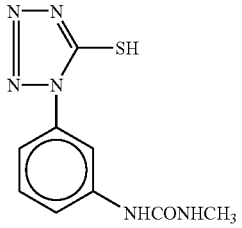
F-9
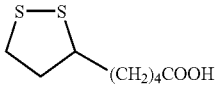
F-10
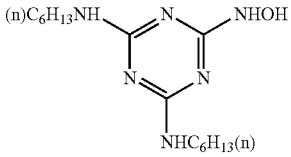
F-11
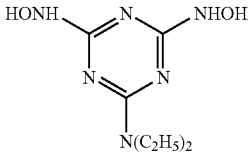
F-12
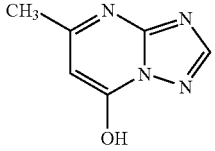
F-13
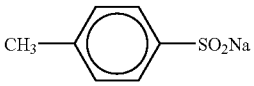
F-14
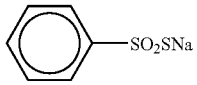
F-15
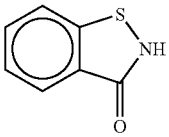
F-16
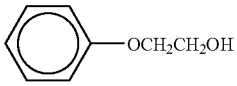
F-17
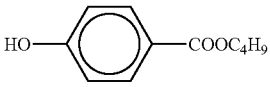
F-18
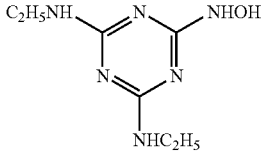
F-19
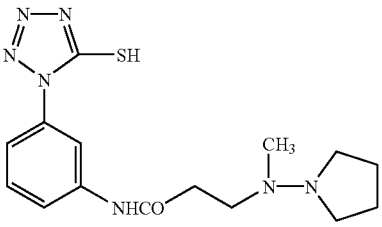
W-1 $C_8F_{17}SO_2NHCH_2CH_2CH_2OCH_2\overset{\oplus}{C}H_2N(CH_3)_3$
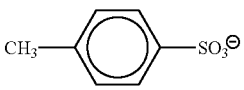

-continued
W-2
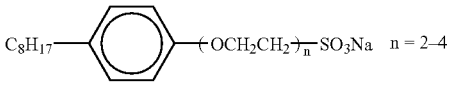
W-3
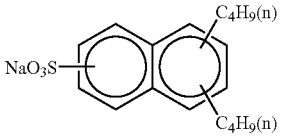
W-4
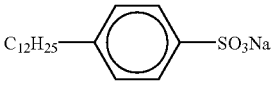
W-5
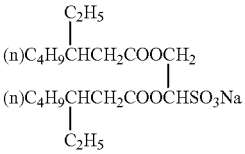
W-6
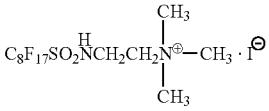
W-7
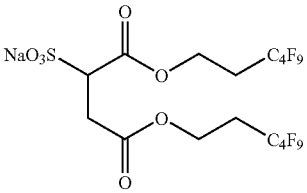
W-8
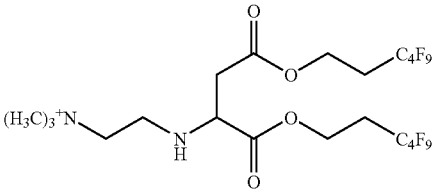
W-9
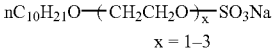
W-10
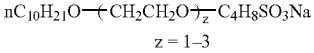
W-11
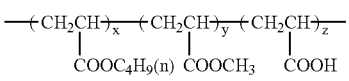
x/y/z = 20/60/20 (wt. ratio)
Average mol. wt.: about 36,000
ExF-1
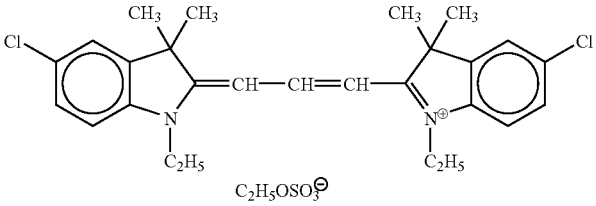
ExF-2
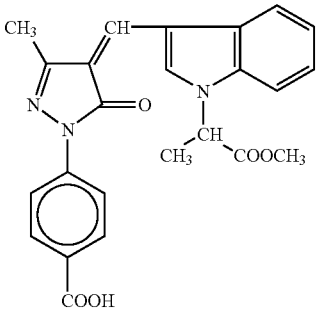
Comparative compound A
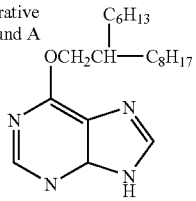

-continued

ExF-4

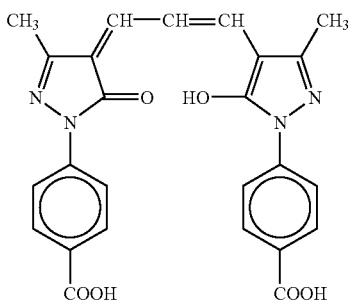

ExF-5

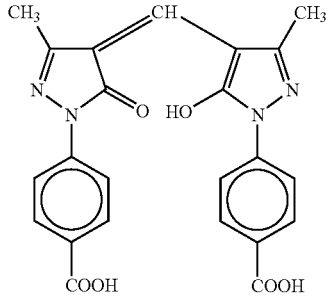

ExF-6

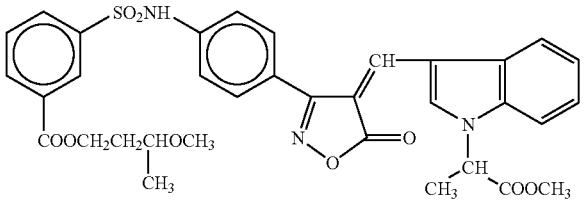

ExF-7

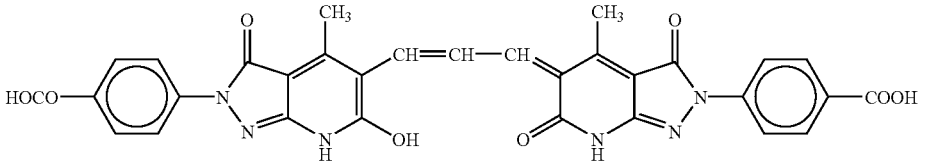

The above silver halide color photosensitive material is regarded as sample 101.

(Preparation of Samples 102 to 119)

Samples 102 to 119 were prepared in the same manner as sample 101, except that the compound of general formula (M) or (C) of the present invention was added to the 6th, 11th, and 14th layers of sample 101, as shown in Table 3.

Samples 101 to 119 were exposed for 1/100 second through a gelatin filter SC-39 manufactured by Fuji Photo Film Co., Ltd. and a continuous wedge.

Each of the exposed samples was processed by the following method.

(Processing Steps)

| Step | Time | Temp. |
|---|---|---|
| Color development | 3 min 15 sec | 38° C. |
| Bleaching | 3 min 00 sec | 38° C. |
| Washing | 30 sec | 24° C. |
| Fixing | 3 min 00 sec | 38° C. |
| Washing (1) | 30 sec | 24° C. |
| Washing (2) | 30 sec | 24° C. |
| Stabilization | 30 sec | 38° C. |
| Drying | 4 min 20 sec | 55° C. |

The composition of each processing solution was as follows.

| | (unit: g) |
|---|---|
| (Color developer) | |
| Diethylenetriaminepentaacetic acid | 1.0 |
| 1-Hydroxyethylidene-1,1-diphosphonic acid | 2.0 |
| Sodium sulfite | 4.0 |
| Potassium carbonate | 30.0 |
| Potassium bromide | 1.4 |
| Potassium iodide | 1.5 mg |
| Hydroxylamine sulfate | 2.4 |
| 4-[N-ethyl-N-(β-hydroxyethyl) amino]-2-methylaniline sulfate | 4.5 |
| Water to make | 1.0 L |
| pH (adjusted by potassium hydroxide and sulfuric acid) | 10.05 |
| (Bleach-fix soln.) | |
| Fe (III) sodium ethylenediaminetetraacetate trihydrate | 100.0 |
| Disodium ethylenediaminetetraacetate | 10.0 |
| 3-Mercapto-1,2,4-triazole | 0.03 |
| Aminonium bromide | 140.0 |
| Ammonium nitrate | 30.0 |
| Aq. ammonia (27%) | 6.5 ml |

-continued

| | (unit: g) |
|---|---|
| Water to make | 1.0 L |
| pH (adjusted by aqueous ammonia and nitric acid) | 6.0 |
| (Fixing solution) | |
| Disodium ethylenediaminetetraacetate | 0.5 |
| Sodium sulfite | 20.0 |

-continued

| | (unit: g) |
|---|---|
| Aq. soln. of ammonium thiosuiphate (700 g/L) | 295.0 ml |
| Acetic acid (90%) | 3.3 |
| Water to make | 1.0 L |
| pH (adjusted by aqueous ammonia and nitric acid) | 6.7 |
| (Stabilizer solution) | |
| p-Nonylphenoxypolyglycidol (glycidol av. polymerization degree: 10) | 0.2 |
| Ethylenediaminetetraacetic acid | 0.05 |
| 1,2,4-Triazole | 1.3 |
| 1,4-Bis(1,2,4-triazol-1-ylmethyl) piperazine | 0.75 |
| Hydroxyacetic acid | 0.02 |
| Hydroxyethylcellulose (HEC SP-2000 produced by Daicel Chemical Industries, Ltd.) | 0.1 |
| 1,2-Benzisothiazolin-3-one | 0.05 |
| Water to make | 1.0 L |
| pH | 8.5. |

The speeds of the red-sensitive layer, green-sensitive layer and blue-sensitive layer were indicated with the logarithmic value of the reciprocal of the exposure amount necessary to give the cyan, magenta, and yellow color image densities of the minimum density plus 0.2, respectively, and represented by the difference with respect to the sample 101.

With respect to the graininess, the RMS granularity of the cyan, magenta, and yellow color images at the fog density plus 0.2 was determined and evaluated. The graininess was indicated with the relative value where the graininess of sample 101 is assumed as 100.

In order to evaluate the substantial speed increase, if the RMS granularity varied with the increase of speed, the amounts of ExY-3 in the sixth, eleventh, and fourteenth layers were adjusted, thereby matching the RMS granularity with that of Sample 101. The speed was then compared.

TABLE 3

| | Compound of generaal formula (M) or general formula (C) | | | | Addition amount (per mol of Ag × $10^{-3}$mol) | | | Speed | | | Graininess | | |
|---|---|---|---|---|---|---|---|---|---|---|---|---|---|
| Sample No. | No. | pKa | ΔpAgF | CRV | 6 th layer | 11 th layer | 14 th layer | R layer | G layer | B layer | R layer | G layer | B layer |
| 101 (Comp.) | — | — | — | — | — | — | — | 0.00 | 0.00 | 0.00 | 100 | 100 | 100 |
| 102 (Comp.) | Comp. Comp. A | — | — | — | 10 | 10 | 10 | +0.03 | +0.03 | +0.03 | 102 | 102 | 102 |
| 103(Inv.) | (64) | 8.83 | 0.46 | 0.14 | 10 | 10 | 10 | +0.06 | +0.05 | +0.06 | 100 | 101 | 101 |
| 104(Inv.) | (70) | 8.73 | 0.45 | 0.14 | 10 | 10 | 10 | +0.06 | +0.05 | +0.06 | 100 | 101 | 101 |
| 105(Inv.) | (55) | 8.43 | 0.44 | 0.14 | 10 | 10 | 10 | +0.08 | +0.06 | +0.07 | 100 | 101 | 101 |
| 106(Inv.) | (56) | 8.48 | 0.35 | 0.18 | 10 | 10 | 10 | +0.08 | +0.05 | +0.07 | 102 | 100 | 101 |
| 107(Inv.) | (57) | 8.51 | 0.20 | 0.14 | 10 | 10 | 10 | +0.10 | +0.07 | +0.08 | 102 | 102 | 101 |
| 108(Inv.) | (2) | 8.12 | 0.21 | 0.16 | 10 | 10 | 10 | +0.13 | +0.10 | +0.13 | 101 | 101 | 101 |
| 109(Inv.) | (3) | 8.13 | 0.20 | 0.16 | 10 | 10 | 10 | +0.13 | +0.09 | +0.12 | 102 | 100 | 102 |
| 110(Inv.) | (9) | 8.15 | 0.22 | 0.13 | 10 | 10 | 10 | +0.13 | +0.09 | +0.11 | 102 | 102 | 102 |
| 111(Inv.) | (17) | 8.13 | 0.18 | 0.16 | 10 | 10 | 10 | +0.15 | +0.12 | +0.14 | 102 | 101 | 102 |
| 112(Inv.) | (20) | 6.49 | 0.20 | 0.17 | 10 | 10 | 10 | +0.14 | +0.12 | +0.13 | 101 | 101 | 101 |
| 113(Inv.) | (58) | 8.25 | 0.20 | 0.02 | 10 | 10 | 10 | +0.17 | +0.14 | +0.16 | 101 | 101 | 101 |
| 114(Inv.) | (15) | 8.13 | 0.20 | 0.03 | 10 | 10 | 10 | +0.17 | +0.14 | +0.16 | 101 | 101 | 102 |
| 115(Inv.) | (18) | 8.14 | 0.20 | 0.03 | 10 | 10 | 10 | +0.17 | +0.14 | +0.16 | 102 | 102 | 102 |
| 116(Inv.) | (59) | 8.14 | 0.21 | 0.03 | 10 | 10 | 10 | +0.18 | +0.15 | +0.17 | 102 | 102 | 100 |
| 117(Inv.) | (2) | 8.12 | 0.21 | 0.16 | 10 | — | — | +0.13 | 0.00 | 0.00 | 101 | 101 | 101 |
| 118(Inv.) | (2) | 8.12 | 0.21 | 0.16 | — | 10 | — | 0.00 | +0.10 | 0.00 | 101 | 101 | 101 |
| 119(Inv.) | (2) | 8.12 | 0.21 | 0.16 | — | — | 10 | 0.00 | 0.00 | +0.13 | 101 | 101 | 101 |

Note:
R layer = Red-sensitive layer; G layer = Blue-sensitive layer; B layer = Blue-sensitive layer
Comp. comp. A = Comparative compound A As described above, it is apparent that the method of the present invention is excellent in obtaining a high quality image. This is made possible by increasing the speed of the photosensitive material without deteriorating the graininess.

It is also apparent from samples 117 to 119 that the effect of the speed increase is more pronounced if the compound represented by formula (M) is used for the red-sensitive layer and blue-sensitive layer, than used for the green-sensitive layer.

Example 2

Sample 201 was prepared in the same manner as sample 106, except that the compound (56) used for the eleventh layer of sample 106 described in Example 1 was moved to the twelfth layer.

Sample 201 was evaluated in the same manner as sample 106 using the method described in Example 1. The speed increase effect of the green-sensitive layer was 0.03, which was reduced with respect to 0.06 of sample 106. However, as the coating liquid of the eleventh and twelfth layers was left over 12 hours at 40° C. before preparation of sample 201, a fog increase did not occur in sample 201, thus making sample 201 advantageous over the undesired fog increase occurring in the eleventh layer of sample 106.

It is preferable that the compound of the present invention be added directly to the light-sensitive layer, from the viewpoint of increasing the effect. However, from the viewpoint of preventing the above side effects, it has been found preferable that the compound be added to the adjacent nonsensitive layer.

Example 3

The support used in Example 3 was prepared using the same method as Example 1.

Application of Light-Sensitive Layer by Coating

Next, the thus obtained back layers on its side opposite to the support were coated with a plurality of layers of the following compositions, thereby obtaining a color negative film sample 301.

(Composition of Light-Sensitive Layer)

The numeric value given beside the description of each component indicates the coating amount represented in the unit of g/m$^2$. With respect to the silver halide, the coating amount is indicated in terms of silver quantity.

For each specific compound, numeral is used in common with Example 1.

(Sample 301)

| | | |
|---|---|---|
| 1st layer (1st antihalation layer) | | |
| Black colloidal silver | silver | 0.104 |
| Silver iodobromide emulsion grains having an average grain diameter of 0.07 μm | silver | 0.011 |
| Gelatin | | 0.910 |
| ExM-1 | | 0.060 |
| ExC-1 | | 0.002 |
| ExC-3 | | 0.002 |
| Cpd-2 | | 0.001 |
| F-8 | | 0.001 |
| HBS-1 | | 0.050 |
| HBS-2 | | 0.002 |
| 2nd layer (2nd antihalation layer) | | |
| Black colloidal silver | silver | 0.055 |
| Gelatin | | 0.413 |
| ExF-1 | | 0.002 |
| F-8 | | 0.001 |
| Solid disperse dye ExF-7 | | 0.120 |
| HBS-1 | | 0.076 |
| 3rd layer (Interlayer) | | |
| ExC-2 | | 0.050 |
| Cpd-1 | | 0.090 |
| Polyethylacrylate latex | | 0.200 |
| HBS-1 | | 0.100 |
| Gelatin | | 0.700 |
| 4th layer (Low-speed red-sensitive emulsion layer) | | |
| Em-C' | silver | 0.515 |
| Em-D' | silver | 0.344 |
| ExC-1 | | 0.193 |
| ExC-2 | | 0.010 |
| ExC-3 | | 0.073 |
| ExC-4 | | 0.120 |
| ExC-5 | | 0.010 |
| ExC-6 | | 0.007 |
| ExC-8 | | 0.053 |
| ExC-9 | | 0.020 |
| Cpd-2 | | 0.020 |
| Cpd-4 | | 0.025 |
| Cpd-7 | | 0.015 |
| UV-2 | | 0.047 |
| UV-3 | | 0.086 |
| UV-4 | | 0.018 |
| HBS-1 | | 0.240 |
| HBS-5 | | 0.038 |

-continued

| | | |
|---|---|---|
| Gelatin | | 0.994 |
| 5th layer (Medium-speed red-sensitive emulsion layer) | | |
| Em-B' | silver | 0.943 |
| ExC-1 | | 0.145 |
| ExC-2 | | 0.076 |
| ExC-3 | | 0.023 |
| ExC-4 | | 0.100 |
| ExC-5 | | 0.023 |
| ExC-6 | | 0.010 |
| ExC-8 | | 0.016 |
| ExC-9 | | 0.005 |
| Cpd-2 | | 0.036 |
| Cpd-4 | | 0.028 |
| Cpd-7 | | 0.020 |
| HBS-1 | | 0.120 |
| Gelatin | | 0.894 |
| 6th layer (High-speed red-sensitive emulsion layer) | | |
| Em-A' | silver | 1.230 |
| ExC-1 | | 0.230 |
| ExC-3 | | 0.034 |
| ExC-6 | | 0.025 |
| ExC-8 | | 0.112 |
| ExC-9 | | 0.023 |
| ExY-3 | | 0.011 |
| Cpd-2 | | 0.062 |
| Cpd-4 | | 0.079 |
| Cpd-7 | | 0.030 |
| HBS-1 | | 0.329 |
| HBS-2 | | 0.120 |
| Gelatin | | 1.300 |
| 7th layer (Interlayer) | | |
| Cpd-1 | | 0.094 |
| Cpd-6 | | 0.369 |
| Solid disperse dye ExF-4 | | 0.030 |
| HBS-1 | | 0.049 |
| Polyethylacrylate latex | | 0.088 |
| Gelatin | | 0.886 |
| 8th layer (layer for donating interlayer effect to red-sensitive layer) | | |
| Em-E' | silver | 0.343 |
| Cpd-4 | | 0.033 |
| ExM-2 | | 0.143 |
| ExM-3 | | 0.014 |
| ExY-1 | | 0.015 |
| ExY-4 | | 0.039 |
| ExC-7 | | 0.022 |
| HBS-1 | | 0.218 |
| HBS-3 | | 0.003 |
| HBS-5 | | 0.030 |
| Gelatin | | 0.614 |
| 9th layer (Low-speed green-sensitive emulsion layer) | | |
| Em-I' | silver | 0.323 |
| Em-J' | silver | 0.345 |
| Em-H' | silver | 0.082 |
| ExM-2 | | 0.374 |
| ExM-3 | | 0.044 |
| ExY-1 | | 0.013 |
| ExC-7 | | 0.007 |
| HBS-1 | | 0.098 |
| HBS-3 | | 0.010 |
| HBS-4 | | 0.074 |
| HBS-5 | | 0.544 |
| Cpd-5 | | 0.010 |
| Cpd-7 | | 0.020 |
| Gelatin | | 1.464 |
| 10th layer (Medium-speed green-sensitive emulsion layer) | | |
| Em-G' | silver | 0.459 |
| ExM-2 | | 0.060 |
| ExM-3 | | 0.026 |

-continued

| | | |
|---|---|---|
| ExY-3 | | 0.005 |
| ExC-6 | | 0.013 |
| ExC-7 | | 0.011 |
| ExC-8 | | 0.010 |
| HBS-1 | | 0.064 |
| HBS-3 | | 0.002 |
| HBS-4 | | 0.020 |
| HBS-5 | | 0.020 |
| Cpd-5 | | 0.004 |
| Cpd-7 | | 0.010 |
| Gelatin | | 0.432 |
| 11th layer (High-speed green-sensitive emulsion layer) | | |
| Em-F' | silver | 0.880 |
| Em-H' | silver | 0.110 |
| ExC-6 | | 0.003 |
| ExC-8 | | 0.012 |
| ExM-1 | | 0.016 |
| ExM-2 | | 0.034 |
| ExM-3 | | 0.032 |
| ExY-3 | | 0.007 |
| Cpd-3 | | 0.004 |
| Cpd-4 | | 0.007 |
| Cpd-5 | | 0.010 |
| Cpd-7 | | 0.020 |
| HBS-1 | | 0.144 |
| HBS-3 | | 0.003 |
| HBS-4 | | 0.020 |
| HBS-5 | | 0.037 |
| Polyethylacrylate latex | | 0.099 |
| Gelatin | | 0.988 |
| 12th layer (Yellow filter layer) | | |
| Cpd-1 | | 0.098 |
| Solid disperse dye ExF-2 | | 0.070 |
| Solid disperse dye ExF-5 | | 0.010 |
| Oil-soluble dye ExF-6 | | 0.010 |
| HBS-1 | | 0.049 |
| Gelatin | | 0.626 |
| 13th layer (Low-speed blue-sensitive emulsion layer) | | |
| Em-O' | silver | 0.123 |
| Em-M' | silver | 0.309 |
| Em-N' | silver | 0.211 |
| ExC-1 | | 0.020 |
| ExC-7 | | 0.015 |
| ExY-1 | | 0.002 |
| ExY-2 | | 0.355 |
| ExY-4 | | 0.056 |
| ExY-5 | | 0.410 |

-continued

| | | |
|---|---|---|
| Cpd-2 | | 0.102 |
| Cpd-3 | | 0.004 |
| HBS-1 | | 0.225 |
| HBS-5 | | 0.070 |
| Gelatin | | 1.450 |
| 14th layer (High-speed blue-sensitive emulsion layer) | | |
| Em-K' | silver | 0.810 |
| Em-L' | | 0.100 |
| ExY-2 | | 0.080 |
| ExY-3 | | 0.005 |
| ExY-4 | | 0.073 |
| ExY-5 | | 0.101 |
| Cpd-2 | | 0.074 |
| Cpd-3 | | 0.001 |
| Cpd-7 | | 0.030 |
| HBS-1 | | 0.124 |
| Gelatin | | 0.699 |
| 15th layer (1st protective layer) | | |
| Silver iodobromide emulsion grains having an average grain diameter of 0.07 μm | silver | 0.305 |
| UV-1 | | 0.211 |
| UV-2 | | 0.132 |
| UV-3 | | 0.198 |
| UV-4 | | 0.026 |
| UV-5 | | 0.200 |
| F-11 | | 0.009 |
| S-1 | | 0.086 |
| HBS-1 | | 0.175 |
| HBS-4 | | 0.050 |
| Gelatin | | 2.120 |
| 16th layer (2nd protective layer) | | |
| H-1 | | 0.400 |
| B-1 (diameter 1.7 μm) | | 0.050 |
| B-2 (diameter 1.7 μm) | | 0.150 |
| B-3 | | 0.050 |
| S-1 | | 0.200 |
| Gelatin | | 0.750 |

In addition to the above components, W-1 to W-11, B-4 to B-6, F-1 to F-19, a lead salt, a platinum salt, an iridium salt and a rhodium salt were appropriately added to the individual layers in order to improve the storage life, processability, resistance to pressure, mildewproofing and antiseptic properties, antistatic properties and coating property thereof.

TABLE 4

Characteristics of silver halide grains contained in emulsions Em-A' to Em-O'

| | Layer in which emulsion is used | Grain shape | Av. ESD (μm) | Av. ECD (μm) COV (%) | Av. thick-ness (μm) COV (%) | Av. aspect ratio | Ratio of tabular grains * (%) | Thick-ness of core portion (μm) | Tree ring structure in core portion | Number of dislocation line per grain |
|---|---|---|---|---|---|---|---|---|---|---|
| Em-A' | High-speed R-sens. layer | (111) main plane tabular grain | 0.95 | 2.20/32 | 0.12/14 | 18 | 97 | 0.09 | absent | 20 |
| Em-B' | Medium-speed R-sens. layer | (111) main plane tabular grain | 0.69 | 1.30/35 | 0.10/15 | 13 | 98 | 0.07 | absent | 15 |
| Em-C' | Low-speed R-sens. layer | (111) main plane tabular grain | 0.48 | 0.89/17 | 0.09/12 | 10 | 99 | — | — | 10 |
| Em-D' | Low speed R-sens. layer | (111) main plane tabular grain | 0.31 | 0.40/20 | 0.09/9.3 | 4.5 | 98 | — | — | 10 |
| Em-E' | Layer for donating interimage effect to R-sens. layer | (111) main plane tabular grain | 0.78 | 1.38/24 | 0.15/13 | 9.2 | 97 | 0.12 | present | 20 |
| Em-F' | High-speed G-sens. layer | (111) main plane tabular grain | 1.00 | 2.40/33 | 0.13/14 | 19 | 99 | 0.09 | absent | 20 |

TABLE 4-continued

Characteristics of silver halide grains contained in emulsions Em-A' to Em-O'

| | Layer in which emulsion is used | Grain shape | Av. ESD (μm) | Av. ECD (μm) COV (%) | Av. thick-ness (μm) COV (%) | Av. aspect ratio | Ratio of tabular grains * (%) | Thick-ness of core portion (μm) | Tree ring structure in core portion | Number of dislocation line per grain |
|---|---|---|---|---|---|---|---|---|---|---|
| Em-G' | Medium-speed G-sens. layer | (111) main plane tabular grain | 0.74 | 1.64/34 | 0.10/15 | 16 | 96 | 0.07 | absent | 15 |
| Em-H' | High- and low-speed G-sens. layer | (111) main plane tabular grain | 0.74 | 1.39/25 | 0.14/11 | 9.9 | 98 | 0.12 | present | 20 |
| Em-I' | Low speed G-sens. layer | (111) main plane tabular grain | 0.55 | 0.79/30 | 0.14/13 | 5.5 | 97 | 0.11 | present | 30 |
| Em-J' | Low speed G-sens. layer | (111) main plane tabular grain | 0.44 | 0.53/30 | 0.17/18 | 3.2 | 97 | 0.13 | present | 20 |
| Em-K' | High-speed B-sens. layer | (111) main plane tabular grain | 1.60 | 3.00/25 | 0.31/21 | 10 | 99 | 0.16 | present | 15 |
| Em-L' | High-speed B-sens. layer | (111) main plane tabular grain | 1.30 | 2.20/24 | 0.34/22 | 7 | 98 | 0.14 | present | 20 |
| Em-M' | Low-speed B-sens. layer | (111) main plane tabular grain | 0.81 | 1.10/30 | 0.23/18 | 4.7 | 97 | 0.13 | present | 20 |
| Em-N' | Low-speed B-sens. layer | (111) main plane tabular grain | 0.40 | 0.55/32 | 0.13/16 | 4.6 | 96 | 0.11 | present | 20 |
| Em-O' | Low-speed B-sens. layer | (100) main plane cubic grain | 0.21 | 0.21/20 | 0.21/20 | 1 | — | — | — | — |

* Ratio of tabular grains = Ratio occupied by tabular grains to the total projected area R-sens. = Red-sensitive; G-sens. = Green-sensitive; B-sens. = Blue-sensitive; Av. ESD = Average equivalent sphere diameter; Av. ECD = Average equivalent circle diameter; COV = Coefficient of veriation; Av. thickness = Average thickness; Av. aspect ratio = Average aspect ratio

TABLE 5

Composition structure of silver halide grains contained in emulsions Em-A' to Em-O'

| | Layer in which emulsion is used | Characteristics of grains occupying 70% or moer of the total projected erea | Silver amount ratio in grain structure (%) and halogen composition (from center of grain) The number in < > is halogen composition in epitaxial junction portion |
|---|---|---|---|
| Em-A' | High-speed R-sens. layer | (111) main plane tabular grain | (11%)AgBr/(35%)$AgBr_{97}I_3$/(18%)AgBr/(9%)$AgBr_{62}I_{38}$/(27)AgBr |
| Em-B' | Medium-speed R-sens. layer | (111) main plane tabular grain | (7%)AgBr/(31%)$AgBr_{97}I_3$/(16%)AgBr/(12%)$AgBr_{62}I_{38}$/(34%)AgBr |
| Em-C' | Low-speed R-sens. layer | (111) main plane tabular grain | (1%)AgBr/(77%)$AgBr_{99}I_1$/(9%)$AgBr_{95}I_5$/(13%)<$AgBr_{63}Cl_{35}I_2$> |
| Em-D' | Low speed R-sens. layer | (111) main plane tabular grain | (57%)AgBr/(14%)$AgBr_{96}I_4$/(29%)<$AgBr_{57}Cl_{41}I_2$> |
| Em-E' | Layer for donating interimage effect to R-sens. layer | (111) main plane tabular grain | (13%)AgBr/(36%)$AgBr_{97}I_3$/(7%)AgBr/(11%)$AgBr_{62}I_{38}$/(33%)AgBr |
| Em-F' | High-speed G-sens. layer | (111) main plane tabular grain | (11%)AgBr/(35%)$AgBr_{97}I_3$/(18%)AgBr/(4%)AgI/(32%)AgBr |
| Em-G' | Medium-speed G-sens. layer | (111) main plane tabular grain | (7%)AgBr/(31%)$AgBr_{97}I_3$/(15%)AgBr/(14%)$AgBr_{62}I_{38}$/(33%)AgBr |
| Em-H' | High- and low-speed G-sens. layer | (111) main plane tabular grain | (14%)AgBr/(36%)$AgBr_{97}I_3$/(7%)AgBr/(11%)$AgBe_{62}I_{38}$/(32%)AgBr |
| Em-I' | Low speed G-sens. layer | (111) main plane tabular grain | (15%)AgBr/(44%)$AgBr_{97}I_3$/(11%)AgBr/(5%)AgI/(25%)AgBr |
| Em-J' | Low speed G-sens. layer | (111) main plane tabular grain | (60%)AgBr/(2%)AgI/(33%)AgBr |
| Em-K' | High-speed B-sens. layer | (111) main plane tabular grain | (68%)$AgBr_{93}I_7$/(21%)AgBr/(1%)AgI/(10%)AgBr |
| Em-L' | High-speed B-sens. layer | (111) main plane tabular grain | (8%)AgBr/(10%)$AgBr_{95}I_5$/(52%)$AgBr_{93}I_7$/(11%)AgBr/(2%)AgI/(17%)AgBr |
| Em-M' | Low-speed B-sens. layer | (111) main plane tabular grain | (12%)AgBr/(43%)$AgBr_{90}I_{10}$/(14%)AgBr/(2%)AgI/(29%)AgBr |
| Em-N' | Low-speed B-sens. layer | (111) main plane tabular grain | (58%)AgBr/(4%)AgI/(38%)AgBr |
| Em-O' | Low-speed B-sens. layer | (100) main plane cubic grain | (6%)AgBr/(94%)$AgBr_{96}I_4$ |

R-sens. = Red-sensitive; G-sens. = Green-sensitive; B-sens. = Blue-sensitive

TABLE 7

Sensitizing dye and dopant used in emulsions Em-A' to Em-O'

| | Layer in which emulsion is used | Sensitizing dye | Dopant |
|---|---|---|---|
| Em-A' | High-speed R-sens. layer | 1, 3, and 14 | $K_2IrCl_6$, and $K_4Fe(CN)_6$ |
| Em-B' | Medium-speed R-sens. layer | 1, 2, and 3 | $K_2IrCl_6$, $K_2IrCl_5(H_2O)$, and $K_4Ru(CN)_6$ |
| Em-C' | Low-speed R-sens. layer | 2, 3, and 14 | $K_2IrCl_6$, and $K_4Fe(CN)_6$ |
| Em-D' | Low speed R-sens. layer | 2, 3 and 14 | $K_2IrCl_6$, and $K_4Fe(CN)_6$ |
| Em-E' | Layer for donating interimage effect to R-sens. layer | 7 and 8 | $K_4Fe(CN)_6$ |
| Em-F' | High-speed G-sens. layer | 5, 6, and 8 | $K_4Ru(CN)_6$ |

TABLE 7-continued

Sensitizing dye and dopant used in emulsions Em-A' to Em-O'

| | Layer in which emulsion is used | Sensitizing dye | Dopant |
|---|---|---|---|
| Em-G' | Medium-speed G-sens. layer | 5, 6, and 8 | $K_2IrCl_6$, and $K_4Fe(CN)_6$ |
| Em-H' | High- and low-speed G-sens. layer | 4, 5, 6, 8, and 13 | $K_2IrCl_6$, and $K_4Fe(CN)_6$ |
| Em-I' | Low speed G-sens. layer | 4, 5, and 6 | $K_2IrCl_6$ |
| Em-J' | Low speed G-sens. layer | 6, 8, and 14 | $K_2IrCl_6$, and $K_4Fe(CN)_6$ |
| Em-K' | High-speed B-sens. layer | 16 | — |
| Em-L' | High-speed B-sens. layer | 9 | — |
| Em-M' | Low-speed B-sens. layer | 16 | — |
| Em-N' | Low-speed B-sens. layer | 9 and 15 | — |
| Em-O' | Low-speed B-sens. layer | 12 and 15 | $K_2IrCl_6$ |

R-sens. = Red-sensitive; G-sens. = Green-sensitive; B-sens. = Blue-sensitive

TABLE 6

| | Layer in which emulsion was used | Av. silver iodide content (mol %)/ Inter-grain COV (%) | Grain surface silver iodide content (mol %) | Average silver chloride content (mol %)/ Inter-grain COV (%) | Grain surface silver chloride content (mol %) | Twin plane distance (μm) COV (%) | (100) plane ratio to side faces | Ratio in number of grains satisfying the requirement A below to the total grains |
|---|---|---|---|---|---|---|---|---|
| Em-A' | High-speed R-sens. layer | 4.5/10 | 3.90 | 0 | 0 | 0.011/30 | 20 | 55 |
| Em-B' | Medium-speed R-sens. layer | 5.5/11 | 5.00 | 0 | 0 | 0.010/30 | 30 | 75 |
| Em-C' | Low-speed R-sens. layer | 1.5/10 | 3.70 | 4.7/8.0 | 16 | 0.010/31 | 25 | — |
| Em-D' | Low speed R-sens. layer | 1.1/11 | 5.00 | 12/9.0 | 23 | 0.009/29 | 25 | — |
| Em-E' | Layer for donating interimage effect to R-sens. layer | 5.3/10 | 5.90 | 0 | 0 | 0.012/30 | 35 | 20 |
| Em-F' | High-speed G-sens. layer | 5.1/10 | 3.90 | 0 | 0 | 0.012/30 | 20 | 60 |
| Em-G' | Medium-speed G-sens. layer | 6.3/13 | 5.60 | 0 | 0 | 0.010/30 | 30 | 65 |
| Em-H' | High- and low-speed G-sens. layer | 5.3/14 | 5.97 | 0 | 0 | 0.011/30 | 30 | 25 |
| Em-I' | Low speed G-sens. layer | 6.3/12 | 7.39 | 0 | 0 | 0.016/32 | 20 | 15 |
| Em-J' | Low speed G-sens. layer | 2.0/14 | 5.68 | 0 | 0 | 0.016/32 | 35 | 18 |
| Em-K' | High-speed B-sens. layer | 5.8/7.0 | 3.88 | 0 | 0 | 0.010/29 | 40 | 25 |
| Em-L' | High-speed B-sens. layer | 6.1/8.0 | 5.50 | 0 | 0 | 0.017/33 | 20 | 20 |
| Em-M' | Low-speed B-sens. layer | 6.3/9.0 | 1.90 | 0 | 0 | 0.019/30 | 30 | 15 |
| Em-N' | Low-speed B-sens. layer | 4.0/10 | 5.50 | 0 | 0 | 0.020/31 | 30 | 20 |
| Em-O' | Low-speed B-sens. layer | 3.8/9.0 | 4.50 | 0 | 0 | — | — | — |

Requirement A: Consisting of silver iodobromide or silver chloroiodobromide grains each having (111) planes as main planes, equivalent circle diameter of 1.0 μm or more, grain thickness of 0.15 μm or less, a core portion consisting of silver iodobromide having a thickness of 0.1 μm or less without a tree ring structure anf 10 or more dislocation lines.

R-sens. = Red-sensitive; G-sens. = Green-sensitive; B-sens. = Blue-sensitive; COV = Coefficient of variation The emulsions contained the optimum amount of spectral sensitizing dye listed in Table 7, and were subjected to gold sensitization, sulfur sensitization and selenium sensitization optimally.

The above silver halide color photosensitive material is regarded as sample 301.

(Preparation of Samples 302 to 313)

Samples 302 to 313 were prepared in the same manner as sample 301, except that the compound of the present invention was added to the sixth, eleventh, and fourteenth layers of sample 301, as shown in Table 8.

Samples 301 to 313 were exposed for 1/100 second through a gelatin filter SC-39 manufactured by Fuji Photo Film Co., Ltd. and a continuous wedge.

The sample after being exposed was processed by the same method as described in Example 1.

The speed and graininess of the red-sensitive layer, green-sensitive layer and blue-sensitive layer were determined using the method described in Example 1.

TABLE 8

| Sample No. | Compound of general formula (M) or general formula (C) No. | Addition amount (per mol of Ag × $10^{-3}$mol) 6th layer | 11th layer | 14th layer | Speed R layer | G layer | B layer | Graininess R layer | G layer | B layer |
|---|---|---|---|---|---|---|---|---|---|---|
| 301 (Comp.) | — | — | — | — | 0.00 | 0.00 | 0.00 | 100 | 100 | 100 |
| 302 (Comp.) | Comparative compound A | 14 | 14 | 12 | +0.03 | +0.03 | +0.03 | 101 | 101 | 102 |
| 303 (Inv.) | (86) | 14 | 14 | 12 | +0.06 | +0.05 | +0.05 | 101 | 101 | 101 |
| 304 (Inv.) | (88) | 14 | 14 | 12 | +0.07 | +0.07 | +0.06 | 100 | 101 | 101 |
| 305 (Inv.) | (93) | 14 | 14 | 12 | +0.11 | +0.10 | +0.08 | 101 | 100 | 100 |
| 306 (Inv.) | (100) | 14 | 14 | 12 | +0.10 | +0.09 | +0.08 | 101 | 101 | 101 |
| 307 (Inv.) | (101) | 14 | 14 | 12 | +0.09 | +0.08 | +0.07 | 101 | 100 | 100 |
| 308 (Inv.) | (106) | 14 | 14 | 12 | +0.09 | +0.08 | +0.07 | 101 | 101 | 100 |
| 309 (Inv.) | (89) | 14 | 14 | 12 | +0.09 | +0.08 | +0.07 | 101 | 101 | 101 |
| 310 (Inv.) | (97) | 14 | 14 | 12 | +0.08 | +0.07 | +0.06 | 102 | 100 | 101 |
| 311 (Inv.) | (104) | 14 | 14 | 12 | +0.08 | +0.07 | +0.06 | 102 | 102 | 101 |
| 312 (Inv.) | (110) | 14 | 14 | 12 | +0.11 | +0.10 | +0.08 | 102 | 101 | 102 |
| 313 (Inv.) | (111) | 14 | 14 | 12 | +0.07 | +0.07 | +0.06 | 101 | 101 | 101 |

Note:
R layer = Red-sensitive layer;
G layer = Blue-sensitive layer;
B layer = Blue-sensitive layer It is apparent from the above results that the method of the present invention is excellent in obtaining a high quality image. This is made possible by increasing the speed of the photosensitive material without deteriorating the graininess.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A method of increasing speed of a silver halide color photosensitive material by using at least one type of compound represented by the following general formula (M-1):

(M-1)

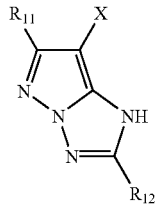

in the general formula (M-1), $R_{11}$ and $R_{12}$ independently represent a substituent; and X represents a hydrogen atom or substituent; and wherein, in the formula (M-1), the total number of carbon atoms of $R_{11}$, $R_{12}$ and X is 13 to 50, wherein the compound represented by the general formula (M-1) is added to a blue-sensitive silver halide emulsion layer or a red-sensitive silver both of the blue-sensitive silver halide emulsion layer and the red-sensitive silver halide emulsion layer, and wherein the compound represented by the general formula (M-1) is added to the highest speed silver halide light sensitive layer of the blue-sensitive silver halide emulsion layer, the red-sensitive silver halide emulsion layer or both of the blue-sensitive silver halide emulsion layer and the red-sensitive silver halide emulsion layer.

2. The method of increasing speed of a silver halide color photosensitive material according to claim 1, wherein the general formula (M-1) is represented by the general formula (M-3):

(M-3)

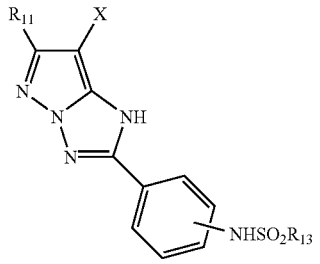

wherein $R_{11}$ and $R_{13}$ independently represent a substituent; and X represents a hydrogen atom or substituent.

3. The method of increasing speed of a silver halide color photosensitive material according to claim 1, wherein the addition of the compound represented by the general formula (M-1) changes film pAg (ΔpAgF) of the silver halide color photosensitive material by 0 to 0.3.

4. The method of increasing speed of a silver halide color photosensitive material according to claim 1, wherein the compound represented by the general formula (M-1) has a pKa value of 6.0 to 8.4.

5. The method of increasing speed of a silver halide color photosensitive material according to claim 1, wherein the compound represented by the general formula (M-1) has a reactivity (CRV) with an oxidized color developing agent of 0.01 to 0.1.

6. The method of increasing speed of a silver halide color photosensitive material according to claim 1, wherein, in the general formula (M-1), X represents an alkyl group, alkoxycarbonyl group, carbamoyl group or a group that leaves by a reaction with an oxidized developing agent.

7. The method of increasing speed of a silver halide color photosensitive material according to claim 2, wherein the compound represented by the general formula (M-3) has a reactivity (CRV) with an oxidized color developing agent of 0.01 to 0.1.

8. The method of increasing speed of a silver halide color photosensitive material according to claim 6, wherein the compound represented by the general formula (M-1) has a reactivity (CRV) with an oxidized color developing agent of 0.01 to 0.1.

9. The method of increasing speed of a silver halide color photosensitive material according to claim 1, wherein the compound represented by the general formula (M-1) is added to a red-sensitive silver halide emulsion layer of the silver halide color photosensitive material.

10. The method of increasing speed of a silver halide color photosensitive material according to claim 1, wherein the compound represented by the general formula (M-1) is added to a blue-sensitive silver halide emulsion layer of the silver halide color photosensitive material.

11. The method of increasing speed of a silver halide color photosensitive material according to claim 1, wherein a layer of the photosensitive material containing tabular grains having an average aspect ratio of 8 or more, contains at least one compound represented by the general formula (M-1) described in claim 1.

12. The method of increasing speed of a silver halide color photosensitive material according to claim 1, wherein the compound represented by the general formula (M-1) is added further to a non-sensitive layer.

* * * * *